United States Patent [19]

Inoue et al.

[11] Patent Number: 4,948,712

[45] Date of Patent: Aug. 14, 1990

[54] DIRECT POSITIVE PHOTOGRAPHIC MATERIALS AND A METHOD OF FORMING DIRECT POSITIVE IMAGES

[75] Inventors: Noriyuki Inoue; Tatsuo Heki; Hidetoshi Kobayashi; Naoyasu Deguchi; Shigeo Hirano, all of Kanagawa, Japan

[73] Assignee: Fuji Photo Film Co., Ltd., Kanagawa, Japan

[21] Appl. No.: 184,552

[22] PCT Filed: Aug. 14, 1987

[86] PCT No.: PCT/JP87/00609

§ 371 Date: Jun. 7, 1988

§ 102(e) Date: Jun. 7, 1988

[87] PCT Pub. No.: WO88/01402

PCT Pub. Date: Feb. 25, 1988

[30] Foreign Application Priority Data

Aug. 15, 1986 [JP] Japan ..... 61-190628

[51] Int. Cl.[5] ..... G03C 1/485; G03C 5/26

[52] U.S. Cl. ..... 430/409; 430/410; 430/544; 430/547; 430/598; 430/955

[58] Field of Search ..... 430/409, 410, 544, 547, 430/598, 955

[56] References Cited

U.S. PATENT DOCUMENTS

| | | | |
|---|---|---|---|
| 4,390,618 | 3/1979 | Takagi . | |
| 4,582,779 | 4/1986 | Kubota et al. | 430/409 |
| 4,618,572 | 10/1986 | Mihayashi et al. | 430/543 |
| 4,628,024 | 3/1981 | Takagi . | |
| 4,656,123 | 4/1987 | Mihayashi et al. | 430/543 |
| 4,724,199 | 12/1978 | Takagi . | |
| 4,746,601 | 5/1988 | Mihayashi et al. | 430/543 |
| 4,835,091 | 5/1989 | Inoue et al. | 430/378 |

*Primary Examiner*—Paul R. Michl
*Assistant Examiner*—Janet C. Baxter
*Attorney, Agent, or Firm*—Sughrue, Mion, Zinn, Macpeak & Seas

[57] ABSTRACT

The invention provides (1) direct positive photographic photosensitive materials in which at least one type of FR compound which releases fogging agent or development accelerator or a precursor thereof in accordance with the amount of silver developed when the silver halide is being developed is included in a direct positive photographic material comprising at least one layer of non-pre-fogged internal latent image type silver halide emulsion on a support, and (2) a method of forming direct positive images of which the distinguishing features are that in a method for the formation of direct positive images in which a direct positive photographic photosensitive material comprising at least one layer of non-pre-fogged internal latent image forming silver halide emulsion on a support is processed, after image exposure, in a surface developer, at least one type of FR compound which releases fogging agent or development accelerator or precursors thereof is included in the said photographic mateiral, and that the said photosensitive material is subjected to a fogging process and to a development process during and/or after the said fogging process.

It is possible by means of this invention to obtain direct positive photographic materials which have excellent stability with respect to the passage of time and especially good stability with respect to the passage of time under conditions of high temperature and high humidity.

Moreover, it is possible to obtain direct positive photographic materials and a method of forming direct positive images which have a high maximum image density and a high resolving power.

Moreover, it is possible to obtain direct positive photographic materials and a method of forming direct positive images with which direct positive images which have a satisfactorily high color density can be obtained, even on processing in highly stable developers of low pH.

12 Claims, No Drawings

DIRECT POSITIVE PHOTOGRAPHIC MATERIALS AND A METHOD OF FORMING DIRECT POSITIVE IMAGES

FIELD OF TECHNOLOGY

This invention concerns direct positive silver halide photographic materials and a method of forming direct positive images.

PRIOR ART

Photographic processes for obtaining positive images directly without the need for a reversal process or negative film are well known.

The conventionally known methods used to form positive images with direct positive silver halide photographic materials can, if special cases are excluded, be divided into two main types, having regard to their practical use.

Thus, in methods of the first type a pre-fogged silver halide emulsion is used and a direct positive image is obtained after development by destroying the fogged nuclei (latent image) in the exposed part by means of solarization or a Herschel effect, for example.

In methods of the second type an unfogged internal latent image type silver halide emulsion is employed and a direct positive image is obtained after imagewise exposure by means of surface development either after or during a fogging process.

The above mentioned internal latent image type silver halide photographic emulsions are silver halide photographic emulsions of the type which have internal light-sensitive nuclei principally inside silver halide grains and they are such that the latent image is formed by the exposing light mainly within these grains.

The methods of the latter type generally have a higher sensitivity than methods of the former type and they are suitable for use in application where a high sensitivity is required. This invention concerns methods of the latter type.

Various techniques are already well known in this field. Thus the principal techniques are disclosed for example in U.S. Pat. Nos. 2,592,250, 2,466,957, 2,497,875, 2,588,982, 3,317,322, 3,761,266, 3,761,276 and 3,796,577 and in British Pat. Nos. 1,151,363, 1,150,553 and 1,011,062.

Comparatively high speed photographic materials of the direct positive type can be made using these known methods.

Furthermore, details of the mechanism by which the direct positive image is formed have been disclosed for example by T. H. James in *The Theory of the Photographic Process*, 4th Edition, Chapter 7, pp. 182 to 193, and in U.S. Pat. No. 3,761,276.

Thus, it is believed that fogging nuclei are formed selectively only on the surfaces of silver halide grains in the unexposed parts as a result of a surface desensitizing action originating from the so-called internal latent image which has been formed inside the silver halide grains by the initial imagewise exposure, and then the photographic image (direct positive image) is formed in the unexposed parts by means of what might be termed a normal surface development process.

Methods generally known as light fogging methods in which a second exposure is given to the whole of the light sensitive layer (for example, see British Pat. No. 1,151,363) and methods known as chemical fogging methods in which a nucleating agent is used are already known as methods used in the selective formation of the fogging nuclei. The latter method is disclosed for example on pages 76 to 78 of *Research Disclosure*, Vol. 151, No. 15162 (published in November 1976).

An internal latent image type silver halide photosensitive material can be subjected to a surface color development process after carrying out a fogging treatment or while carrying out a fogging treatment and then to bleaching and fixing processes (or a bleach-fix process) to form a direct positive color image. A water wash and/or stabilization treatment is normally carried out after the bleaching and fixing processes.

The development speed is slower and a longer processing time than that required for negative type materials is required to form direct positive images using light fogging or chemical fogging methods of this type and so conventionally the pH of the developer and/or the developer temperature has/have been raised to shorten the processing time. However, in general problems arise with rising minimum image density in the direct positive images obtained when the pH is raised. Furthermore, the developing agent itself is more liable to deteriorate due to aerial oxidation under conditions of high pH, and the pH is liable to fall as a result of the absorption of carbon dioxide gas from the atmosphere. This results in a considerable reduction in developer activity.

Other known means of raising the development speed in direct positive image formation include the use of hydroquinone derivatives (U.S. Pat. No. 3,227,552), and the use of mercapto compounds which have carboxylic acid groups or sulfonic acid groups (Japanese Patent Application (OPI) No. 170843/85 (the term "OPI" as used herein means a "published unexamined patent application")) but the use of these compounds has little effect and no way has yet been discovered for raising the maximum density of direct positive images effectively. The provision of a technique with which it is possible to obtain adequate maximum image density while processing with a low pH developer is therefore especially desirable.

On the other hand, there is a problem with direct positive photosensitive materials in that if the unexposed regions remaining when the image is exposed are narrow, the maximum image density is much lower in these regions than it is in wider unexposed regions. Consequently direct positive photosensitive materials tend to have lower resolving power than negative photosensitive materials and a means of overcoming this problem is also desirable.

Furthermore, a surface chemical sensitization treatment can be carried out in order to increase the maximum density of the resulting direct positive image, especially in the case of core/shell type silver halide emulsions, but surface chemical sensitization must normally be stopped at an appropriate level in order to avoid problems with rinsing minimum density which arises as a result of excessive chemical sensitization, with reduction in sensitivity and with the formation of false images in the parts which have been subjected to a high level of exposure. Moreover, the nuclei which are formed at this time by surface chemical sensitization are weak in comparison to those usually obtained with negative type materials and their stability with respect to the passage of time is very poor.

The addition of conventional well known stabilizers such as 4-hydroxy-6methyl--1,3,3a,7-tetrazaindene, 1-phenyl-5-mercaptotetrazole etc. has been investigated as a means of improving such failings, but these materials must be added in large quantities in order to present any changes from occurring in performance with the passage of time and it has been impossible to avoid the various adverse effects which these materials have on the photographic performance of the material. Actual examples of such adverse effects include a lowering of the maximum density of the positive image as a result of an action of development inhibitor and an increase in re-reversal image sensitivity and, moreover, action of obstructing the adsorption of the sensitizing dyes which ar often used in silver halide emulsions to improve spectral sensitivity and impede any increase in spectral sensitivity by these compounds. So the discovery of a technique with which these adverse effects could be avoided and with which stability with respect to time could be improved is also desirable.

On the basis of the facts outlined above, it is clearly difficult to obtain easily direct positive photosensitive materials which, in addition to having a satisfactory maximum image density, have excellent resolving power and stability with respect to the passage of time, irrespective of whether the conventional techniques are employed individually or conjointly.

The object of this invention is to provide direct positive photosensitive materials which have good storage properties and which, more precisely, have excellent storage properties under conditions of high temperature and high humidity.

Moreover, the invention provides direct positive photosensitive materials and a method of forming direct positive images with which it is possible to obtain direct positive images which have a high maximum image density and a high resolving power.

Moreover, the invention provides direct positive photosensitive materials and a method of forming direct positive images with which it is possible to form direct positive images with a sufficiently high color density even when processed with a highly stable low pH developer.

DISCLOSURE OF THE INVENTION

It has been discovered that the above mentioned objects can be achieved by means of (1) direct positive photographic photosensitive materials of which the distinguishing feature is that at least one type of compound (referred to below as an FR compound) which releases fogging agent or development accelerator (referred to below as FA) or a precursor thereof in accordance with the amount of silver developed when the silver halide is being developed is included in a direct positive photographic material comprising at least one photographic emulsion layer which contains internal latent image type silver halide grains which have not been prefogged on a support, and (2) a method of forming direct positive images of which the distinguishing features are that in a method for the formation of direct positive images in which a direct positive photographic photosensitive materials comprising at least one layer of non-pre-fogged internal latent image forming silver halide emulsion on a support is processed, after imagewise exposure, in a surface developer, at least one type of FR compound which releases fogging agent or development accelerator or precursors thereof is included in the said photographic material, and that the said photosensitive material is subjected to a fogging process and to a development process during and/or after the fogging process.

As a result of various studies carried out with a view to achieving the above mentioned objects, the inventors discovered that they could be achieved with unexpected effectiveness by using an FR compound and the invention is based upon this discovery.

Conventionally, FR compounds have been used principally in films for color photography in order to provide photographs which have a high maximum image density and gradation, and their use in color printing papers (color papers) has also been proposed (for example, see Japanese Patent Application (OPI) No. 150845/82). However, both of these cases involve negative emulsions in which the latent image is formed mainly on the surfaces of the silver halide grains and while these compounds have long been known to have the effect of increasing maximum image density it has not been realized that the inherent technical problems of internal latent image type direct positive emulsions in which the latent image is formed principally within the silver halide grains as described earlier (for example improvement of the resolving power and the storage properties of the photosensitive material etc.) could be resolved by means of FR compounds.

MODE OF EXECUTION OF THE INVENTION

The FR compounds of the invention can be added to any photographic layer but the addition of these compounds to the photographic emulsion layer is preferred.

Moreover, reducing compounds (hydrazines, hydrazides, hydrazones, hydroquinone, catechol, p-aminophenols, p-phenylenediamines, 1-phenyl-3-pyrazolidinone, enamines, aldehydes, polyamines, acetylenes, aminoboranes and quaternary salts of carbazinic acids such as tetrazolium salts, ethylenebispyridinium salts etc.) and compounds which can form silver sulfide during development (for example compounds which have

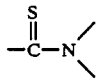

as part of their structure, such as thiourea, thioamides, dithiocarbamates, rhodanine, thiohydantoin, thiazolidinethiones) etc. can be used as the fogging agent or development accelerator (FA).

The FR compounds which can be used in the invention include the following:

(i) Couplers which couple with the oxidation products of primary aromatic amine developing agents and release FA compounds or precursors thereof.

(ii) Couplers which couple with the oxidation products of primary aromatic amine developing agents to form diffusible coupling products and with which the said coupling products function as FA compounds or precursors thereof.

(iii) Redox compounds which release FA compounds or precursors thereof by way of an oxidation-reduction reaction with the oxidation products of the primary aromatic amine developing agent or by way of a later continuation of the said reaction.

The above mentioned compound types (i), (ii) and (iii) can be represented respectively by the general formulae [1], [2] and [3] below:

$$Cp—(TIME)_n—FA \quad (1)$$

$$BALL—Cp—(TIME)_n—FA \quad (2)$$

$$RED—(TIME)_n—FA \quad (3)$$

In these formulae Cp is a coupling group residue which is able to undergo a coupling reaction with the oxidized form of a primary aromatic amine developing agent, BALL is group fast to diffusion which can be separated from Cp by means of a coupling reaction with the primary aromatic amine developing agent and RED is a compound residual group which can undergo an oxidation-reduction reaction with the oxidized form of the primary aromatic amine developing agent.

TIME is a timing group which releases the FA compound after being separated from Cp or RED by means of a coupling reaction.

Moreover n is 0 or 1 and if n is zero then FA is a group which can be separated from Cp or RED by means of a coupling reaction and if n is 1 then FA is a group which can be released from TIME (in the case of compounds which can be represented by [2] in the above formula FA may not be separated from Cp or TIME after the coupling reaction.)

Here, FA is a fogging agent or development accelerator which acts upon the silver halide grains during development and forms fogging nuclei at which development can begin. FA can take the form of a group which acts reductively on the silver halide grains during development to form fogging nuclei at which development can begin or a group which acts upon the silver halide grains and forms silver sulfide nuclei which are fogging nuclei at which development can begin.

Groups which contain a group which can be adsorbed on silver halide grains are preferred for FA and such groups can be represented by the following formula:

$$AD—(L)_m—X$$

Here AD represents a group which can be adsorbed on silver halide, L represents a divalent group and m is 0 or 1. X is a reducing group or a group which acts upon silver halide and forms silver sulfide. In the latter case X may also have the function of AD and the structure AD—(L)m— is not always required.

In cases where FA is a group which can be represented by $AD—(L)_m—X$ then TIME, Cp or RED can be bonded to any position of the $AD—(L)_m—X$ structure.

In the general formula [1] the unit $—(TIME)_n—FA$ is bonded to the coupling position of Cp and this bond is broken when the coupling reaction occurs.

In the general formula [2] the unit BALL is bonded to the coupling position of Cp and this bond is broken when the coupling reaction occurs. Furthermore, the unit $—(TIME)_n—FA$ is bonded to a non-coupling position of Cp and so this bond is not broken immediately by the coupling reaction.

In the general formula [3] the unit $—(TIME)_n—FA$ is bonded to a position where it can be released from the unit RED by an oxidation reduction reaction of RED with the oxidized form of the primary aromatic amine developing agent or by a subsequent reaction.

On the other hand, the group represented by TIME may also be a trivalent group in the case of general formula [1]. That is to say, there are cases in which FA is bonded to one of the three bonds, Cp is bonded by its coupling position to one of the remaining two bonds and the third bond is made with a non-coupling position of Cp. The distinguishing feature of compounds which have a structure of this type is that the bond with TIME at the coupling position is broken when the coupling reaction with the primary aromatic amine developing agent occurs, but the bond with TIME at the non-coupling position is not cleaved at this time and the bonding part (anion) of TIME which has been cleaved can cleave the bond with FA and can then release FA via an intramolecular electron transfer and/or intramolecular nucleophilic substitution reaction of the unit TIME. Hence in the case of a compound of this type it is necessary to have a structure which is not only trivalent but which can also release FA by means of an intramolecular electron transfer and/or intramolecular nucleophilic substitution reaction.

General formulae [1], [2] and [3] are described in greater detail below.

In general formula [1] the coupling group residue Cp may have part of the structure of a colorless coupler or a black coupler as well as a yellow, magenta or cyan coupler, as described below.

Typical examples of yellow couplers are disclosed in U.S. Pat. Nos. 2,875,057, 2,407,210, 3,265,506, 2,298,443, 3,048,194 and 3,447,928 etc. Of these the preferred yellow couplers are the acylacetoamide derivatives such as benzoylacetoanilide and pivaloylacetoanilide etc.

Hence the groups shown as general formulae [Ia] and [IIa] below are ideal yellow coupling group residues (Cp).

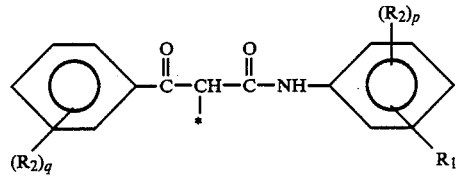

[Ia]

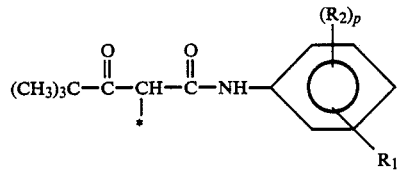

[IIa]

In these formulae * indicates the position at which the coupling group residue is bonded to the FA group or the TIME group. (The same mark is used for this purposes below in the general formula up to number [XVa]).

In these formulae $R_1$ is a group which has a total of 8 to 32 carbon atoms and which is fast to diffusion and $R_2$ is a hydrogen atom, halogen atom, lower alkyl group, lower alkoxy group or a group which has a total of 8 to 32 carbon atoms and which is fast to diffusion. Moreover p is an integer of value 1 to 4 and q is an integer of value 1 to 5. In cases where p, q has a value of 2 or more then the $R_2$ groups may be the same or different.

Typical examples of magenta couplers are disclosed in U.S. Pat. Nos. 2,600,788, 2,369,489, 2,343,703, 2,311,082, 3,152,896, 3,519,429, 3,062,653, 2,908,573, Japanese Patent Publication No. 27411/72 and Japanese Patent Application (OPI) Nos. 171956/84, 162548/84, 33552/85, 43659/85 and 172982/85 etc. Of these the preferred magenta couplers are pyrazolone or pyrazoloazoles (pyrazolopyrazole, pyrazoloimidazole, pyrazolotriazole, pyrazolotetrazole etc.)

Hence the groups represented by the general formulae [IIIa], [IVa] and [Va] below are ideal magenta coupling group residues (Cp).

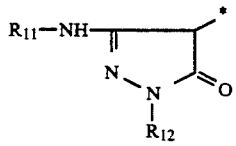

[IIIa]

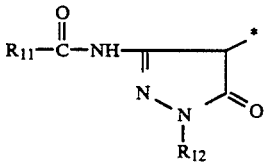

[IVa]

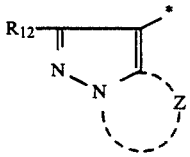

[Va] (sic)

In these formulae $R_{11}$ represents a group which has a total of 8 to 32 carbon atoms and which is fast to diffusion and $R_{12}$ is a halogen atom, lower alkyl group, lower alkoxy group, phenyl group or substituted phenyl group. Z represents a non-metallic atomic group required to from a 5-membered azole ring which contains 2 to 4 nitrogen atoms and the said azole ring may have substituents (including condensed rings) and the said substituents may be groups which are fast to diffusion.

Typical examples of cyan couplers are disclosed in U.S. Pat. Nos. 2,772,162, 2,895,826, 3,002,836, 3,034,892, 2,474,293, 2,423,730, 2,367,531, 3,041,236, Japanese Patent Application (OPI) Nos. 99341/81, 155538/82, 204545/82, 189154/83, 31953/84, 118643/83, 187928/83, 213748/83 and U.S. Pat. No. 4,333,999 etc. Of these the phenols and naphthols are the preferred cyan couplers.

Hence the groups represented by the general formulae [VIa], [VIIa], [VIIIa] and [IXa] below are ideal cyan coupling group residues (Cp).

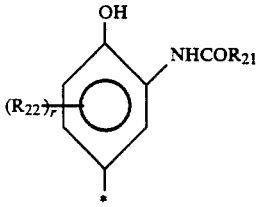

[VIa]

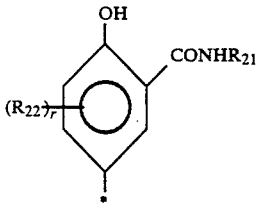

[VIIa]

-continued

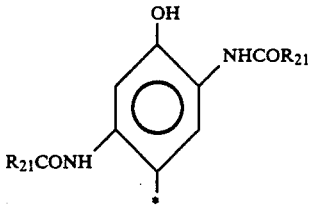

[VIIIa]

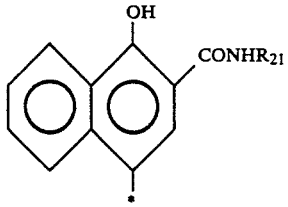

[IXa]

In these formulae $R_{21}$ represents a group which has a total of 8 to 32 carbon atoms and which is fast to diffusion, $R_{22}$ represents a halogen atom, lower alkyl group, or lower alkoxy group and r is an integer of value 1 to 3. In cases where r is 2 or more the $R_{22}$ groups may be same or different.

Furthermore, Cp may also be a colorless coupler.

Typical examples of colorless couplers are disclosed in U.S. Pat. Nos. 3,912,513, 4,204,867 and in Japanese Patent Application (OPI) No. 152721/77.

Typical examples of these colorless couplers have skeletons which can be represented by the general formulae [Xa], [XIa] and [XIIa] below:

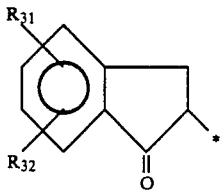

[Xa]

Here $R_{31}$ represents a group which has a total of 8 to 32 carbon atoms and which is fast to diffusion and $R_{32}$ represents a hydrogen atom, halogen atom, lower alkyl group or a lower alkoxy group.

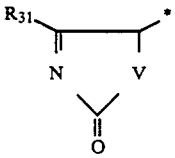

[XIa]

Here $R_{31}$ represents a group which has a total of 8 to 32 carbon atoms and which is fast to diffusion and V represents an oxygen atom, sulfur atom or an

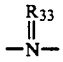

group. $R_{33}$ represents a hydrogen atom or an alkyl group which has 1 to 32 carbon atoms.

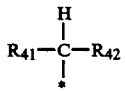

[XIIa]

Here $R_{41}$ and $R_{42}$ each represent an alkoxycarbonyl group, aminocarbonyl group, acyl group, alkoxysulfonyl group, alkoxysulfinyl group, sulfamoyl group, sulfinamoyl group, sulfonyl group, sulfinyl group, cyano group, ammoniumyl group or a heterocyclic ring which is bonded with a nitrogen atom. $R_{41}$ and $R_{42}$ may be bonded to form a 5 or 6 membered ring.

As well as the groups described above Cp may be a color forming coupler group residue which reacts with the oxidized form of the developing agent to form a black coloration. Examples of these couplers are disclosed in U.S. Pat. Nos. 1,939,231, 2,181,944, 2,333,106, 4,126,461 and West German Patent Application (OLS) Nos. 2,644,194 and 2,650,764 etc. Actual examples of these coupling group residues can be represented by the general formulae XIIIa], [XIVa] and [XVa] below:

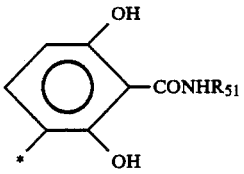

[XIIIa]

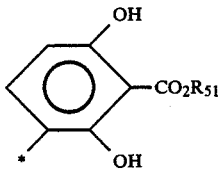

[XIVa]

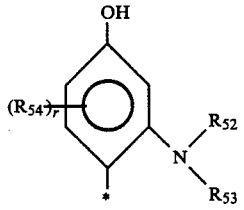

[XVa]

In these formulae $R_{51}$ represents an alkyl group which has 3 to 20 carbon atoms, or a phenyl group (the said phenyl group may be substituted with hydroxyl groups, halogen atoms, amino groups and alkyl or alkoxy groups which have 1 to 20 carbon atoms). $R_{52}$ and $R_{53}$ represent independently a hydrogen atom, halogen atom, alkyl or alkenyl group which has 1 to 20 carbon atoms or an aryl group which has 6 to 20 carbon atoms. $R_{54}$ represents a halogen atom, alkyl or alkoxy group which has 1 to 20 carbon atoms or some other univalent organic group and r represents an integer of value 1 to 3. In cases where r is 2 or more the $R_{54}$ groups may be the same of different.

The Cp represented by the general formula [Ia]-[XVa] above may form dimers or more polymers via parts other than the coupling parts and they may also be bonded to polymers via these parts.

In general formula [2] the coupling group residue represented by Cp has a part structure which can be represented by the general formulae [Ia]-[XVa] as described above and these are bonded to BALL at the position indicated * and to —(TIME)$_n$—FA at one other position.

In general formula [2] the group represented by BALL which is fast to diffusion has a size and form such that it renders the coupler fast to diffusion and this may take the form of a polymer to which a plurality of eliminating groups are coupled or it may have alkyl groups and/or aryl groups which render the group fast to diffusion. In the latter case the alkyl groups and/or aryl groups preferably have 8 to 32 carbon atoms in total. BALL is a group for bonding to the coupling position of Cp and typically takes the form —O—, —S—, —N=N—,

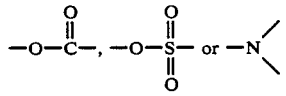

in a heterocyclic structure.

The group represented by RED in general formula [3] represents a group which has a hydroquinone, catechol, o-aminophenyl or p-aminophenol skeleton and which undergoes an oxidation-reduction reaction with the oxidized form of a primary aromatic amine developing agent and then undergoes alkali hydrolysis to release the —(TIME)$_n$—FA group (this group is abbreviated to FR in general formulae [XVIa] to [XXIa] below).

Actual examples of this group are shown in general formulae [XVIa] to [XXIa].

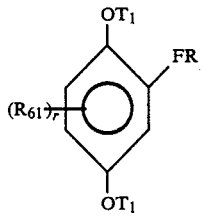

[XVIa]

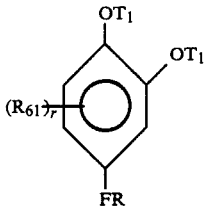

[XVIIa]

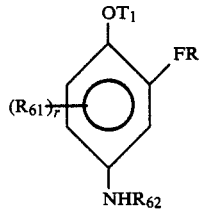

[XVIIIa]

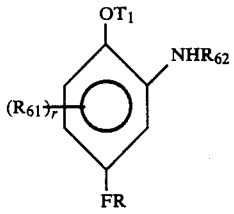

[XIXa]

-continued

[XXa]

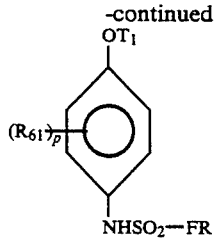

[XXIa]

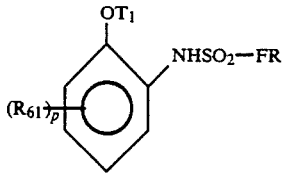

In these formulae $R_{61}$ represents a hydrogen atom, halogen atom, alkyl group, aryl group, alkoxy group, aryloxy group, alkylthio group, arylthio group, cyano group, alkoxycarbonyl group, carbamoyl group, sulfamoyl group, carboxyl group, sulfo group, sulfonyl group, acyl group, carbonamido group, sulfonamido group or a heterocyclic group, r represents an integer of value 1 to 3 and p an integer of value 1 to 4. In cases where p, r are 2 or more the $R_{61}$ groups may be the same or different, and 2 groups of vic-position may be bonded to take the form of a benzene ring or a 5 to 7 membered heterocyclic ring. $R_{62}$ represents an alkyl group, aryl group, acyl group, carbamoyl group, sulfonyl group or a sulfamoyl group. $T_1$ represents a hydrogen atom, or a group which can be eliminated by hydrolysis under alkaline conditions. In cases where there are two $T_1$ groups in one molecule the two groups may be different. Hydrogen atom, acyl group, sulfonyl group, alkoxycarbonyl group, carbamoyl group, oxyaryl group etc. are typical examples of the group $T_1$.

The timing groups represented by TIME include those which eliminate FA by means of an intramolecular substitution reaction after the elimination of Cp or RED by means of a coupling reaction or an oxidation-reduction reaction as disclosed in U.S. Pat. No. 4,248,962 or Japanese Patent Application (OPI) No. 56837/82, those from which FA is eliminated by an electron transfer via a conjugated system as disclosed in British Pat. No. 2,072,363A, Japanese Patent Application (OPI) Nos. 154234/82, 188035/82, 114946/81, 56837/82, 209736/83, 209737/83, 209738/83, 209740/83, 98728/83 etc. and those in which there is a coupling component which can eliminate FA by means of a coupling reaction with the oxidized form of the primary aromatic amine developing agent such as that disclosed in Japanese Patent Application (OPI) No. 111536/82. These reactions may take place in a single step or via a number of steps.

Furthermore trivalent TIME groups which are bonded to FA, the coupling position and a non-coupling position as mentioned earlier are preferred (an example of a combination with a yellow coupler is disclosed in Japanese Patent Application (OPI) No. 209740/83).

When FA is a group which contains an AD—$(L-)_m$—X unit the AD may be bonded directly to the carbon atom at the coupling position and both L and X may be groups which can be eliminated by the coupling reaction, being bonded to the coupling carbon. Moreover a group known as a two equivalent elimination group may be present between the coupling carbon and AD. Such a two equivalent elimination group may be an alkoxy group (for example a methoxy group), an aryloxy group, (for example a phenoxy group), an alkylthio group (for example an ethylthio group), an arylthio group (for example a phenylthio group), a heterocyclic oxy group (for example tertazolyl oxy group), a heterocyclic thio group, (for example a pyridylthio group), a heterocyclic group (for example a hydantoinyl group, pyrazolyl group, a triazolyl group, benzotriazolyl group etc.). Furthermore the groups disclosed in British Pat. No. 2,011,391 can be used for FA.

The groups which can be adsorbed on silver halide which are represented by AD include nitrogen-containing heterocyclic compounds which have a dissociable hydrogen atom (pyrrole, imidazole, pyrazole, triazole, tetrazole, benzimidazole, benzopyrazole, benzotriazole, uracil, tetraazaindene, imidazotetrazole, pyrazolotriazole, pentaazaindene etc.), heterocyclic compounds which have at least one nitrogen atom and other hetero atoms (oxygen, sulfur, selenium atoms etc.) in the ring (oxazole, thiazole, thiazoline, thiazolidine, thiadiazole, benzothiazole, benzoxazole, benzselenazole etc.), heterocyclic compounds which have mercapto groups (2-mercaptobenzthiazole, 2-mercaptopyrimidine, 2-mercaptobenzoxazole, 1-phenyl-5-mercaptotetrazole etc.), quaternary salts (quaternary salts of tertiary amines, pyridine, quinoline, benzthiazole, benzimidazole, benzoxazole etc.), thiophenols, alkylthiols (cystine etc.) and compounds which contain the structural unit

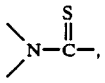

(for example, thiourea, dithiocarbamate, thioamide, rhodanine, thiazolidinethione, thiohydantoin, thiobarbituric acid etc.).

The divalent linking group represented by L in FA has a structure selected from among alkylene, alkenylene, phenylene, naphthylene, —O—, —S—, —SO—, —$SO_2$—, —N=N—, carbonyl, amido, thioamido, sulphonamido, ureido, thioureido, heterocyclic ring etc.

It is possible to control or deactivate the fogging action by selecting a group which can be cleaved by the action of a component of the developer solution (for example hydroxide ion, hydroxylamine, sodium sulfite ion etc.) as one of the divalent linking groups which constitute L.

The groups which are represented by X are reducing compounds (hydrazine, hydrazide, hydrazone, hydroquinone, catechol, p-aminophenol, p-phenylenediamine, 1-phenyl-3-pyrazolidinone, enamine, aldehyde, polyamine, acetylene, aminoborane, tetrazolium salt, quaternary carbazinic acid salts such as ethylenebis-pyridinium salt, etc.) or compounds which can form silver sulfide during development (for example compounds which contain the structural unit

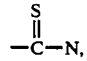

such as thiourea, thioamides, dithiocarbamates, rhodanine, thiohydantoin, thiazolidine thione etc.). Some of the groups which are represented by X which can form silver sulfide during development may have the ability to become adsorbed on silver halide grains and they can also function as the group AD which has adsorption properties.

The most preferred FA groups are represented by the general formulae [XXIIa] and [XXIIIa] below.

General formula [XXIIa]

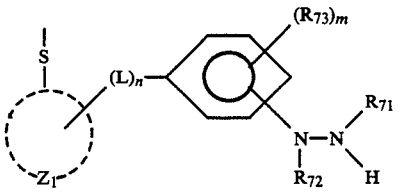

General formula [XXIIIa]

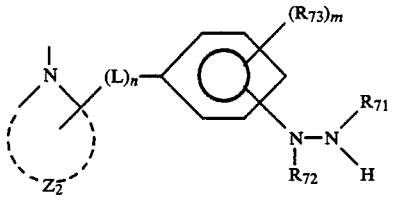

In these formulae $R_{71}$ represents an acyl group, carbamoyl group, alkylsulfonyl group, arylsulfonyl group, alkoxycarbonyl group, aryloxycarbonyl group, or a sulfamoyl group, $R_{72}$ represents a hydrogen atom, acyl group, alkoxycarbonyl group or an aryloxycarbonyl group and $R_{73}$ represents a halogen atom, alkoxy group, alkyl group, alkenyl group, aryl group, aryloxy group, alkylthio group, arylthio group, carbonamido group or a sulfonamido group. Moreover m is an integer of value 0 to 4 and in cases where m is 2 or more the $R_{73}$ groups may be the same or different and when two or more groups are bonded they may take the form of a condensed ring. L has the same significance as described earlier, which is to say that it represents a divalent linking group, and n has the value of 0 or 1. $Z_1$ represents a group of non-metallic atoms required to form a single or condensed heterocyclic ring and $Z_2$ represents a group of non-metallic atoms required together with nitrogen to form a single or condensed heterocyclic ring.

Examples of the substituent groups are described in detail below. Thus $R_{71}$ may be an acyl group, (formyl group, acetyl group, propionyl group, trifluoroacetyl group, pyruvoyl group etc.), a carbamoyl group (dimethylcarbamoyl group etc.), an alkylsulfonyl group (methanesulfonyl group etc.), an arylsulfonyl group (benzensulfonyl group etc.), an alkoxycarbonyl group (methoxycarbonyl group etc.), aryloxycarbonyl group (phenoxycarbonyl group etc.), or a sulfamoyl group (methylsulfamoyl group etc.), $R_{72}$ may be a hydrogen atom, or an acyl group (trifluoroacetyl group etc.), alkoxycarbonyl group (methoxycarbonyl group etc.), or an aryloxycarbonyl group (phenoxycarbonyl group etc.) and $R_{73}$ may be a halogen atom (fluorine atom, chlorine atom etc.) or an alkoxy group (methoxy group, methoxyethoxy group etc.), alkyl group (methyl group, hydroxymethyl group etc.), alkenyl group (allyl group etc.), aryl group (phenyl group etc.), aryloxy group (phenoxy group etc.) alkylthio group (methylthio group etc.), arylthio group (phenylthio group etc.), carbonamide group (acetoamide group etc.) or a sulphonamide group (methanesulphonamide group etc.).

Examples of

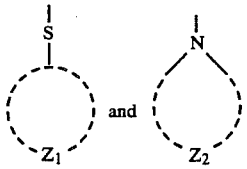

are indicated later among the examples of the AD group.

Examples of the FR compounds used in the invention are disclosed in Japanese Patent Application (OPI) Nos. 150845/82, 50439/84, 157638/84, 170840/84, 37556/85, 167029/85, 128446/85 etc.

Examples of AD are indicated below. The free bonds are linked to $-(L)_m-X$ and $-(TIME)_n-$.

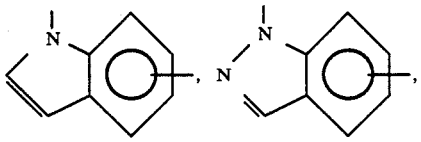

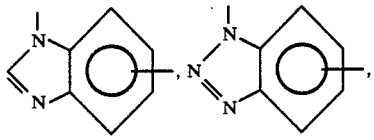

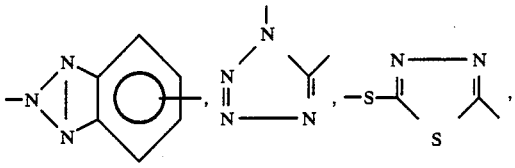

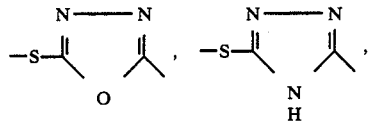

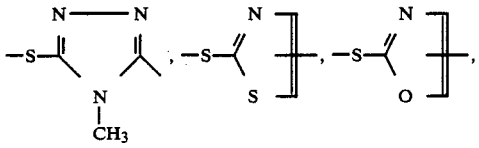

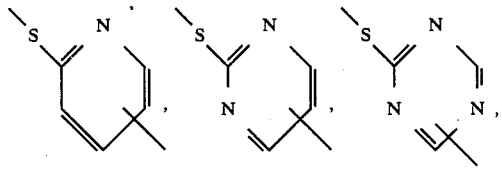

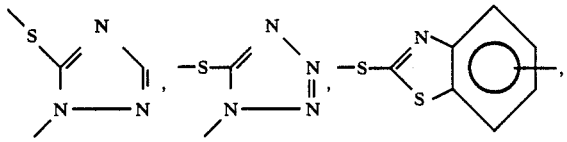

-continued
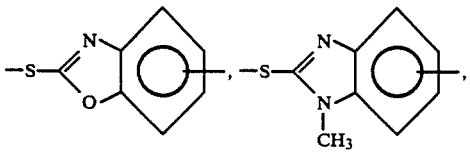
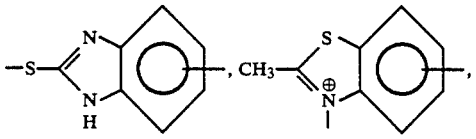
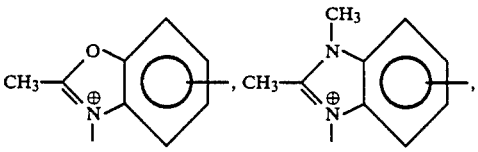
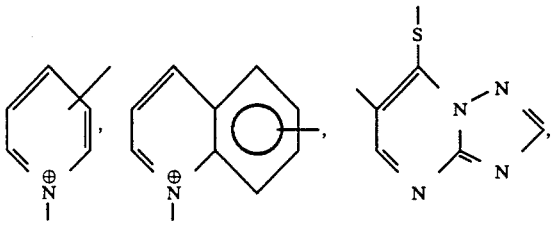
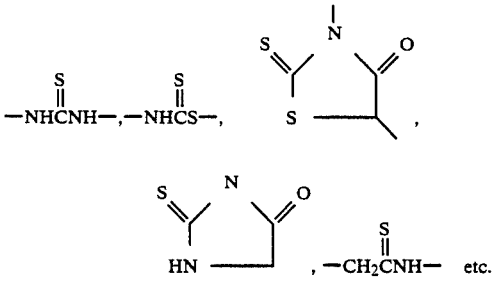
Examples of L are indicated below.
$-CH_2-$, $-CH_2CH_2-$, $-OCH_2-$, $-OCH_2CH_2-$, $-SCH_2-$, $-COO-$,
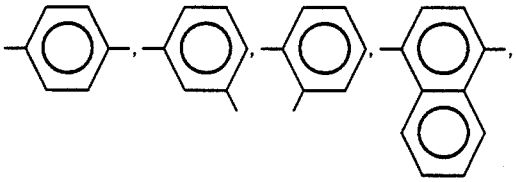
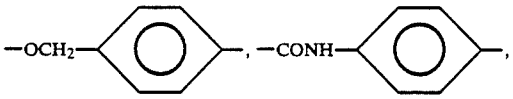
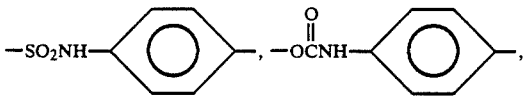
-continued
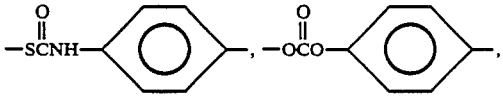
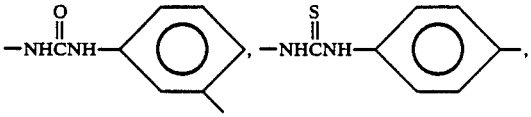
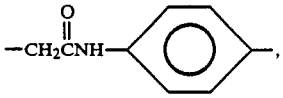
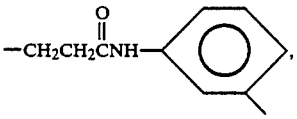
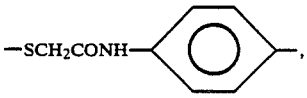
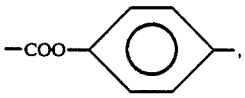
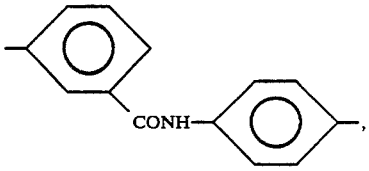
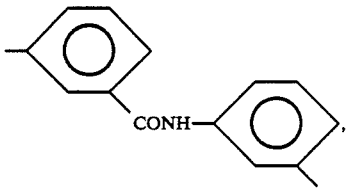
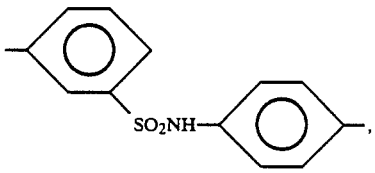
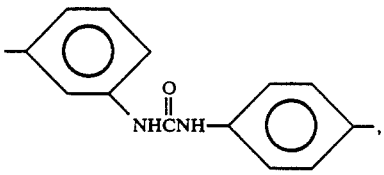

-continued
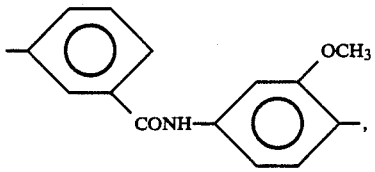
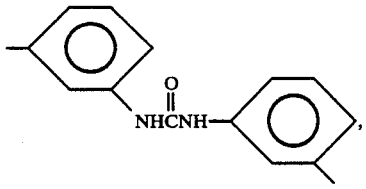
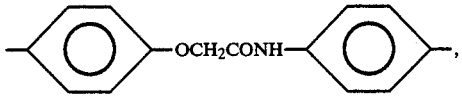
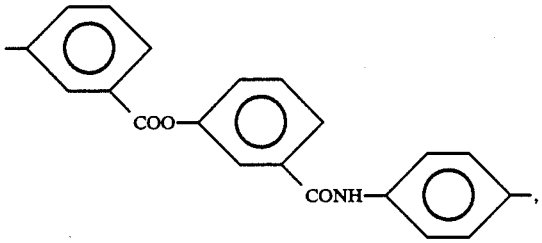
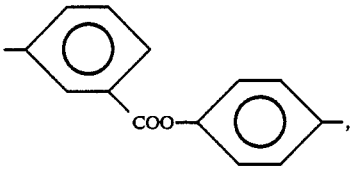
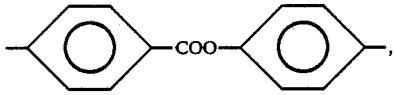
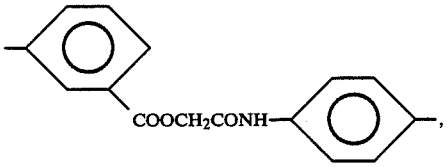
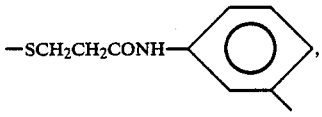
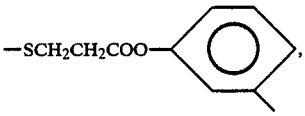
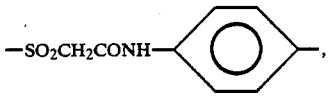
-continued
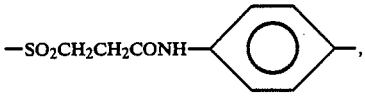
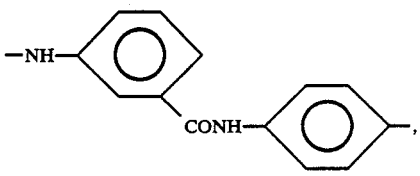
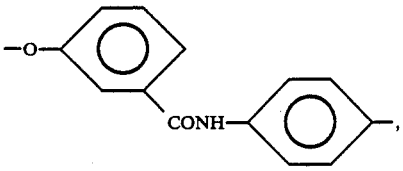
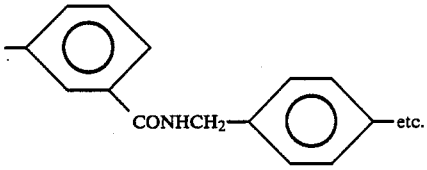
Examples of X are indicated below:
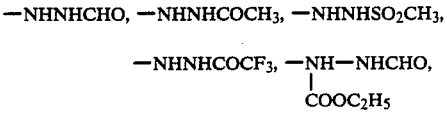
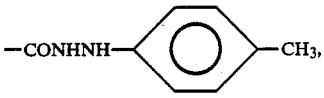
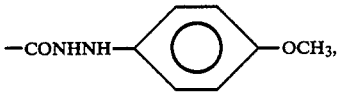
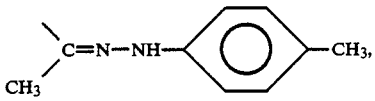
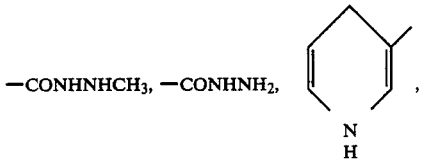
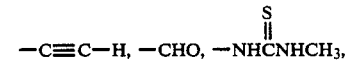
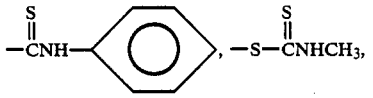

-continued
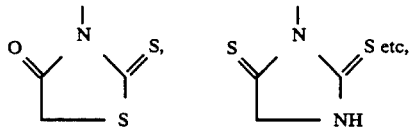
Preferred embodiments of the group FA in general formulae [1] to [3] are indicated below.
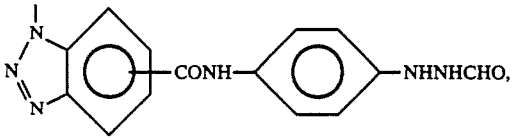
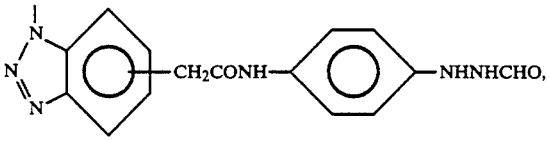
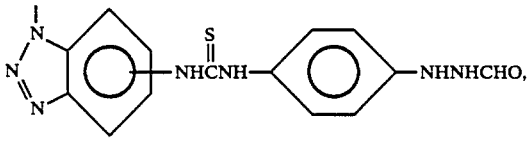
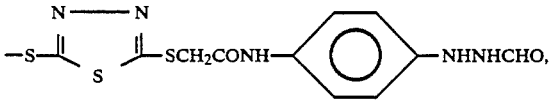
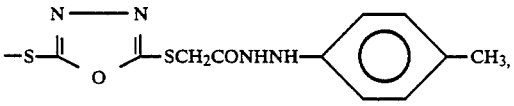
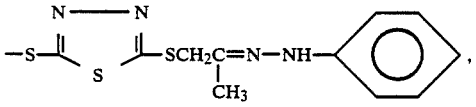
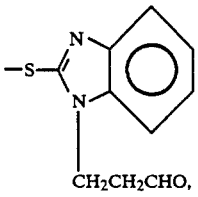
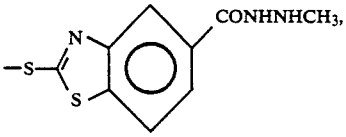
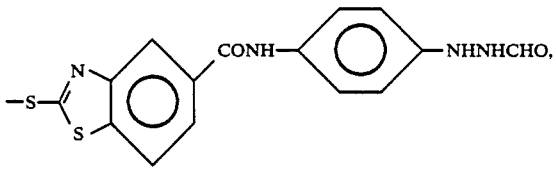
-continued
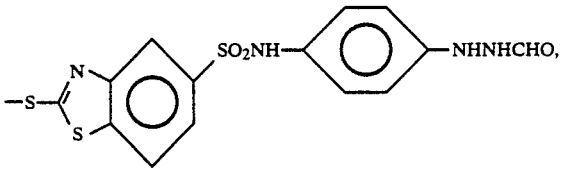
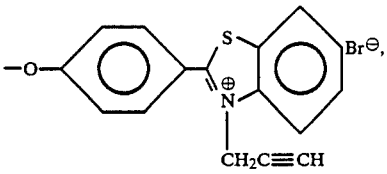
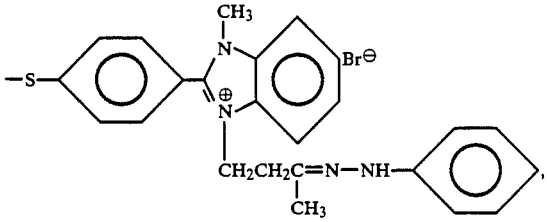
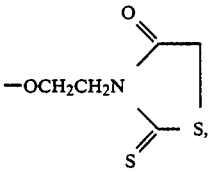
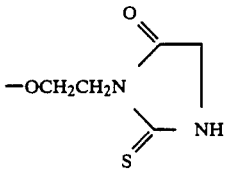
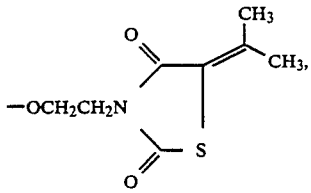
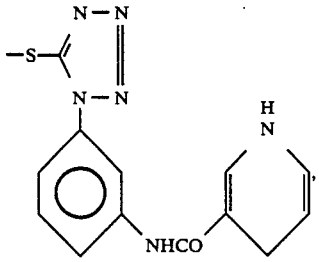
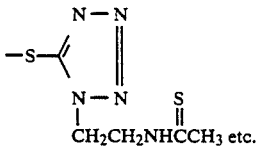

Actual examples of the compounds which are used in the invention are as follows:
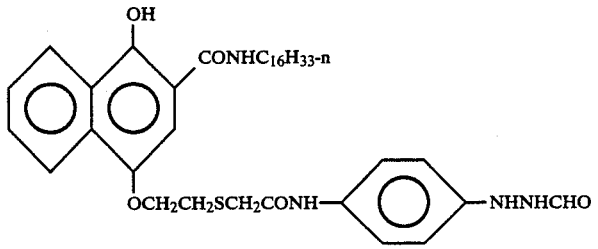
[1-1]
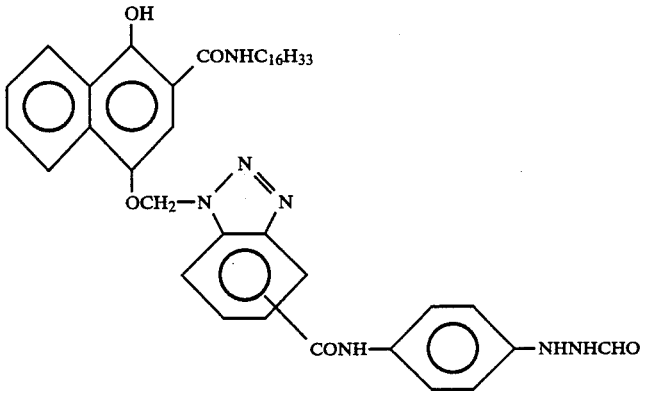
[1-2]
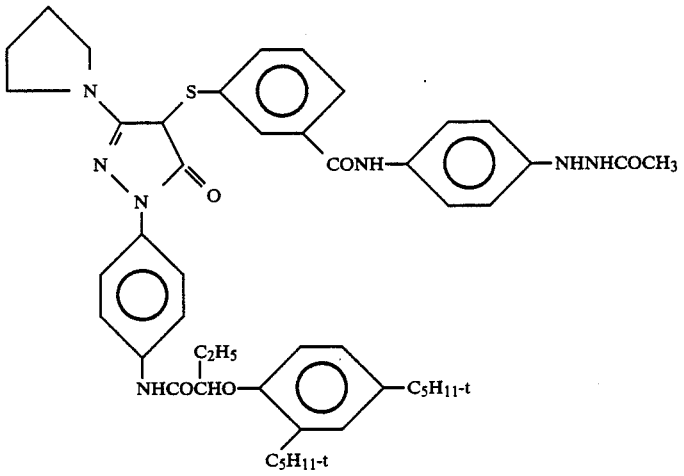
[1-3]
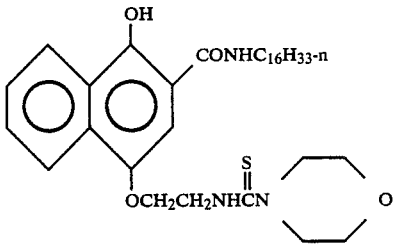
[1-4]

-continued
[1-5]
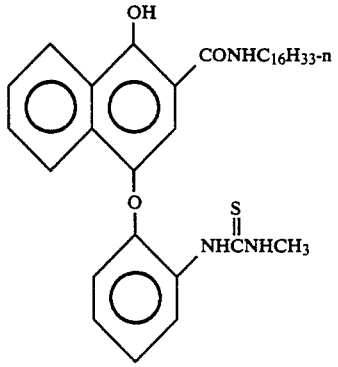
[1-6]
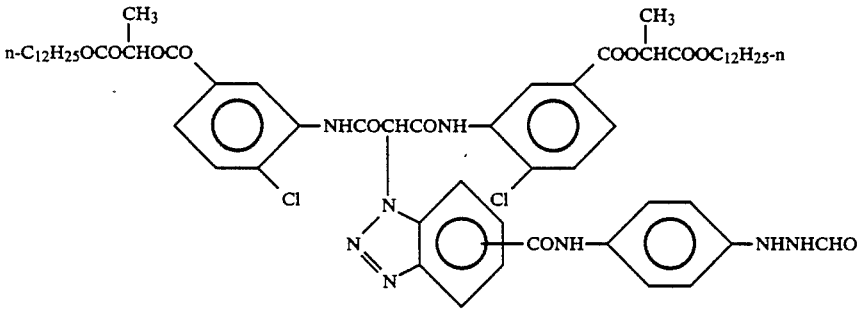
[1-7]
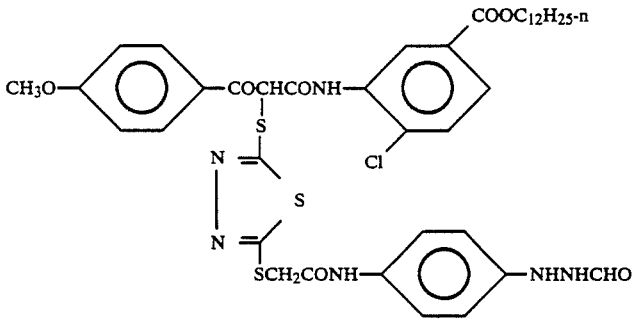
[1-8]
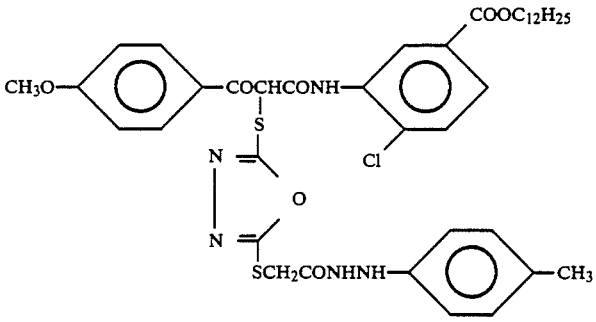

-continued
[1-9]
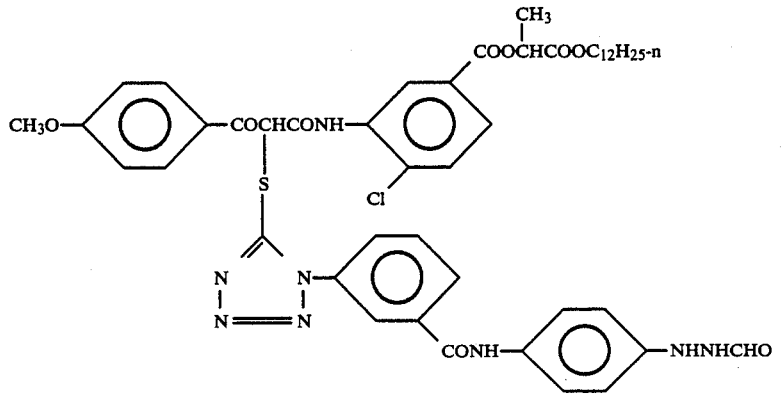
[1-10]
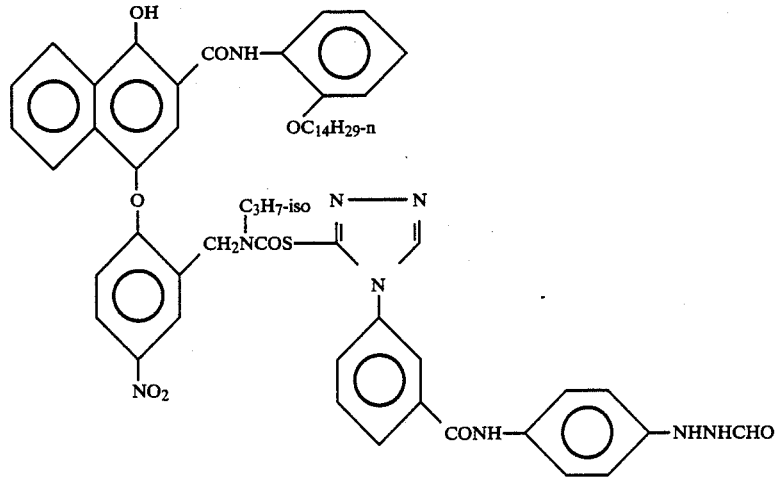
[1-11]
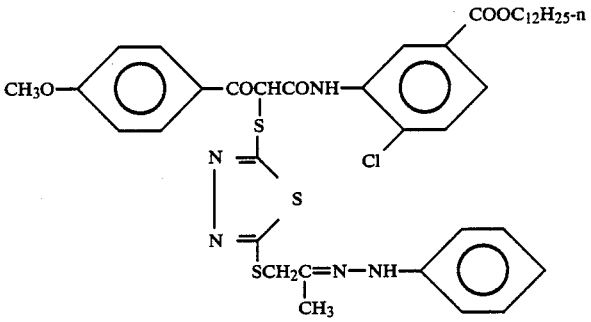
[1-12]
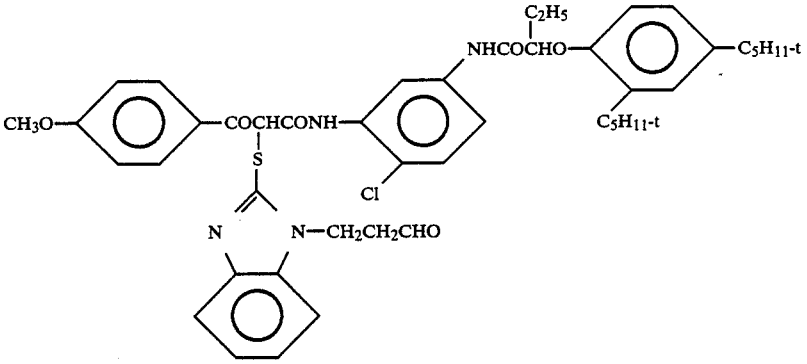

-continued
[1-13]
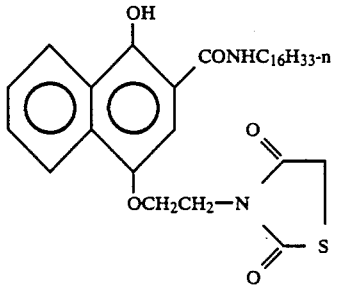
[1-14]
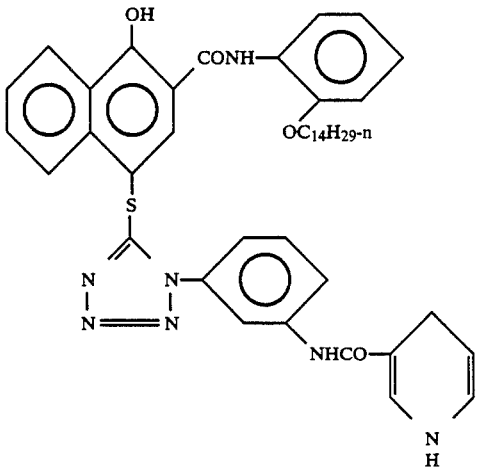
[1-15]
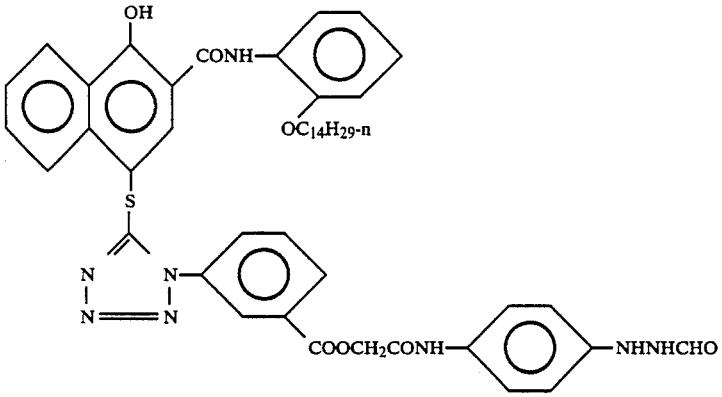
[1-16]
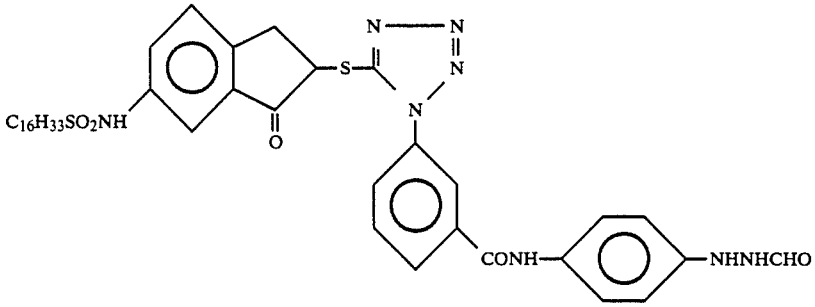

-continued
[I-17]
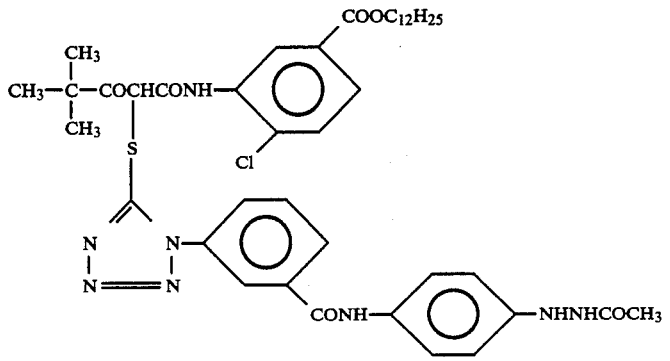
[1-18]
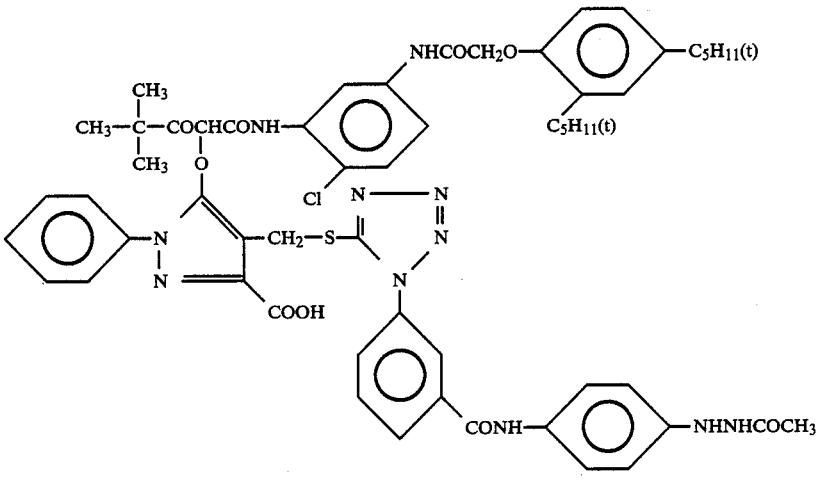
[1-19]
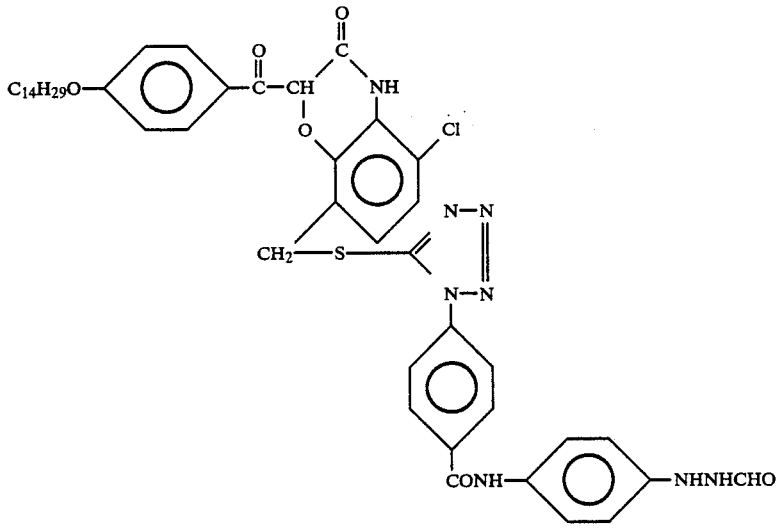

-continued
[1-20]
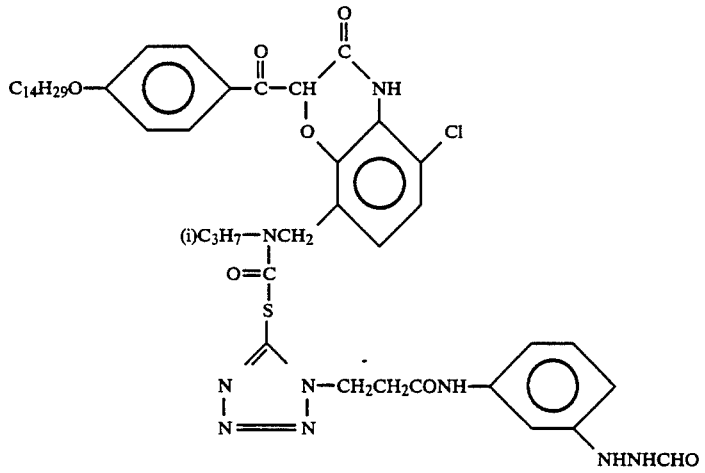
[1-21]
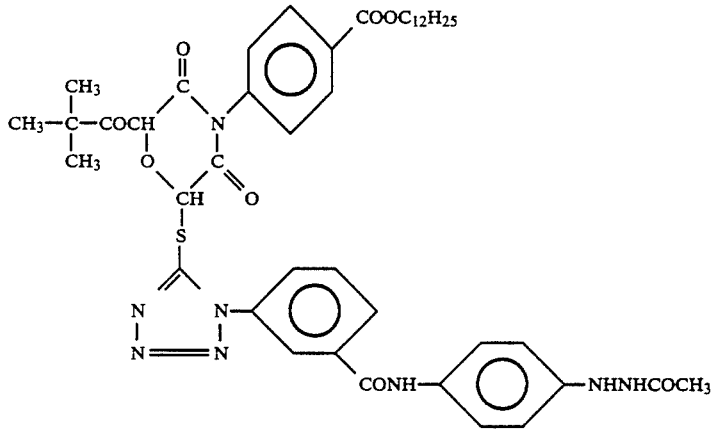
[1-22]
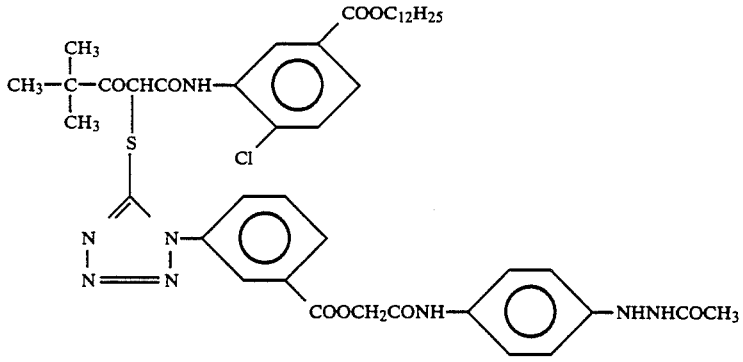

-continued
[1-23]
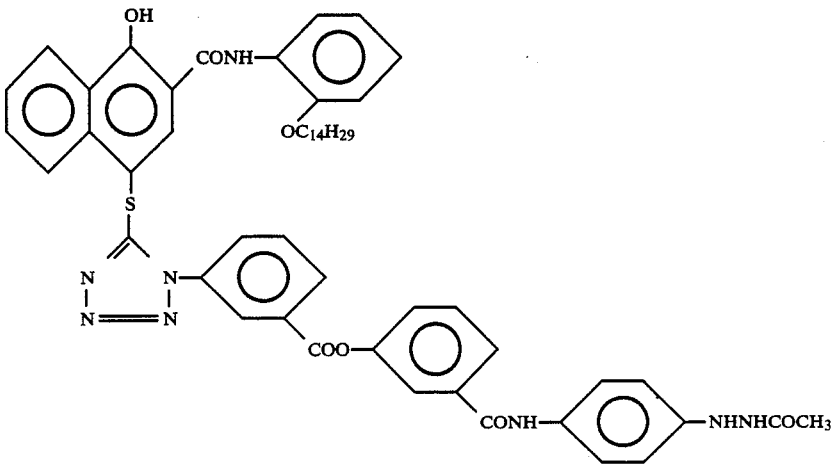
[1-24]
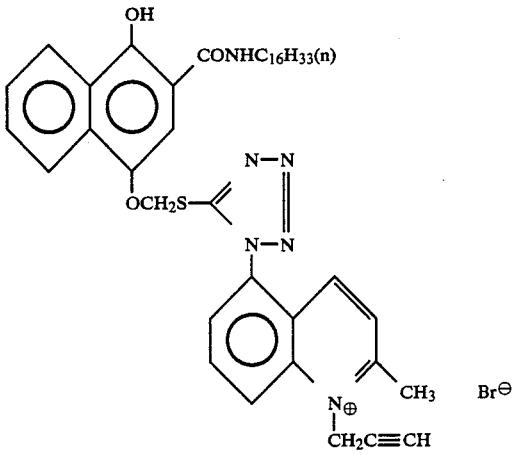
[1-25]
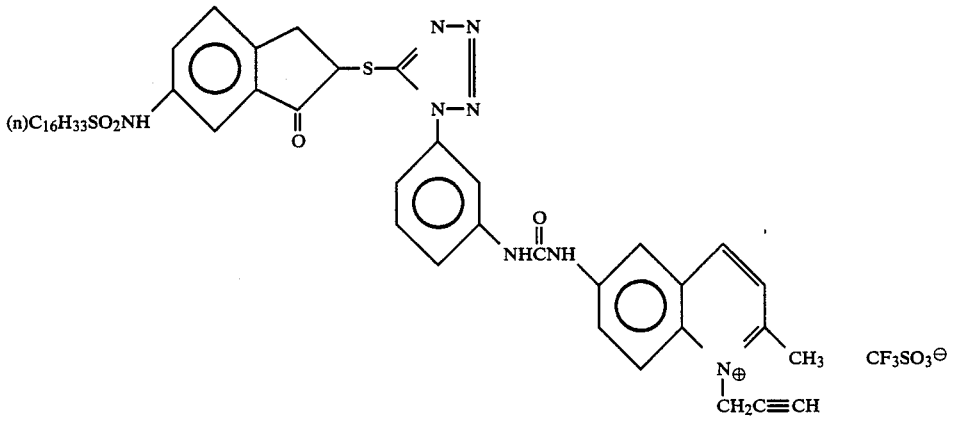

-continued
[1-26]
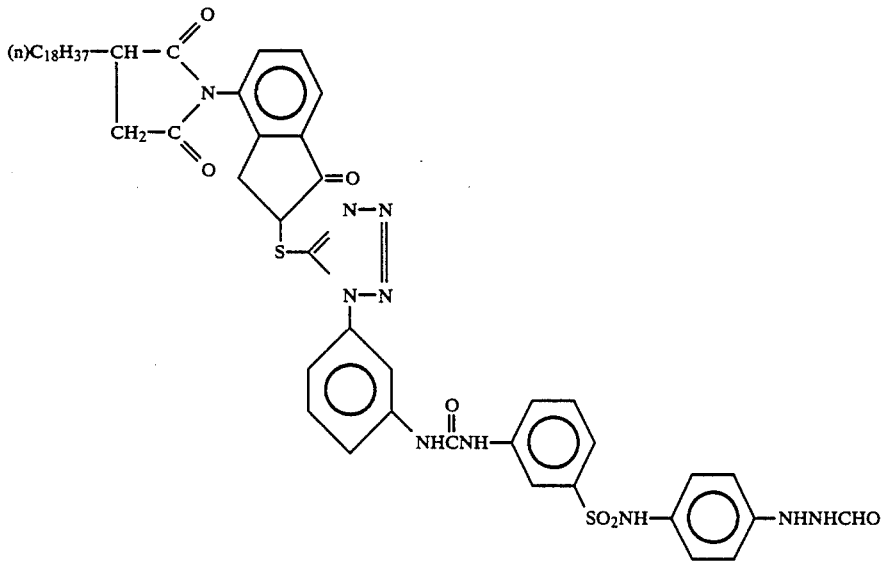
[1-27]
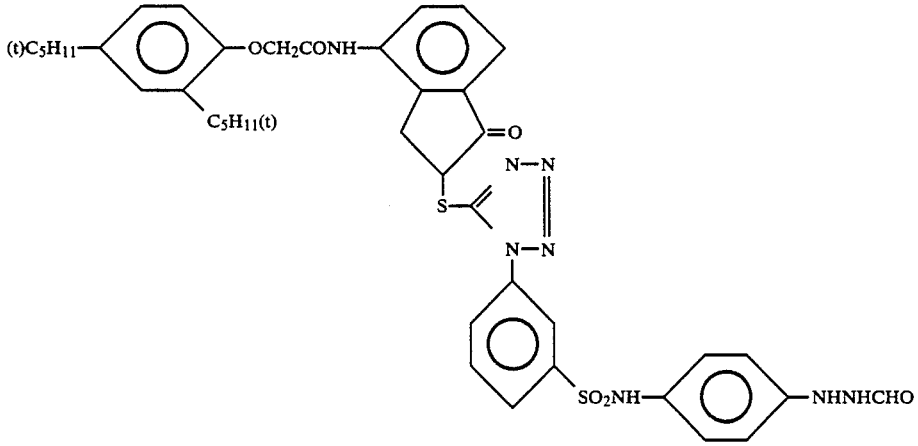
[1-28]
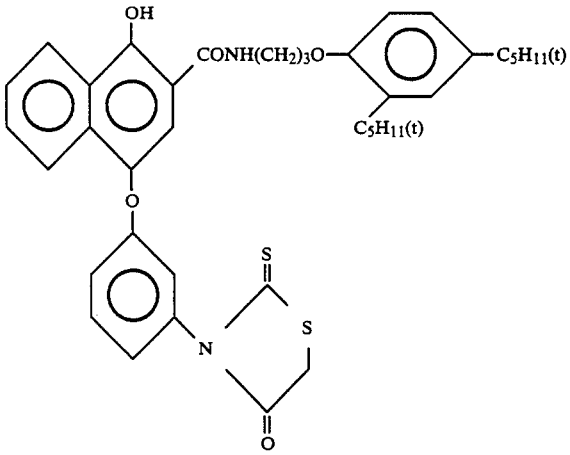
[2-1]
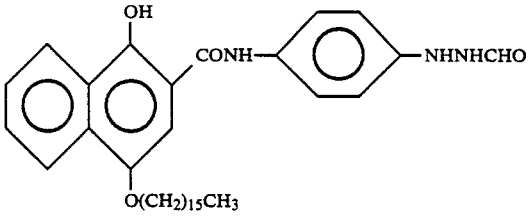

-continued
[2-2]
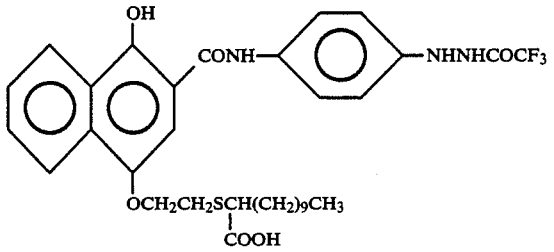
[2-3]
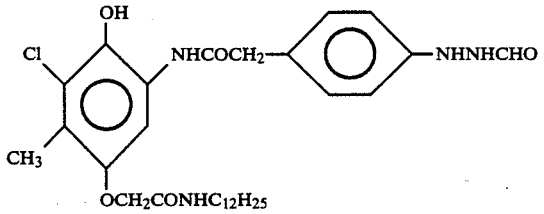
[2-4]
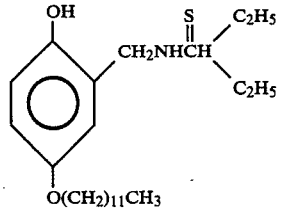
[2-5]
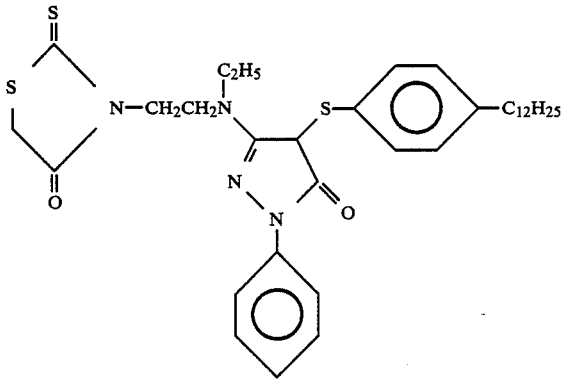
[2-6]
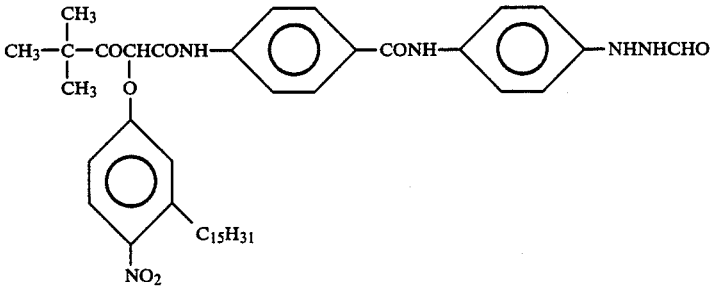
[2-7]
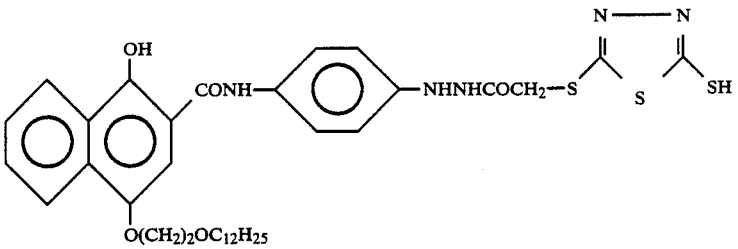

-continued
[2-8]
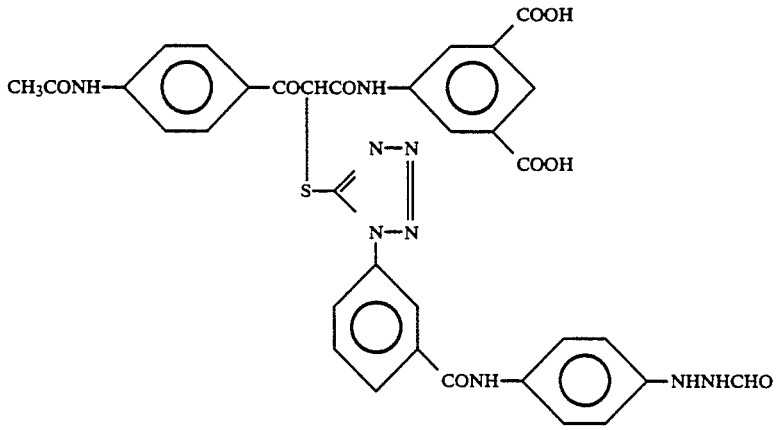
[2-9]
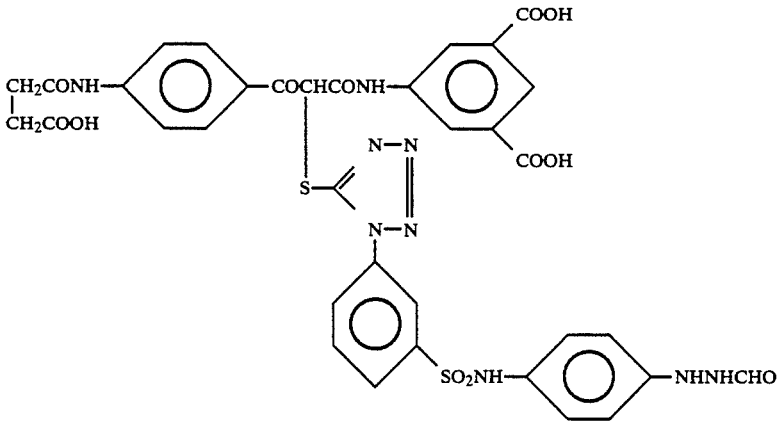
[2-10]
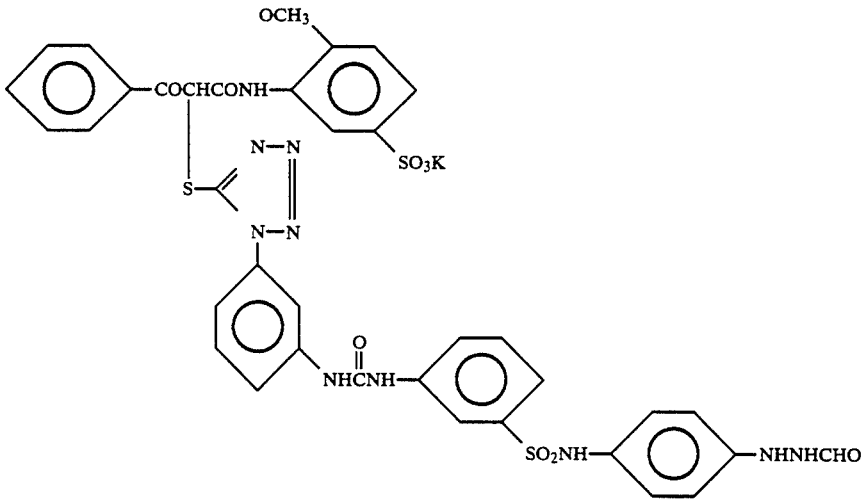

-continued
[2-11]
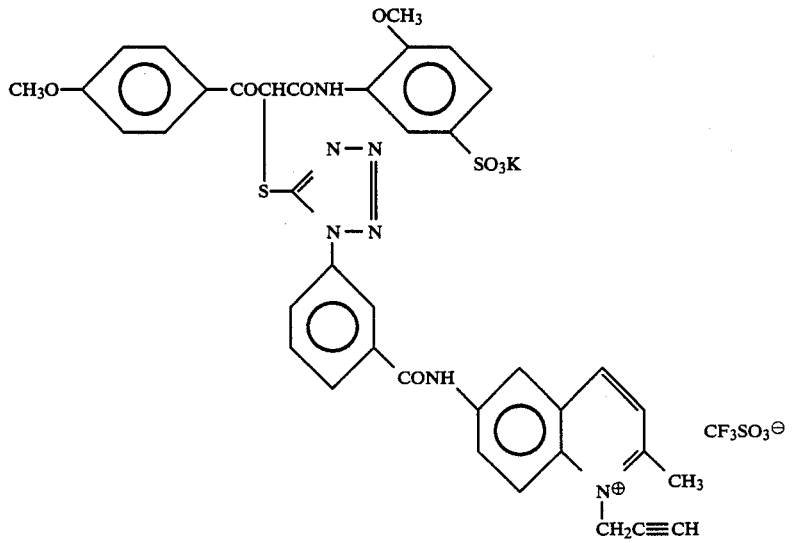
[2-12]
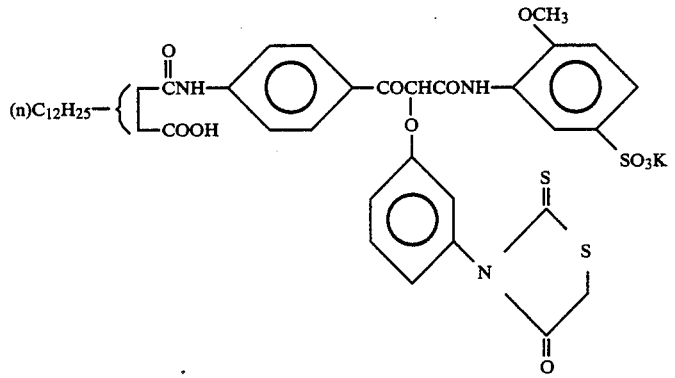
(Here $(n)C_{12}H_{25}$—{ —CNH— / —COOH } signifies $(n)C_{12}H_{25}$—CH(CH$_2$—COOH)—C(=O)NH— or
$(n)C_{12}H_{25}$—CH(COOH)—CH$_2$—C(=O)NH— or a mixture of both.)
[2-13]
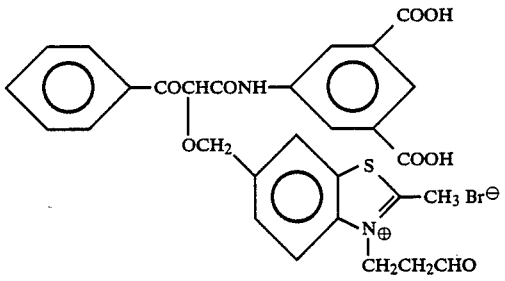

-continued
[2-14]
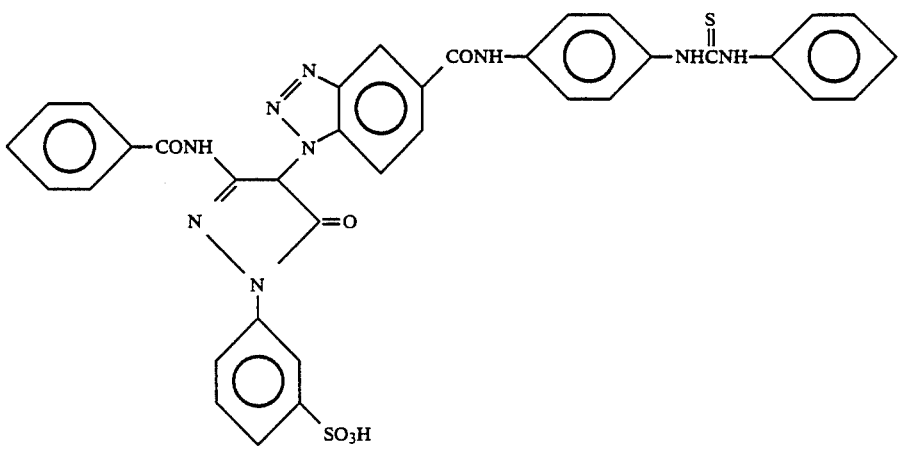
[2-15]
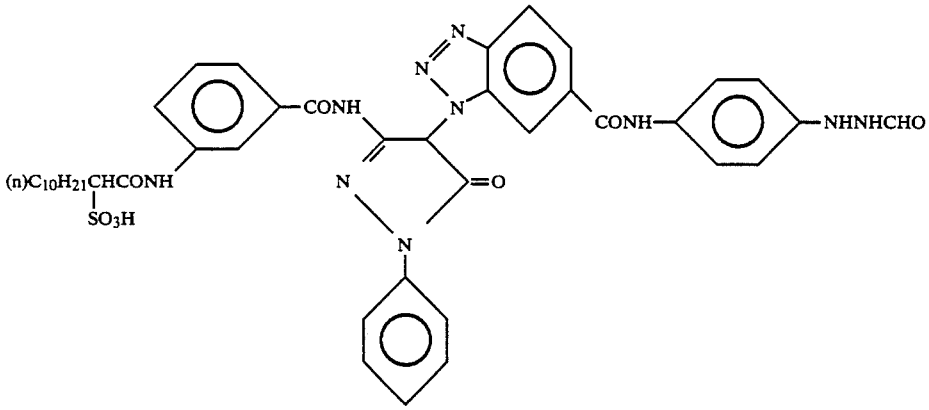
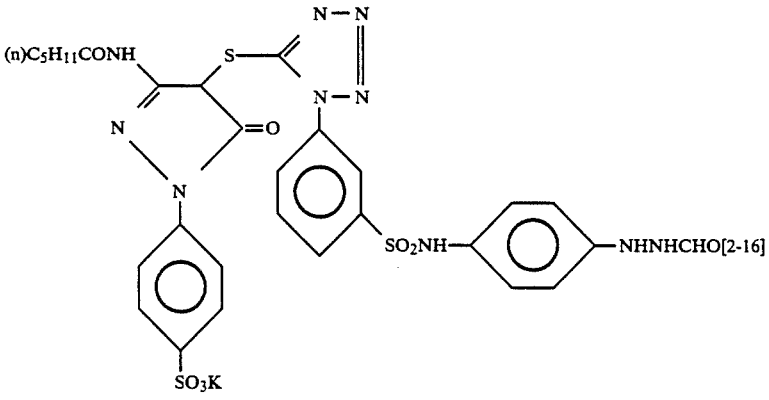
[2-16]

-continued
[2-17]
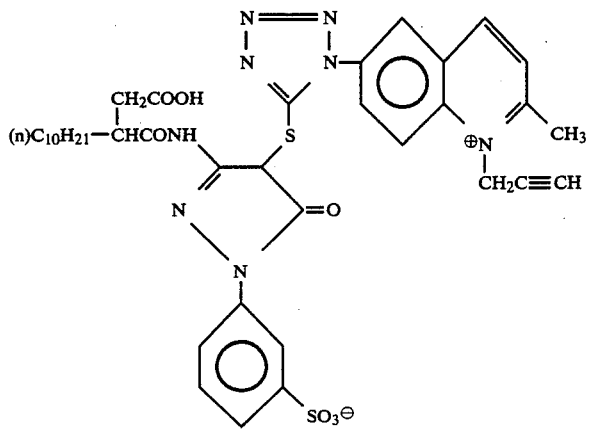
[2-18]
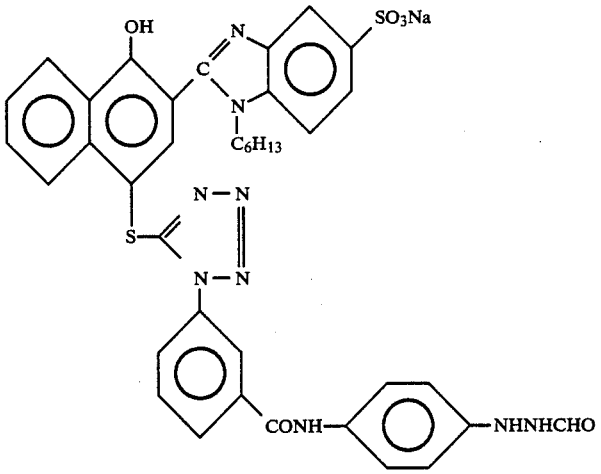
[2-19]
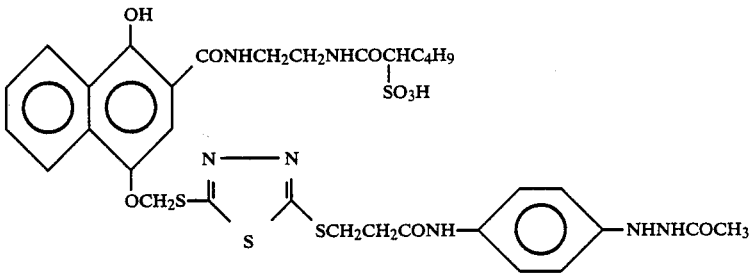

-continued
[2-20]
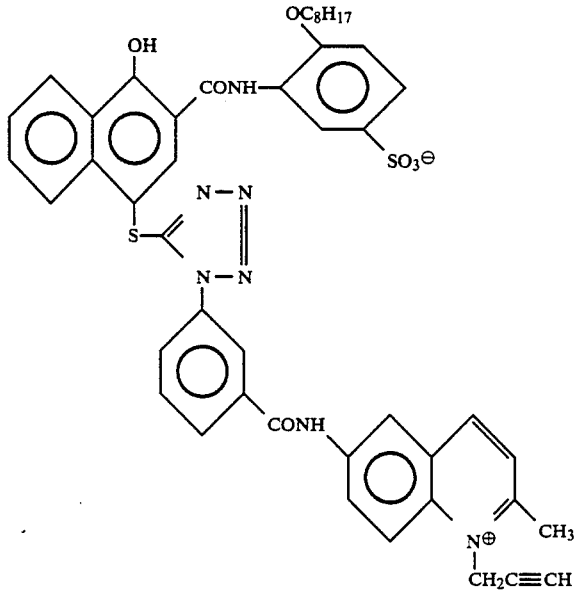
[2-21]
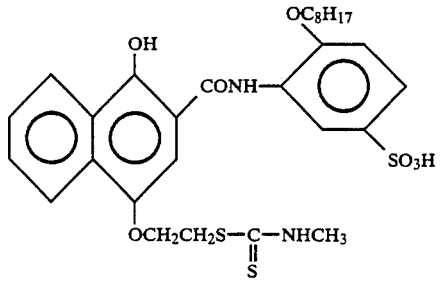
[3-1]
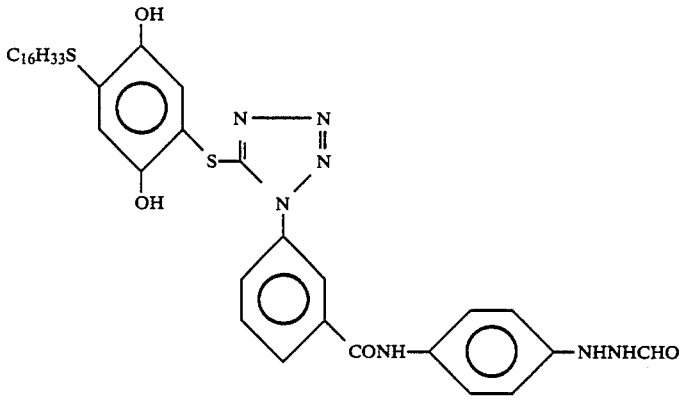
[3-2]
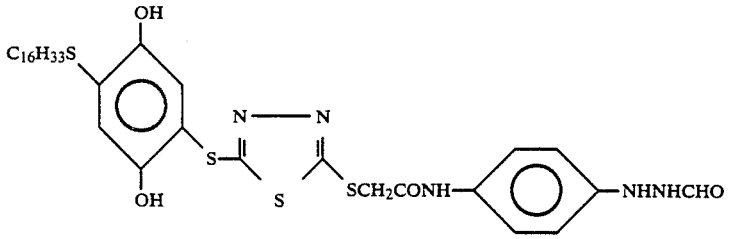

-continued
[3-3]
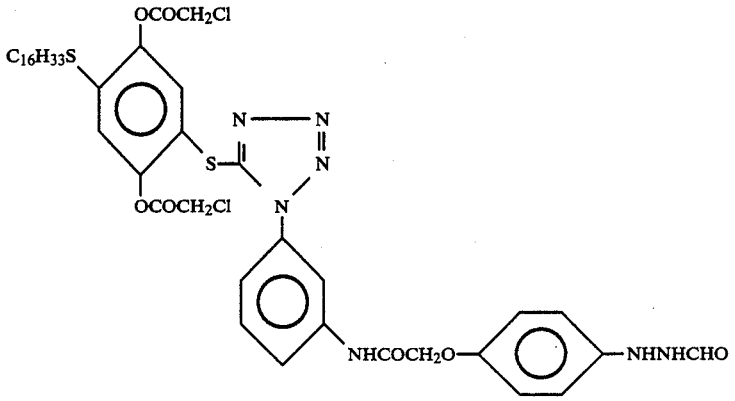
[3-4]
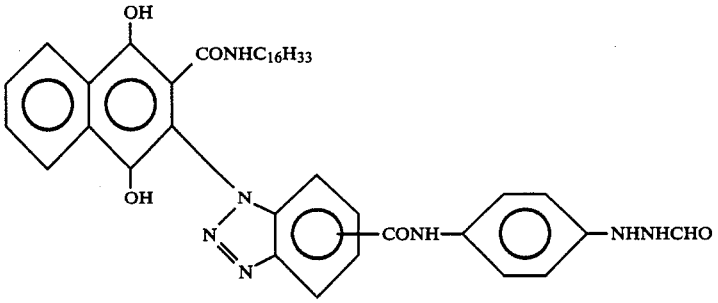
[3-5]
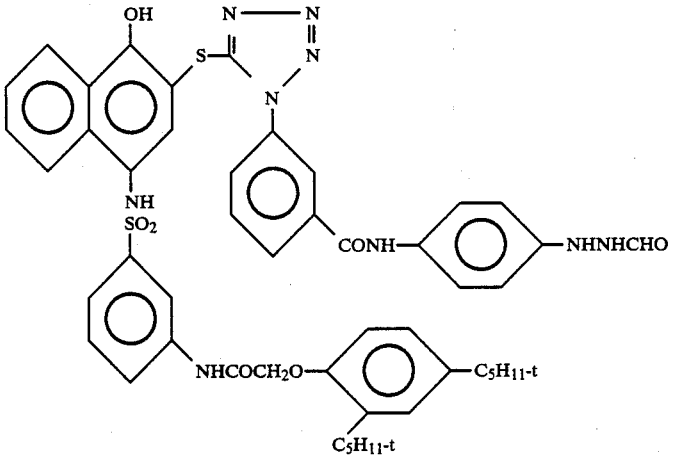
[3-6]
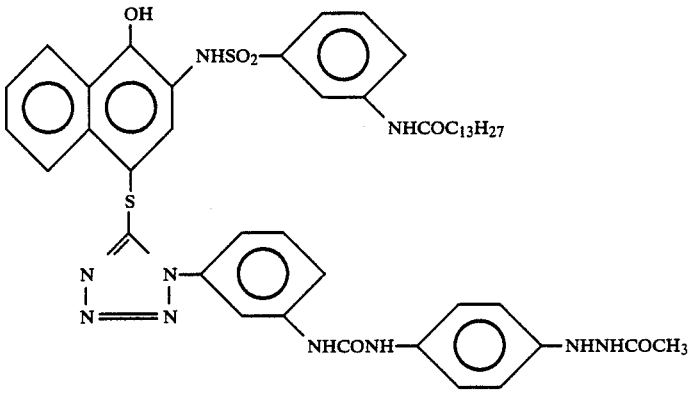

-continued
[3-7]
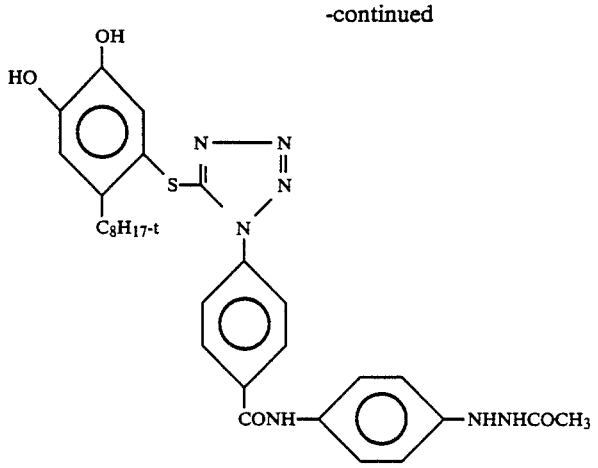
[3-8]
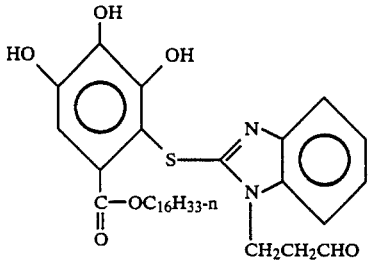
[3-9]
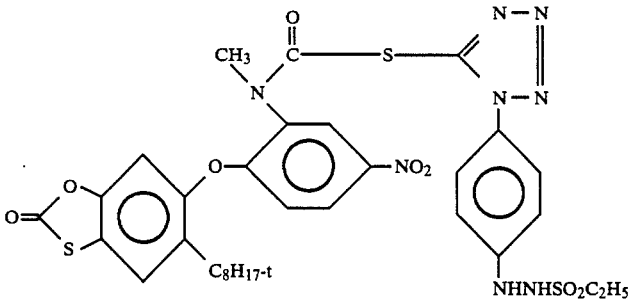
[3-10]
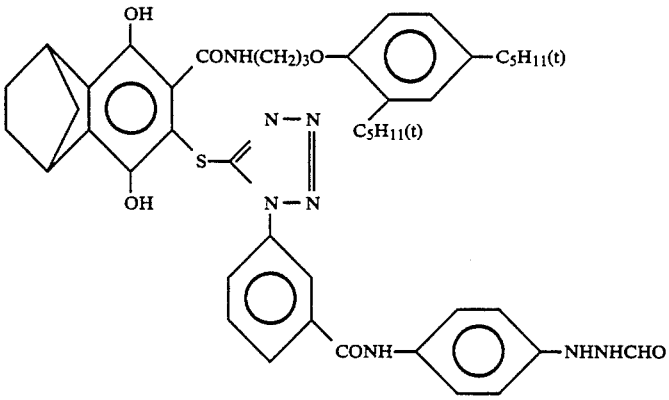
[3-11]
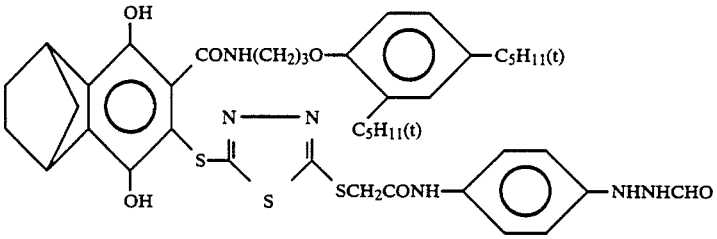

-continued

[3-12]

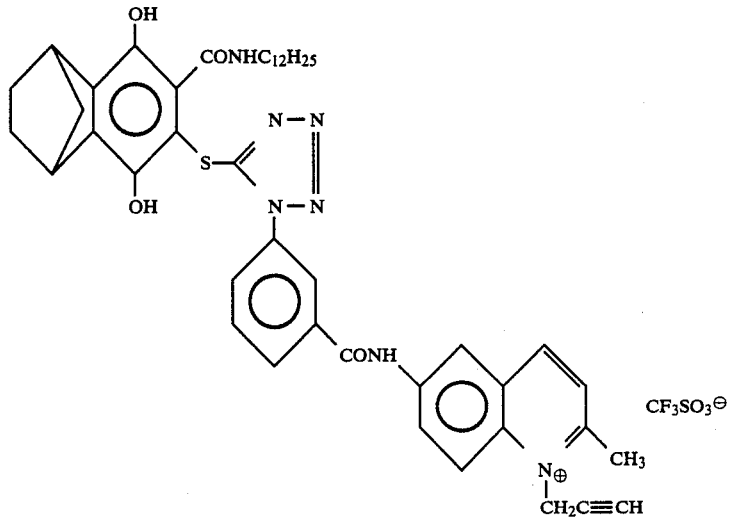

[3-13]

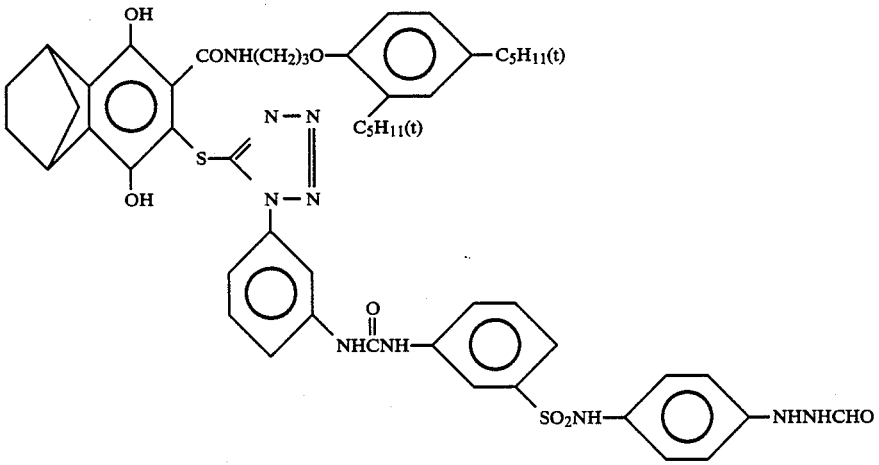

The FR compound used in the invention is added at the rate of $10^{-9}$ to $10^{-1}$ mol, and preferably at the rate of $10^{-5}$ to $10^{-1}$ mol, per 1 mol of silver halide contained in the layer which contains the FR compound or in the layer adjacent to this layer.

In this invention the FR compound can be introduced into the silver halide emulsion layer using the known methods such as that disclosed in U.S. Pat. No. 2,322,027. For example, the compounds can be dissolved in an alkyl phthalate ester (dibutyl phthalate, dioctyl phthalate etc), a phosphate ester (diphenyl phosphate, triphenyl phosphate, tricresyl phosphate, dioctylbutyl phosphate), a citrate ester (for example tributylacetyl citrate), a benzoic acid ester (for example octyl benzoate), an alkylamide (for example diethyl laurylamide), a fatty acid ester (for example dibutoxyethyl succinate, diethyl azelate), for a trimesate ester (for example tributyl trimesate) etc. or in an organic solvent of boiling point from about 30° C. to about 150° C., for example a lower alkyl acetate such as ethyl acetate or butyl acetate, ethyl propionate, secondary butyl alcohol, methyl isobutyl ketone, β-ethoxyethyl acetate, methyl cellosolve acetate etc. and then dispersing the solution in a hydrophilic colloid. An organic solvent with a high boiling point and an organic solvent with a low boiling point, as mentioned above, may be mixed and used together.

Furthermore the method of dispersion with polymers as disclosed in Japanese Patent Publication No. 39853/76 and Japanese Patent Application (OPI) No. 59943/76 can also be used.

When the FR compound has acid groups, such as carboxylic acid groups or sulfonic acid group, it can be introduced into the hydrophilic colloid in the form of an alkaline aqueous solution.

The internal latent image forming silver halide emulsion which has not been pre-fogged, which is used in the invention, is an emulsion in which the surface of the silver halide grains has not been pre-fogged and which contains silver halide such that the latent image is formed principally within the grains. Moreover, when in practice a fixed amount (0.5 to 3 g/m$^2$) of the silver halide emulsion is coated onto a transparent support, the maximum density measured using the normal photographic densitometric procedure after exposing the layer for a fixed period of from 0.01 to 10 seconds and developing for 5 minutes at 18° C. in the developer solution A (an internal type developer solution) described below is preferably at least five times greater than the maximum density obtained when silver halide emulsion, which has been coated at the same rate and exposed in the same way as described above, is developed for 6 minutes at 20° C. in the developer solution B (surface type developer solution) described below.

Emulsions which have a maximum density when the internal type developer solution is used at least 10 times greater than that when the surface type developer is used are especially desirable.

| Internal Type Developer Solution A | |
|---|---|
| Metol | 2 grams |
| Sodium sulfite (anhydrous) | 90 grams |
| Hydroquinone | 8 grams |
| Sodium carbonate (monohydrate) | 52.5 grams |
| KBr | 5 grams |
| KI | 0.5 gram |
| Water to make | 1 liter |
| Surface Type Developer Solution B | |
| Metol | 2.5 grams |
| L-Ascorbic acid | 10 grams |
| $NaBO_2.4H_2O$ | 35 grams |
| KBr | 1 gram |
| Water to make | 1 liter |

The conversion type silver halide emulsions disclosed in British Pat. No. 2,592,250 and the core/shell type silver halide emulsions disclosed in U.S. Pat. Nos. 3,761,276, 3,850,637, 3,923,513, 4,035,185, 4,395,478, 4,504,570, Japanese Patent Application (OPI) Nos. 56614/77, 127549/80, 60222/78, 22681/81, 208540/84, 107641/85, 3137/86, Japanese Patent Application No. 32462/86 and the patents indicated on p. 236 of *Research Disclosure,* No. 23510 (published November 1983) can be cited as actual examples of internal latent image type emulsions.

The silver halide grains used in the invention may have a regular cubic, octahedral, dodecahedral, tetradecahedral etc. crystalline form, or they may have an irregular crystalline form, such as a spherical form, and moreover grains which have a tabular form in which the length/thickness ratio is at least 5 can also be used. Moreover, emulsions comprising various complex crystalline forms or mixture of these forms can also be used.

The silver halide comprises of silver chloride, silver bromide mixed silver halide and the preferred silver halide for use in the invention is silver chloro(iodo)bromide, silver (iodo)chloride or silver (iodo)bromide which contain either no silver iodide or, if silver iodide is present, not more than 3% of silver iodide.

The preferred average grain size of the silver halide grains is less than 2 μm but greater than 0.1 μm and an average grain size of less than 1 μm but greater than 0.15 μm is especially desirable. The grain size distribution may be narrow or wide but the use of "monodispersed" silver halide emulsions which have a narrow grain size distribution such that 90% or more of all the grains are within ±40% of the average grain size, and preferably within ±20% of the average grain size, in terms of particle numbers or weight, is preferred for improving graininess and sharpness etc. Furthermore, two or more monodispersed silver halide emulsions which have different grain sizes, or a plurality of grains which have the same size but different sensitivities, can be coated as a mixture in the same layer, or as a laminate of different layers, in emulsion layers which have essentially the same color sensitivity in order to provide the gradation required of the photosensitive material. Moreover, combinations of two or more types of polydispersed silver halide emulsion or of monodispersed emulsion and polydispersed emulsion can be used in the form of mixtures or in the form of laminates.

The silver halide emulsion used in the invention can be chemically sensitized by the independent or conjoint use of sulphur or selenium sensitization, reduction sensitization or precious metal sensitization within or at the surface of the grains. Detailed examples of such sensitization will be found in the patents indicated, for example, on page 23 of *Research Disclosure,* No. 17643-III (published in December 1978).

The photographic emulsions used in the invention are spectrally sensitized using photographic sensitizing dyes in the conventional way. Cyanine dyes, merocyanine dyes and complex merocyanine dyes are especially useful in this connection and these dyes can be used individually or conjointly. Furthermore, the above mentioned dyes can also be used in conjunction with strong color sensitizing agents. Detailed examples will be found in the patents noted, for example, on pages 23 to 24 of *Research Disclosure,* No. 17643-IV (published in December 1978).

Antifoggants or stabilizers can be included in the photographic emulsions used in the invention with a view to preventing fogging during the manufacture, storage and photographic processing of the photosensitive material and stabilizing the photographic performance of the photosensitive material. Detailed examples will be found, for example, in *Research Disclosure,* No. 17643-VI (published in December 1978) and in E. J. Birr, *Stabilization of Photographic Silver Halide Emulsions,* (Focal Press) published in 1974.

A variety of color couplers can be used to form direct positive colored images. Color couplers are compounds which undergo a coupling reaction with the oxidized form of a primary aromatic amine based color developing agent and form or release a dye which is essentially fast to diffusion and it is preferable that they themselves should be compounds which are essentially fast to diffusion. Typical examples of useful color couplers are naphthol and phenol based compounds, pyrazolone or pyrazoloazole based compounds and ketomethylene compounds which have open chains or heterocyclic rings. Actual examples of the cyan, magenta and yellow couplers which can be used in the invention include the compounds disclosed on page 25, section VII-D of *Research Disclosure,* No. 17643 (published December 1978), *Research Disclosure,* No. 18717 (published November 1979) and in Japanese Patent Application No. 32462/86 and in the patents noted in these documents.

The oxygen atom elimination type and nitrogen atom elimination type of yellow two equivalent couplers are typical examples of yellow couplers which can be used in the invention. The α-pivaloylacetoanilide based couplers in particular provide colored dyes of excellent stability, especially light fastness, while on the other hand the α-benzoylacetoanilide based couplers are preferred because of their ability to provide high color densities.

Furthermore, 5-pyrazolone based couplers which are substituted in the 3-position with an arylamino group or an acylamino group (especially sulfur elimination type two equivalent couplers) are the preferred 5-pyrazolone based magenta couplers for use in the invention.

Other preferred couplers are the pyrazoloazole based couplers and of these the pyrazolo[5,1-c][1,2,4]triazoles disclosed in U.S. Pat. No. 3,725,067 are preferred but the use of the imidazo[1,2-b]pyrazoles disclosed in U.S. Pat. No. 4,500,630 is more desirable in respect of the small extent of yellow subsidiary absorbance of the dye and its light fastness and the pyrazolo[1,5-b][1,2,4]triazole disclosed in U.S. Pat. No. 4,540,654 is especially desirable.

The cyan couplers preferred for use in the invention are the naphthol based and phenol based couplers disclosed in U.S. Pat. Nos. 2,474,293, 4,052,212, and the phenol based cyan couplers which have an alkyl group having at least an ethyl group in the meta position of the phenol ring disclosed in U.S. Pat. No. 3,772,002 and the 2,5-diacylamino substituted phenol based couplers are also desirable from the point of view of the stability of the colored image.

Colored couplers for correcting the unrequired absorption in the short wavelength region of the dyes which are formed, couplers with which the colored dye has suitable diffusion properties, colorless couplers, DIR couplers which release development restrainers along with the coupling reaction and polymerized couplers can also be used.

The standard amount of color coupler used is within the range of 0.001 to 1 mol per 1 mol of light sensitive silver halide and the preferred ranges are 0.01 to 0.5 mol of yellow coupler per 1 mol of light sensitive silver halide, 0.03 to 0.5 mol of magenta coupler per 1 mol of light sensitive silver halide and 0.002 to 0.5 mol of cyan coupler per 1 mol of light sensitive silver halide.

Color intensifiers can be used in the invention to improve the color forming properties of the couplers. Typical examples of these compounds are disclosed on pages 347 to 391 of Japanese Patent Application No. 32462/86.

The couplers of this invention are dissolved in organic solvents of high and/or low boiling point and formed into an emulsified dispersion by mixing at high speed in a homogenizer etc. with an aqueous solution of gelatin or other hydrophilic colloid, by producing fine particles mechanically in a colloid mill or by means of ultrasonic techniques and then added to the emulsion layer. In this case it is not always necessary to use a high boiling point solvent but the use of the compounds disclosed on pages 440 to 467 of Japanese Patent Application No. 32462/86 is preferred.

The couplers of this invention can be dispersed in a hydrophilic colloid using the method disclosed on pages 468 to 475 of Japanese Patent Application No. 32462/86.

The photosensitive material formed using the invention may also contain hydroquinone derivatives, aminophenol derivatives, amines, gallic acid derivatives, catechol derivatives, ascorbic acid derivatives, colorless couplers, sulfonamidophenol derivatives etc. as agents for preventing the occurrence of color fogging or as agents for preventing color mixing. Typical agents for preventing the occurrence of color fogging and color mixing are disclosed on pages 600 to 630 of Japanese Patent Application No. 32462/86.

It is possible to use various agents for preventing the occurrence of color fading in the photosensitive materials of this invention. Typical examples of organic agents for preventing the occurrence of color fading include hydroquinones, 6-hydroxychromans, 5-hydroxycoumarins, spirochromans, p-alkoxyphenols, hindered phenols based on bisphenols, gallic acid derivatives, methylenedioxybenzenes, aminophenols, hindered amines and ethers in which the phenolic hydroxyl group in each of these compounds has been silylated or alkylated, or ester derivatives. It is also possible to use metal complexes as typified by the (bis-salicylaldoxymato)-nickel complex and the (bis-N,N-dialkylthiocarbamato)nickel complexes.

Compounds which have both a hindered amine structure and a hindered phenol structure within the same molecule, such as those disclosed in U.S. Pat. No. 4,268,593, are effective for preventing the deterioration of the yellow dye image due to heat, moisture and light. Furthermore the spiroindanes disclosed in Japanese Patent Application (OPI) No. 159644/81 and the hydroquinone diether or monoether substituted chromans disclosed in Japanese Patent Application (OPI) No. 89835/80 are effective for preventing deterioration of the magenta dye images, especially in respect of deterioration due to light.

Typical examples of these agents for preventing the occurrence of fading are disclosed on pages 401 to 440 of Japanese Patent Application No. 32462/86. The desired effect can be achieved by emulsifying these compounds along with the coupler, normally at a rate of from 5 to 100% by weight with respect to the corresponding color coupler, and adding them to the light sensitive layer.

The introduction of ultraviolet absorbers into the layers on both sides adjacent to the cyan color forming layer is effective for preventing the deterioration of the cyan dye image due to heat and, more especially, light. The ultraviolet absorbers can also be added to a hydrophilic colloid layer such as the protective layer for example. Typical examples of such compounds are disclosed on pages 391 to 400 of Japanese Patent Application No. 32462/86.

Gelatin based materials are useful as the binding agents and protective colloids used for the emulsion layers and intermediate layers of the photosensitive materials of this invention but other hydrophilic colloids can also be used.

Dyes which prevent the occurrence of irradiation and halation, ultraviolet absorbers, plasticizers, fluorescent whiteners, matting agents, agents for preventing the occurrence of aerial fogging, coating aids, hardening agents, antistatic agents and lubrication improvers etc. can be added to the photosensitive materials of this invention. Typical examples of such additives are disclosed on pages 25 to 27 of *Research Disclosure,* No. 17643, sections VIII–XIII (published in December 1978) and on pages 647 to 651 of *Research Disclosure,* No. 18716 (published in November 1979).

The invention can also be applied to multilayer multicolor photographic materials with at least two different spectral sensitivities on a support. Multilayer natural photographic materials normally have at least one red sensitive emulsion layer, one green sensitive emulsion layer and one blue sensitive emulsion layer on a support. The order of these layers is selected as required. The preferred sequence of the layers is either, form the support side, red sensitive—green sensitive—blue sensitive or green sensitive—red sensitive—blue sensitive. Moreover each of the aforementioned emulsion layers may consist of two or more emulsion layers of different sensitivities, and a non-light sensitive layer may be present between two or more emulsion layers which have the same color sensitivity. The cyan forming coupler is normally contained in the red sensitive emulsion layer, the magenta forming coupler is normally contained in the green sensitive emulsion layer and the yellow forming coupler is normally contained in the blue sensitive layer, but different combinations can be employed depending on the particular case.

The photosensitive materials of this invention preferably have established suitable auxiliary layers, such as a protective layer, intermediate layers, filter layers, antihalation layers, backing layer, white reflecting layers etc., as well as the silver halide emulsion layers.

The photographic emulsion layers and other layers can be applied to the support disclosed on p. 28 of *Research Disclosure,* No. 17643 XVII (published December 1978) and in European Pat. No. 0,182,253 and Japanese Patent (OPI) No. 97655/86 as photosensitive materials of this invention. In addition the application methods disclosed on pp. 28 to 29 of *Research Disclosure,* No. 17643 XV can be employed.

Furthermore, when photosensitive materials of this invention are used in color diffusion transfer type photographic applications it is possible to use dye developing agents for the color material but it is more useful to employ the color material which itself is fast to diffusion (immobile) under alkaline conditions (in the developer solution) and of the type which release a diffusible dye (or a precursor thereof) as a result of development. Couplers and redox compounds etc. which release diffusible dyes exist as diffusible dye releasing type color materials (DRR compounds) and these are useful not only in color diffusion transfer photographic applications (wet method) but also as color materials for photosensitive materials of the heat developable type (dry systems) such as that disclosed in Japanese Patent Application (OPI) No. 58543/83 for example.

The diffusible dye releasing redox compounds (referred to below as DRR compounds) can be represented by the following general formula.

(Ballast)-(Redox Cleaving Atomic Group)-D

The compounds disclosed on pages 12 to 22 of Japanese Patent Application (OPI) No. 163938/83 can be used for the (Ballast) unit and the redox cleaving atomic group in this formula. Furthermore D represents the dye (or a precursor thereof). The dye moiety may also be bonded to the redox cleaving atomic group via a linking group. The dye components indicated in the literature below are effective as the dye component represented by D in the above mentioned formula.

Examples of Yellow Dyes

Those disclosed in U.S. Pat. Nos. 3,597,200, 3,309,199, 4,013,633, 4,245,028, 4,156,609, 4,139,383, 4,195,992, 4,148,641, 4,148,.643, 4,366,322; Japanese Patent Application (OPI) Nos. 114930/76, 71072/81 and *Research Disclosure,* Nos. 17630 (1978) and 16475 (1977).

Examples of Magenta Dyes

Those disclosed in U.S. Pat. Nos. 3,453,107, 3,544,545, 3,932,380, 3,931,144, 3,932,308, 3,954,476, 4,233,237, 4,255,509, 4,250,246, 4,142,891, 4,207,104, 4,287,292, and Japanese Patent Application (OPI) Nos. 106727/77, 23628/78, 36804/80, 73057/81, 71060/81 and 134/80.

Examples of Cyan Dyes

Those disclosed in U.S. Pat. Nos. 3,482,972, 3,929,760, 4,013,635, 4,268,625, 4,171,220, 4,242,435, 4,142,891, 4,195,994, 4,147,544, 4,148,642; British Pat. No. 1,551,138; Japanese Patent Application (OPI) Nos. 99431/79, 8827/77, 47823/78, 143323/78, 99431/79, 71061/81; European Pat. Nos. 53,037, 53,040; and in *Research Disclosure* Nos. 17630 (1978) and 16475 (1977).

These compounds are generally coated at the rate of about $1\times10^{-4}$ to $1\times10^{-2}$ mol/m$^2$ and preferably at the rate of about $2\times10^{-4}$ to $2\times10^{-2}$ mol/m$^2$.

The color material may be included in the silver halide emulsion layer with which it is combined in this invention or it may be included in a layer close to the said emulsion layer on the exposure side or on the opposite side.

In cases where a photosensitive material of this invention is used in a color diffusion transfer method the photographic emulsion may be coated as one on the same support on which the image receiving layer has been coated or it may be coated on a separate support. Moreover, the silver halide photographic emulsion layer (light sensitive element) and the image receiving layer (image receiving element) may be supplied in a combined form as a film unit or they may be provided in the form of separated independent photographic materials. Furthermore, the film unit may take the form of a unified unit throughout the processes of exposure, development and viewing of the transfer image or it may take a form which is peeled apart after development. The latter type is more effective in connection with this invention.

The invention can be applied to a variety of color photosensitive materials.

Thus, typical examples include color reversal films for slides or television purposes, color reversal papers and instant color films etc. Moreover, it can also be used in full color copying machines and for providing hard copy for storing CRT images etc. The invention can also be applied to the black and white photosensitive materials in which tricolor coupler mixtures are used as disclosed for example in *Research Disclosure,* No. 17123 (published in July 1978).

The photosensitive materials of this invention are capable of forming direct positive color images by image exposure and then developing in a surface developer which contains a primary aromatic amine based color developing agent after or during a fogging treatment which is carried out with light or a nucleating agent, followed by bleaching and fixing processes.

No particular limitation is imposed on the pH of the developer but the photosensitive materials of this invention are particularly effective in that good direct positive color images can be obtained using low pH color developers which have a pH of less than 11.5.

The fogging treatment in this invention may involve either the method in which the whole surface of the light sensitive layer is subjected to a second exposure, known as the "light fogging method" or the method in which the development process is carried out in the presence of a nucleating agent, known as the "chemical fogging method". The development process can also be carried out in the presence of a nucleating agent and fogging light. Furthermore, photosensitive materials which contain a nucleating agent may also be subjected to a fogging exposure.

The whole-surface exposure, that is to say the fogging exposure, used in the 'light fogging method' of this invention is carried out after image exposure and before and/or during the development process. The imagewise exposed photosensitive material is exposed while immersed in developer or developer pre-bath or it is exposed on removal from these solutions before drying, but exposure in the developer is much preferred.

Provided that the wavelength is within the sensitive range of the photosensitive material, any light source can be used for the fogging exposure and in general terms fluorescent lamps, tungsten lamps, xenon lamps, sunlight etc. can be used for this purpose. Actual examples of these methods are disclosed in British Patent No.

1,151,363, Japanese Patent Publication Nos. 12710/70, 12709/70, 6936/83; and Japanese Patent Application (OPI) Nos. 9727/73, 137350/81, 129438/82, 62652/83, 60739/83, 70223/83 (corresponding to U.S. Pat. No. 4,440,851) and 120248/83 (corresponding to European Patent 89101A2) etc. With photosensitive materials which are sensitive to the whole wavelength range, for example with color photosensitive materials, a strongly color rendering light source (as close to white as possible) such as those disclosed in Japanese Patent Application (OPI) Nos. 137350/81 or 70223/83 is best. A level of illumination of 0.01 to 2000 lux, preferably of 0.05 to 30 lux, and more desirably of 0.05 to 5 lux, is appropriate. A lower level of sensitizing light is preferred with photosensitive materials in which higher speed emulsions are used. Illumination control can be achieved by varying the brightness of the light source, by varying photosensitivity using filters, by varying the distance between the photosensitive material and the light source or by varying the angle between the photosensitive material and the light source. It is possible to reduce the exposure time by using weak light for an initial exposure and then using stronger light.

The light irradiation may be carried out after immersing the photosensitive material in the developer or developer pre-bath and allowing the liquid to permeate adequately into the emulsion layers. The time elapsing after immersion in the liquid before exposure to the fogging light is generally 2 seconds to 2 minutes, preferably 5 seconds to 1 minute and more preferably 10 to 30 seconds.

The exposure time for fogging is generally 0.01 seconds to 2 minutes, preferably 0.1 seconds to 1 minute and more preferably 1 to 40 seconds.

All of the compounds developed in the past with a view to nucleating internal latent image type silver halides can be used as the nucleating agent in this invention. Combinations of two or more nucleating agents can also be used. More precisely, the materials disclosed for example on pages 50 to 54 of *Research Disclosure*, No. 22534 (published in January 1983), pages 76 to 77 of *Research Disclosure*, No. 15162 (published in November 1976) and on pages of 346 to 352 of *Research Disclosure*, No. 23510 (published in November 1983) are nucleating agents and these can be broadly classified into three groups, namely quaternary heterocyclic compounds (compounds which can be represented by the general formula [N I] below), hydrazine based compounds (compounds which can be represented by the general formula [N-II] below), and other compounds.

General Formula [N-I]

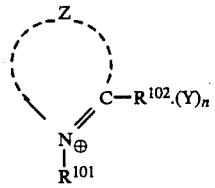

(In this formula Z represents a non-metallic atomic group required to form a 5 or 6 membered heterocyclic ring and it may be substituted with a substituent group. $R^{101}$ is an aliphatic group and $R^{102}$ is a hydrogen atom, aliphatic group or aromatic group. $R^{101}$ and $R^{102}$ may be substituted with substituent groups. However at least one of the groups represented by $R^{101}$, $R^{102}$ and and Z contains an alkynyl group, acyl group, hydrazine group or a hydrazone group or $R^{101}$ and $R^{102}$ form a 6 membered ring, and a dihydropyridinium skeleton is formed. Moreover at least one of the substituent groups of $R^{101}$ to $R^{102}$ and Z may be an $X^1$-$(L_1)_m$ group. Here $X^1$ is a group for promoting adsoption on silver halide and $L^1$ is a divalent linking group. Y is the counter ion to balance the electrical charge, n is 0 or 1 and m is 0 or 1.)

More precisely, the heterocyclic ring which is completed by Z is for example a quinolinium nucleus, a benzothiazolium nucleus, a benzimidazolium nucleus, a pyridinium nucleus, a thiazolinium nucleus, a thiazolium nucleus, naphthothiazolium nucleus, a selenazolium nucleus, a benzosenazolium nucleus, an imidazolium nucleus, tetrazolium nucleus, indolenium nucleus, a pyrrolinium nucleus, an acridinium nucleus, a phenanthridinium nucleus, an isoquinolinium nucleus, an oxazolium nucleus, a naphthoxazolium nucleus or a benzoxazolium nucleus. Alkyl groups, alkenyl groups, aralkyl groups, aryl groups, alkynyl groups, hydroxyl groups, alkoxy groups, aryloxy groups, halogen atoms, amine groups, alkylthio groups, arylthio groups, acyloxy groups, acylamino groups, sulfonyl groups, sulfonyloxy groups, sulfonylamino groups, carboxyl groups, acyl groups, carbamoyl groups, sulfamoyl groups, sulfo groups, cyano groups, ureido groups, urethane groups, carbonate ester groups, hydrazine groups, hydrazone groups or imino groups etc. may be substituent groups of Z. At least one of the substituent groups mentioned above is selected as a substituent of Z and in cases where there are two or more such substituents these may be the same or different. Furthermore, the above mentioned substituent groups may be further substituted with these substituent groups.

Furthermore, heterocyclic quaternary ammonium groups which are completed with Z via an appropriate linking group L may form substituents of Z. In such a case a so-called dimeric structure is adopted.

The preferred heterocyclic rings completed by Z are a quinolinium nucleus, a benzothiazolium nucleus, a benzimidazolium nucleus, a pyridinium nucleus, an acridinium nucleus, a phenanthridinium nucleus and an isoquinolinium nucleus. More preferably this ring is a quinolinium nucleus, a benzothiazolium nucleus and the most preferred ring is a quinolinium nucleus.

The aliphatic groups of $R^{101}$ and $R_{102}$ are unsubstituted alkyl groups of 1 to 18 carbon atoms or substituted alkyl groups of which the alkyl part has 1 to 18 carbon atoms. The substituent groups described for Z may be substituent groups on these aliphatic groups.

The aromatic groups represented by $R^{102}$ have 6 to 20 carbon atoms and may be for example a phenyl group or a naphthyl group. These may have as substituents the substituents described as substituents for Z.

$R^{102}$ is preferably an aliphatic group and most preferably $R_{102}$ is a methyl or substituted methyl group.

At least one of $R^{101}$, $R^{102}$ and Z is an alkynyl group, hydrazine group or hydrazone group, or $R^{101}$ and $R^{102}$ are combined as a 6 membered ring to form dihydropyridinium skeletons and theses may be substituted with the substituent groups described earlier for the group which has been represented by Z.

Cases in which at least one of the substituents on the ring or on the groups represented by $R^{101}$, $R^{102}$ and Z is an alkenyl group or an acyl group, or cases in which a dihydropyridinium skeleton is formed by connecting $R_{101}$ and $R^{102}$ are preferred and the inclusion of at least one alkenyl group is most preferred.

Thioamide groups, mercapto groups or 5 or 6 membered nitrogen-containing heterocyclic rings are preferred for the groups which promote adsorption on silver halide which are represented by XI. These may be substituted with the substituents described as substituents for Z. A non-cyclic type thioamide (for example thiourethane group, thioureido group etc.) is preferred for the thioamido group.

Heterocyclic mercapto groups (for example 5-mercaptotetrazole, 3-mercapto-1,2,4-triazole, 2-mercapto1,3,4-thiadiazole, 2-mercapto-1,3,4-oxadiazole etc.) are especially preferably as the mercapto groups of $X^1$.

The 5 or 6 membered nitrogen-containing heterocyclic rings which are represented by $X^1$ are rings consisting of combinations of nitrogen, oxygen, sulfur and carbon and the preferred rings are those such as benzotriazole, for example, which form iminosilver Atoms or atomic groups including at least one of carbon, nitrogen, sulfur and oxygen form the divalent linking groups which are represented by $L^1$. Actual examples include alkylene groups, alkenylene groups, alkynylene groups, arylene groups, —O—, —S—, —NH—, —N=, —CO—, —$SO_2$—etc. (these groups may also have substituents) and these may be present independently or in combination.

The counter ion Y for balancing the electrical charge is for example a bromide ion, chloride ion, iodide ion, p-toluenesulfonate ion, ethylsulfonate ion, perchlorate ion, trifluoromethylsulfonate ion, thiocyanate ion etc.

Examples of these compounds and methods for their synthesis are disclosed on pages 50 to 54 of *Research Disclosure*, No. 22534 (published in January 1983), pages 267 to 270 of *Research Disclosure*, No. 23213 (published in August 1983); Japanese Patent Publication Nos. 38164/74, 19452/77, 47326/77; Japanese Patent Application (OPI) Nos. 69613/77, 3426/77, 138742/80, 11837/85, and U.S. Pat. Nos. 4,306,016 and 4,471,044.

Actual examples of compounds which can be represented by general formula [N-I] are indicated below but they are not limited to these examples.

(N-I-1)

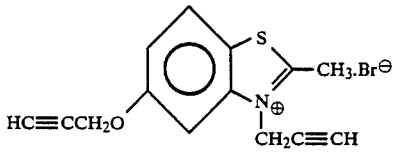

(N-I-2)

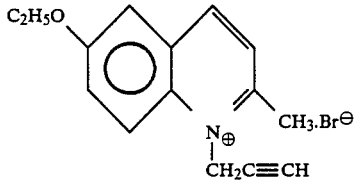

(N-I-3)

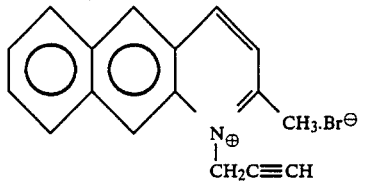

(N-I-4)

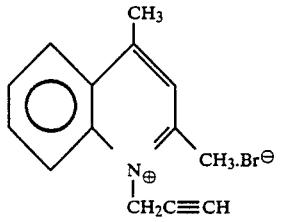

(N-I-5)

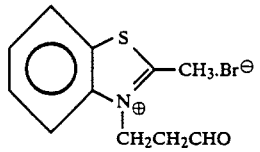

-continued
(N-I-6)
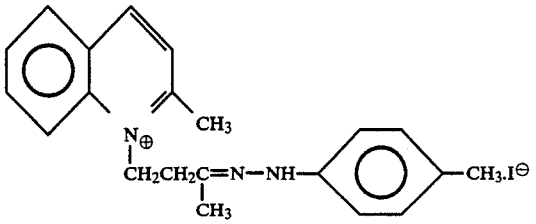
(N-I-7)
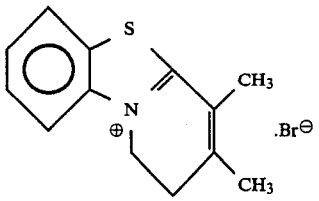
(N-I-8)
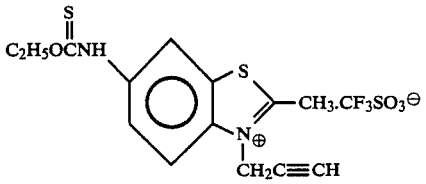
(N-I-9)
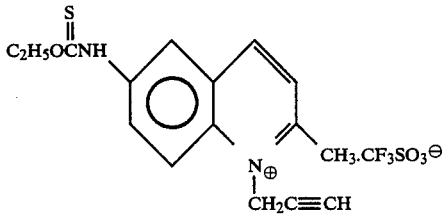
(N-I-10)
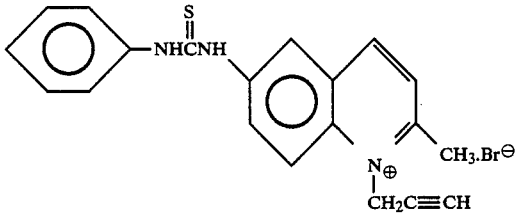
(N-I-11)
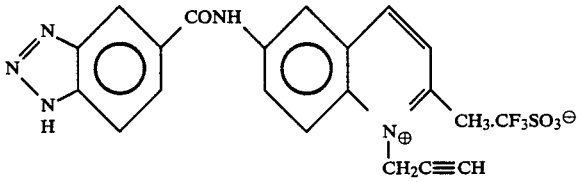
(N-I-12)
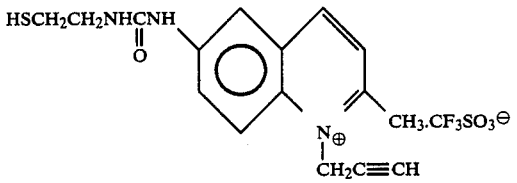

-continued

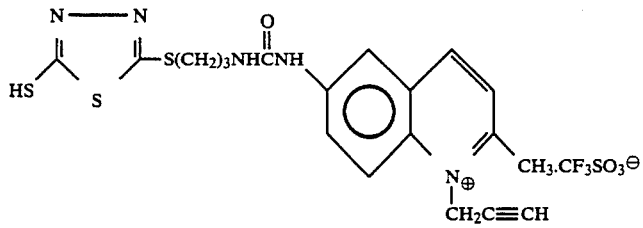

(N-I-13)

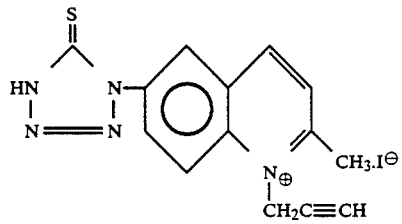

(N-I-14)

General Formula [N-II]

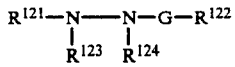

(In this formula $R^{121}$ represents an aliphatic group, aromatic group or a heterocyclic group, R122 represents a hydrogen atom, alkyl group, aralkyl group, aryl group, alkoxy group, aryloxy group or amino group, G represents a carbonyl group, sulfonyl group, sulfoxy group, phosphoryl group or iminomethylene group (NH=C<) and $R^{123}$ and $R^{124}$ both represent hydrogen atoms or one represents a hydrogen atom and the other represents an alkylsulfonyl group, arylsulfonyl group or an acyl group. However a hydrazine structure (>N—N=C<) may be provided in a form which contains G, $R^{123}$, $R^{124}$ and the hydrazine nitrogen. Furthermore where possible the groups mentioned above may be substituted with substituent groups.)

More precisely, $R^{121}$ may be substituted with a substituent such as those indicated below. These groups may also be substituted. For example alkyl groups, aralkyl groups, alkoxy groups, alkyl or aryl substituted amino groups, acylamino groups, sulfonylamino groups, ureido groups, urethane groups, aryloxy groups, sulfamoyl groups, carbamoyl groups, aryl groups, alkylthio groups, arylthio groups, sulfonyl groups, sulfinyl groups, hydroxy groups, halogen atoms, cyano groups, sulfo groups and carboxyl groups etc.

Of these substituents the ureido and sulfonylamino groups are especially preferable.

Where it is possible these groups may be linked together to form a ring.

$R^{121}$ is preferably an aromatic group, an aromatic heterocyclic ring or an aryl substituted methyl group and more preferably it is an aryl group (for example a phenyl group, naphthyl group etc.).

$R^{122}$ is preferably a hydrogen atom, alkyl group (for example a methyl group) or an aralkyl group (for example an o-hydroxybenzyl group etc.) and most preferably it is a hydrogen atom.

As well as those substituents indicated in connection with $R^{121}$ which can be used appropriately, acyl groups, acyloxy groups, alkyl or aryl oxycarbonyl groups, alkenyl groups, alkynyl groups and nitro groups can also be used as substituents for $R^{122}$.

The substituents may also be substituted with these substituents. Furthermore in cases where it is possible these groups may be linking together to form a ring.

Of $R^{121}$ or $R^{122}$, $R^{121}$ may contain a group which is fast to diffusion for the coupler etc, a so-called ballast group, and (especially preferable when linked with a ureido group) it may have a group $X^2$ -(-$L^2$-)-$m_2$ which promotes adhesion on the surface of the silver halide grains. Here $X^2$ has the same significance as X, in general formula [N I] and it is preferably a thioamide group (excluding thiosemicarbazide and substituted derivatives thereof), a mercapto group, or a 5 or 6 membered nitrogen-containing heterocyclic group. $L^2$ represents a divalent linking group and has the same significance as $L^2$ in general formula [N I]. $m_2$ is 0 or 1.

$X^2$ is preferably a non-cyclic thioamide group (for example a thioureido group, thiourethane group etc.), a cyclic thioamide group (which is to say a mercapto substituted nitrogen-containing heterocyclic ring, for example a 2-mercapto-1,3,4-thiadiazole group, a 3-mercapto-1,2,4-triazole group, a 5-mercaptotetrazole group, a 2-mercapto-1,3,4-oxadiazole group, a 2-mercaptobenzoxazole group etc.) or a nitrogen-containing heterocyclic group (for example a benzotriazole group, benzimidazole group, indazole group etc.).

The most preferred $X^2$ group differs according to the sensitive material which is being used. For example when a coupling material (a coupler) which forms a dye by means of a coupling reaction with the oxidized form of a p-phenylenediamine based developing agent in a color sensitive material is being used $X^2$ is preferably a mercapto substituted nitrogen-containing heterocyclic ring or a nitrogen-containing heterocyclic ring which forms iminosilver. Furthermore when a coloring material (a DRR compound) which form a diffusible dye by cross oxidation of the oxidized form of the developing agent in a color sensitive material is being used $X^2$ is preferably a noncyclic thioamide group or a mercapto substituted nitrogen-containing heterocyclic ring. Moreover in black and white sensitive materials $X^2$ is preferably a mercapto substituted nitrogen-containing heterocyclic ring or a nitrogen-containing heterocyclic ring which forms iminosilver.

$R^{123}$ and $R^{124}$ are most preferably hydrogen atoms.

G in the general formula [N-II] is most preferably a carbonyl group.

Furthermore compounds of general formula [N-II] preferably have either groups for adsorption on silver halide or ureido groups.

Examples of these compounds and methods for their synthesis are to be found in the literature as indicated below. Thus examples of hydrazine based nucleating agents which have groups for adsorption on silver halide are disclosed for example in U.S. Pat. Nos. 4,030,925, 4,080,207, 4,031,127, 3,718,470, 4,269,929, 4,276,364, 4,278,748, 4,385,108, 4,459,347, 4,478,928, 4,560,632; British Patent No. 2,011,391B and Japanese Patent Application (OPI) Nos. 74729/79, 163533/80, 74536/80 and 179734/80.

Other hydrazine based nucleating agents are disclosed for example in Japanese Patent Application (OPI) No. 86829/82; U.S. Pat. Nos. 4,560,638, 4,478,928 and also in 2,563,785 and 2,588,982.

Typical examples of compounds which can be represented by the general formula [N-II] are indicated below but the invention is not limited to these compounds.

(N-II-1)

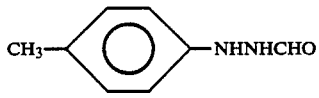

(N-II-2)

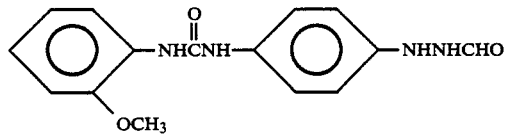

(N-II-3)

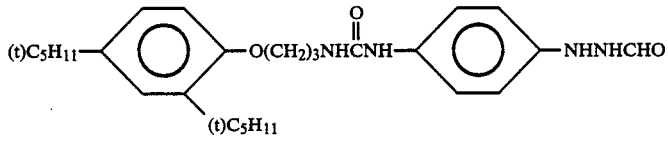

(N-II-4)

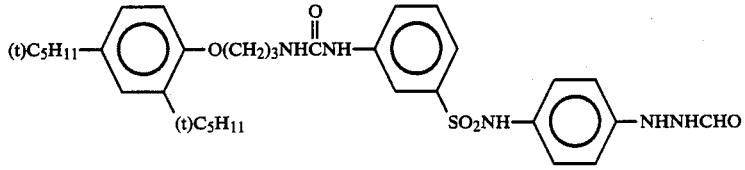

(N-II-5)

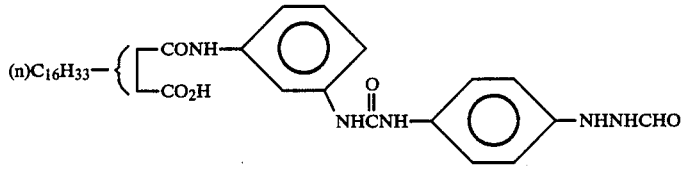

(wherein 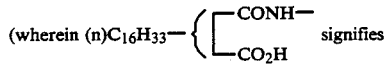

signifies

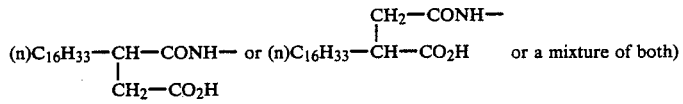

or a mixture of both)

(N-II-6)

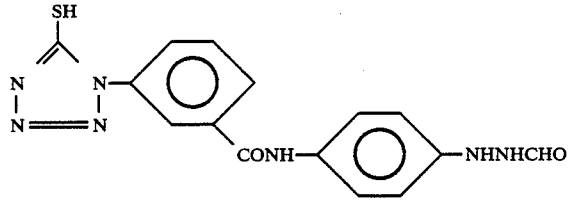

-continued
(N-II-7)
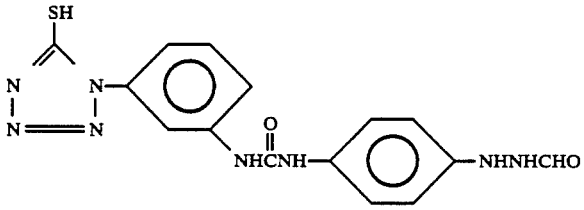
(N-II-8)
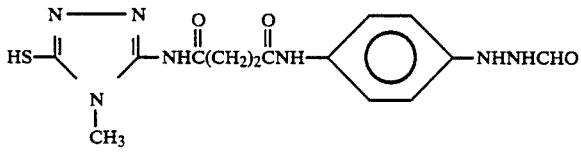
(N-II-9)
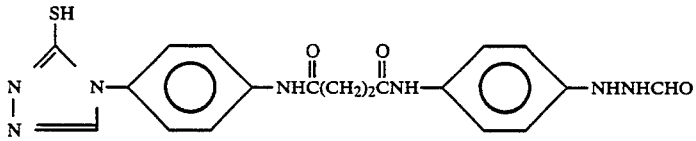
(N-II-10)
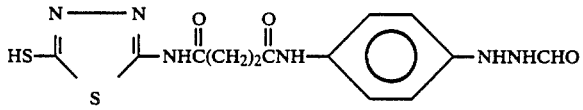
(N-II-11)
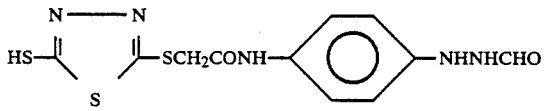
(N-II-12)
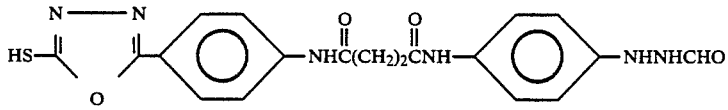
(N-II-13)
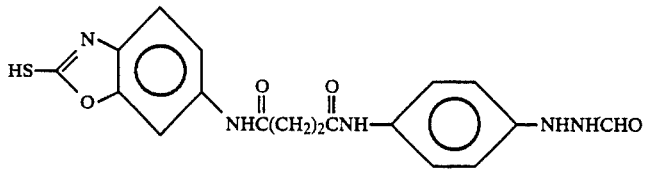
(N-II-14)
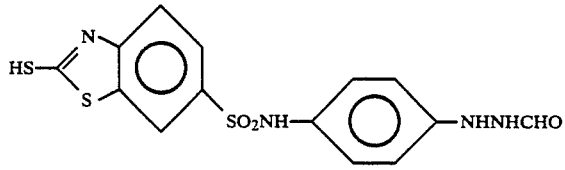
(N-II-15)
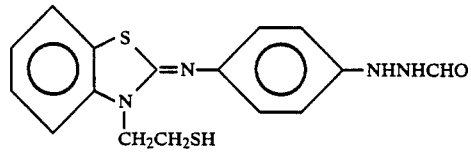
(N-II-16)
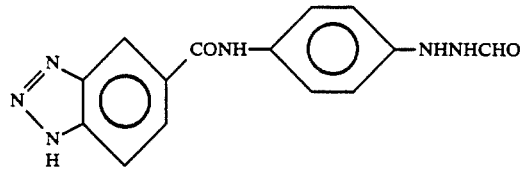

-continued
(N-II-17)
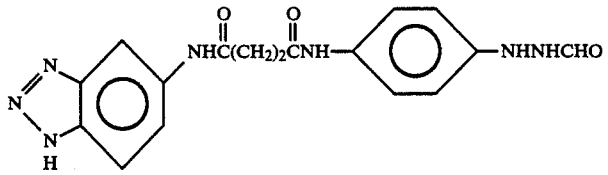
(N-II-18)
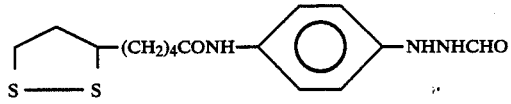
(N-II-19)
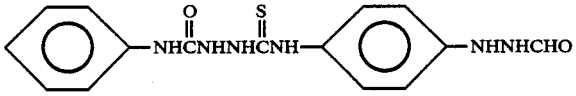
(N-II-20)
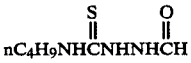
(N-II-21)
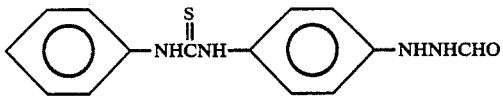
(N-II-22)
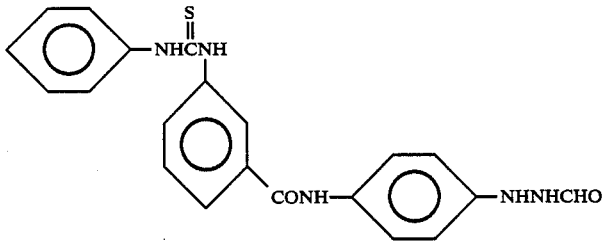
(N-II-23)
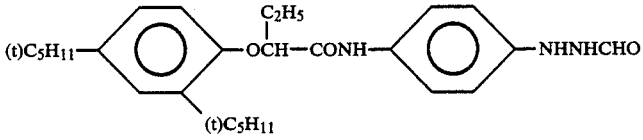
(N-II-24)
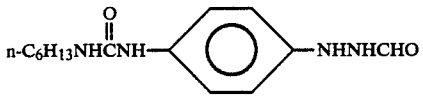
(N-II-25)
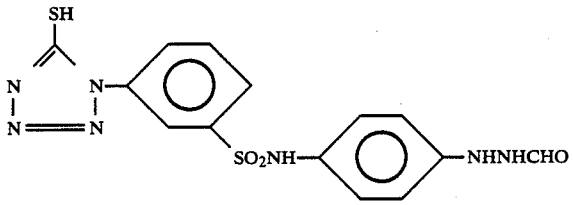
(N-II-26)
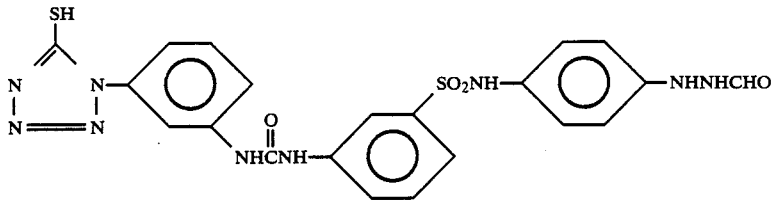
The nucleating agents used in the invention can be included in the sensitive material or in the processing solution for the sensitive material but their inclusion in the sensitive material is preferred.

When the nucleating agent is included in the sensitive material it is preferably used at the rate of $10^{-8}$ to $10^{-2}$ mol and more preferably at the rate of $10^{-7}$ to $10^{-3}$ mol per 1 mol of silver halide.

Furthermore when the nucleating agent is added to a processing solution it is preferably used at the rate of $10^{-8}$ to $10^{10}$ $^{-3}$ mol and more preferably at the rate of $10^{-7}$ to $10^{-4}$ mol per 1 liter of solution.

The following compounds can be added with a view to raising the maximum image density, lowering the minimum image density and improving the storage properties of the photosensitive material or with a view to speeding up development.

Hydroquinones (for examples the compounds disclosed in U.S. Pat. Nos. 3,227,552, 4,279,987); chromans (for example the compounds disclosed in U.S. Pat. No. 4,268,621, Japanese Patent Application (OPI) No. 103031/79, and on pages 333 to 334 of *Research Disclosure*, No. 18264 (published in June 1979)); quinones (for example the compounds disclosed on pages 433 to 434 of *Research Disclosure*, No. 21206 (published in December 1981)), amines (for example the compounds disclosed in U.S. Pat. No. 4,150,993 and Japanese Patent Application (OPI) No. 174757/83); oxidizing agents (for example the compounds disclosed in Japanese Patent Application (OPI) No. 260039/85 and on pages 10 to 11 of *Research Disclosure*, No. 16936 (published in May 1978)); catechols (for example the compounds disclosed in Japanese Patent Application (OPI) Nos. 21013/80 and 65944/80); compounds which release nucleating agents during development (for example the compounds disclosed in Japanese Patent Application (OPI) No. 107029/85); thioureas (for example the compounds disclosed in Japanese Patent Application (OPI) No. 95533/85); spirobisindanes (for example the compounds disclosed in Japanese Patent Application (OPI) No. 65944/80).

Tetrazaindenes, triazaindenes and pentazaindenes which have at least one mercapto group which may be substituted arbitrarily with an alkali metal atom or an ammonium group and the compounds disclosed in Japanese Patent Application No. 136948/86 (pages 2 to 6 and pages 16 to 43) and Japanese Patent Application No. 136949/86 (pages 12 to 43) can be added as nucleation accelerators for speeding up nucleation.

Actual examples of nucleation accelerators are indicated below but such compounds are not limited to those indicated below.

(A-1)

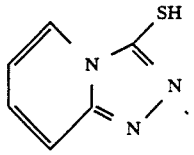

(A-2)

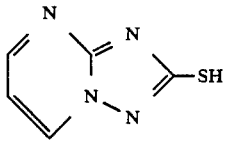

(A-3)

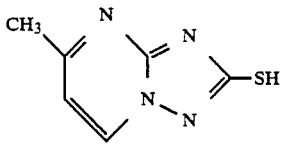

-continued (A-4)

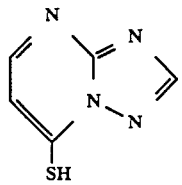

(A-5)

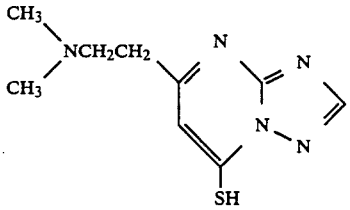

(A-6)

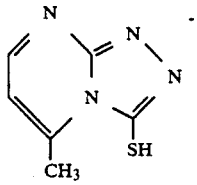

(A-7)

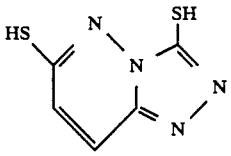

(A-8)

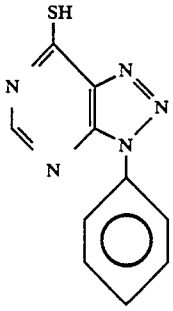

(A-9)

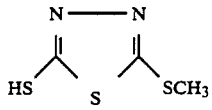

(A-10)

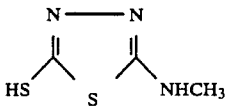

(A-11)

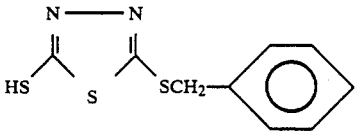

(A-12)

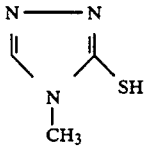

-continued
(A-13)
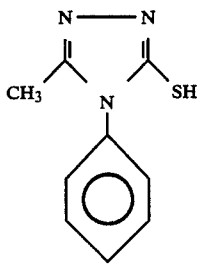
(A-14)
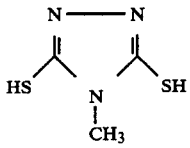
(A-15)
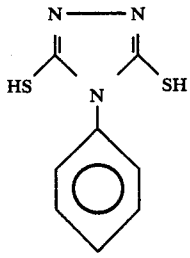
(A-16)
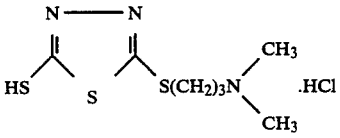
(A-17)
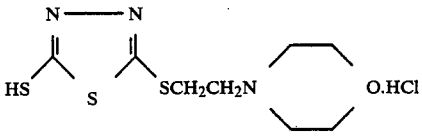
(A-18)
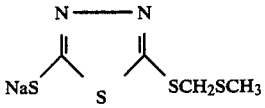
(A-19)
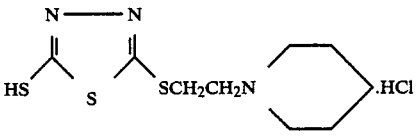
(A-20)
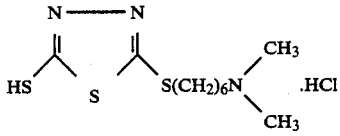
(A-21)
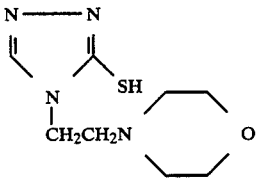
-continued
(A-22)
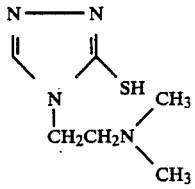
(A-23)
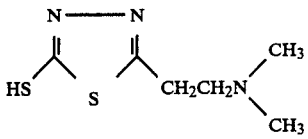
(A-24)
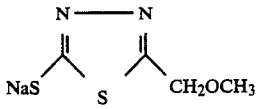
(A-25)
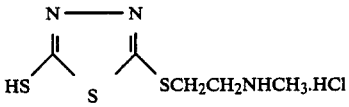
(A-26)
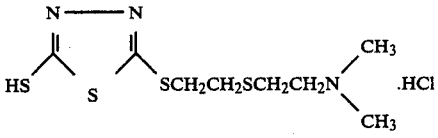
(A-27)
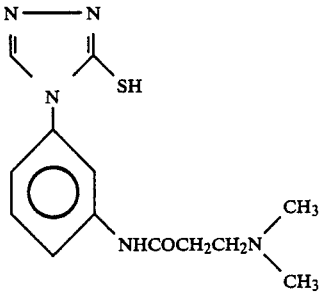
(A-28)
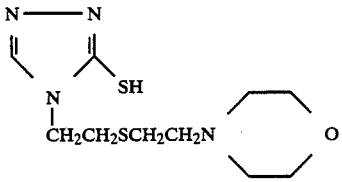
(A-29)
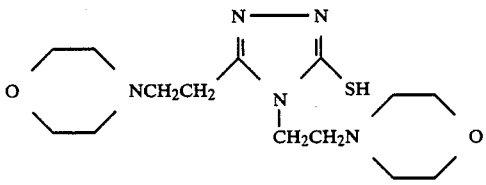
(A-30)
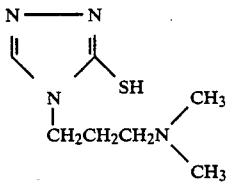

-continued

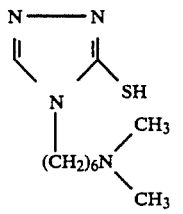
(A-31)

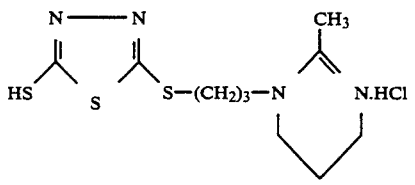
(A-32)

Nucleation accelerators can be included in the photosensitive material or in a processing solution but they are preferably included in the internal latent image type silver halide emulsion or in some other hydrophilic colloid layer (intermediate layer or protective layer etc.) in the photosensitive material. The nucleation accelerator is most desirably included in the silver halide emulsion layer or in a layer which is adjacent to this layer.

The nucleation accelerator is preferably added at a rate of $10^{-6}$ to $10^{-2}$ mol and more desirably at a rate of $10^{-5}$ to $10^{-2}$ mol per 1 mol of silver halide.

Furthermore when the nucleation accelerator is added to a processing solution, which is to say to the developer or to a pre-bath, it is preferably added at a rate of $10^{-8}$to $10^{-3}$ mol and more desirably at a rate of $10^{-7}$ to $10^{-4}$ per liter of solution.

It is possible to use two or more types of nucleating accelerator conjointly.

The color developer used in the developing process of the photosensitive materials of this invention are preferably alkaline aqueous solutions which have a primary aromatic amine based color developing agent as the principal component. Aminophenol based compounds can also be used for the color developing agent but the use of p-phenylenediamine based compounds is preferred. Thus 3-methyl-4-amino-N,N-diethylaniline, 3-methyl-4-amino-N-ethyl-N-8-hydroxyethylaniline, 3-methyl 4-amino-N-ethyl-N-$\beta$8-methanesulfonamidoethylaniline, 3-methyl-4-amino-N-ethyl-N-8-methoxyethylaniline and their sulfates, hydro- chlorides or p-toluenesulfonates are typical examples of these developing agents. Two or more of these compounds can be used conjointly depending on the intended purpose of the developer.

The color developer generally contains pH buffering agent such as an alkali metal carbonate, borate or phosphate and a development restrainer or anti-foggant such as a bromide, an iodide, a benzimidazole, a benzothiazole or a mercapto compound. It may also contain, as required, various preservatives such as hydroxylamine, diethylhydroxylamine, sulfites, hydrazines, phenylsemicarbazides, triethanolamine, catechol sulfonic acids and triethylenediamine(1,4-diazabicyclo[2,2,2]octanes), organic solvents such as ethylene glycol and diethylene glycol, development accelerators such as benzyl alcohol, polyethylene glycol, quaternary ammonium salts and amines, dye forming couplers, competitive couplers, fogging agents such as sodium borohydride, auxiliary developing agents such as 1-phenyl-3-pyrazolidone, viscosity imparting agents and various chelating agents as typified by aminopolycarboxylic acids, aminopolyphosphonic acids, alkylphosphonic acids and phosphonocarboxylic acids, for example, ethylenediamine tetraacetic acid, nitrilotriacetic acid, diethylenetetramine pentaacetic acid, cyclohexanediamine tetraacetic acid, hydroxyethylimino diacetic acid, 1-hydroxyethylidene 1,1-diphosphonic acid, nitrilo-N,N,N,-trimethylene phosphonic acid, ethylenediamine-N,N,N',N'-tetramethylene phosphonic acid, ethylenediamine-di(o-hydroxyphenylacetic acid) and salts of these compounds as typical examples.

The pH of these color developers is generally from 9 to 12 and preferably from 9.5 to 11.5.

The replenishment rate of these developers depends upon the color photographic material which is being processed but it is generally less than 1 liter per 1 square meter of photosensitive material and it can be reduced to less than 300 ml per square meter by reducing the bromide ion concentration in the replenisher. In cases where the replenishment rate is reduced the prevention of liquid evaporation and aerial oxidation is preferably achieved by minimizing the contact area with the air in the processing tank. Furthermore the replenishment rate can also be reduced by using some means of suppressing the accumulation of bromide ion in the developer.

The photographic emulsion layer is normally bleached after color development. The bleaching process may be carried out concurrently with the fixing process (in a bleach-fix process) or the two processes may be carried out separately. Furthermore a bleach-fix process can be used after a bleaching process in order to speed up processing. Moreover the material can be treated in bleach-fix solution in two consequtive tanks, a fixing process can be used perior to a bleach-fix process or a bleaching process may be carried out after a bleach-fix process as required, depending on the objective of the processing. Compounds of polyvalent metals such as iron (III), cobalt (III), chromium (VI), copper (II) etc., peracids, quinones, nitro compounds etc. can be used for example as bleaching agents. Thus ferricyanide; dichromates; organic complexes of iron (III) or cobalt (III), for example complexes of aminopolycarboxylic acid such as ethylenediamine tetraacetic acid, diethylenetriamine pentaacetic acid, cyclohexanediamine tetraacetic acid, methylimino diacetic acid, 1,3-diaminopropane teraacetic acid, glycol ether diamine tetraacetic acid, etc. or citric acid complexes, tartaric acid complexes, malic acid complexes etc.; persulfates; bromates; permanganates; nitrobenzenes etc. can be used as typical bleaching agents. Of these materials the use of aminopolycarboxylic acid iron (III) complexes, particularly the ethylenediamine tetraacetic acid iron (III) complexes, and the persulfates are preferred from the points of view of both processing speed and the avoidance of environmental pollution. Moreover the aminopolycarboxylic acid iron (III) complexes are especially useful in both bleaching solutions and bleach-fix solutions. The pH of the bleach solutions and bleach-fix solutions in which these aminopolycarboxylic acid iron (III) complexes are used in normally 5.5 to 8 but processing can be carried out at a lower pH in order to speed up the process.

Bleaching accelerators can be used as required in the bleach baths, bleach-fix baths and bleach and bleachfix pre-baths. Typical examples of useful bleaching accelerators which can be used for this purposes have been disclosed in the following specifications: Compounds which have mercapto groups or disulfide bonds as disclosed in U.S. Pat. No. b 3,893,858, West German Pat. No. 1,290,812, Japanese Patent Application (OPI) No. 95630/78 and *Research Disclosure*, No. 17129 (published in July 1978); thiazolidine derivatives as disclosed in Japanese Patent Application (OPI) No. 140129/75, thiourea derivatives as disclosed in U.S. Pat. No. 3,706,561; iodides as disclosed in Japanese Patent Application (OPI) No. 16235/83, polyoxyethylene compounds as disclosed in West German Pat. No. 2,748,430; polyamine compounds as disclosed in Japanese Patent Publication No. 8836/70, and bromide ions etc. Of these materials the use of compounds which have mercapto groups or disulfide groups is preferred from the point of view of their considerable accelerating effect and the use of the compounds disclosed in U.S. Pat. No. 3,893,858, West German Patent No. 1,290,812 or Japanese Patent Application (OPI) No. 95630/78 is especially desirable. Moreover the use of the compounds disclosed in U.S. Pat. No. 4,552,834 is also preferred. These bleaching accelerators may also be added to the sensitive material. These bleaching accelerators are especially effective when bleach fixing color photosensitive materials which have been used for photographic purposes.

Thiosulfates, thiocyanates, thioether based compounds, thioureas, large quantities of bromides etc. can be used for the fixer but thiosulfates are generally used and ammonium thiosulfate is the most widely used of these materials. Sulfites, bisulfites, or carbonylbisulfite addition compounds are the preferred preservatives for bleach-fix baths.

The silver halide color photographic materials of this invention are generally subjected to a water wash and/or stabilizing process after the desilvering process. The amount of water used in the water washing process can be established over a wide range depending on the properties of the photosensitive material (for example the use of couplers etc.) and its ultimate application, and moreover the wash water temperature, the number of wash tanks (number of stages), whether replenishment is carried out with a counter flow or a sequential flow system, and various other conditions. The relationship between the amount of water used and the number of washing tanks in a multi-stage counter-flow system can be derived using the method indicated on pages 248 to 253 of Volume 64 of the Journal of the Society of Motion Picture and Television Engineers (May 1955).

The amount of wash water required can be greatly reduced by adopting the multi-stage counter-flow system described in the aforementioned publication but problems can arise with bacterial growth and the attachment of suspended material produced by bacterial growth to the photosensitive material as a result of the increased residence time of the water in the tanks. The method of reducing the amount of calcium ion and magnesium ion disclosed in Japanese Patent Application No. 131632/86 is very effective for overcoming these problems. Furthermore the isothiazolone compounds and thiabendazoles disclosed in Japanese Patent Application (OPI) No. 8542/82, chlorine based bactericides such as chlorinated sodium isocyanate etc., benzotriazoles etc., and the bactericides mentioned in "The Chemistry of Bactericides and Fungicides" by Hiroshi Horiguchi, the Hygiene Technology Association publication entitled "Bacteriostatic, Bactericidal and Fungicidal Techniques" and in the Japan Bactericide and Fungicide Association publication entitled "A Dictionary of Bactericides and Fungicides" can also be used for this purpose.

The pH of the wash water used for processing the photosensitive materials of this invention is between 4 and 9 and preferably between 5 and 8. The wash water temperature and washing time can be set in accordance with the characteristics of the photosensitive material and the particular application but generally a wash of duration 20 seconds to 10 minutes at 15° to 45° C and preferably of duration 30 seconds to 5 minutes at 25° to 40° C is used. Moreover the photosensitive materials of this invention can be treated with a direct stabilizing solution in place of the above mentioned water wash. Any of the stabilizing treatments disclosed in Japanese Patent Application (OPI) Nos. 8543/82, 14834/83 and 220345/85 can be adopted for this purpose. Various chelating agents and fungicides may be added to the stabilizing bath.

The overflow which accompanies replenishment of the above mentioned wash water and/or stabilizer can be reused in other desilvering processes etc.

Color developing agents can also be incorporated into the silver halide photosensitive materials of this invention with a view to simplifying and speeding up processing. The use of various precursors of color developing agents is preferred for this purpose. For example use can be made of the indoaniline based compounds disclosed in U.S. Pat. No. 3,342,597, the Schiff base type compounds disclosed in U.S. Pat. No. 3,342,599 and in *Research Disclosure* Nos. 14850 and 15159, the aldol compounds disclosed in *Research Disclosure* No. 13924, the metal salt complexes disclosed in U.S. Pat. No. 3,719,492 and the urethane based compounds disclosed in Japanese Patent. Application (OPI) No. 135628/78.

Various 1-phenyl-3-pyrazolidones may also be included as required in the silver halide color photosensitive materials of this invention in order to accelerate color development. Typical compounds of this type are disclosed in Japanese Patent. Application (OPI) Nos. 64339/81, 144547/82 and 115438/83 etc.

The various processing baths are used at a temperature of 10° C. to 50° C. in this invention. The temperature is normally standardized at 33° C. to 38° C. but processing may be accelerated and the processing time shortened by raising the temperature while improvement of image quality and processing solution stability can be achieved by lowering the processing temperature. Furthermore processes using hydrogen peroxide intensification or cobalt intensification as disclosed in West German Pat. No. 2,226,770 or U.S. Pat. No. 3,674,499 can be used to economize on silver in the photosensitive material.

Lower replenishment rates are preferred in each of the processing operations. The amount of replenisher is preferably 0.1 to 50 times, and more desirably 3 to 30 times, the amount of carry-over from the bath before, per unit area of photosensitive materials.

On the other hand various known developing agents can be used to develop black and white photosensitive materials in this invention. For example polyhydroxybenzenes such as hydroquinone, 2-chlorohydroquinone, methylhydroquinone, catechol, pyrogallol etc; aminophenols such as p-aminophenol, N-methyl-p-aminophenol, 2,4-diaminophenol; 3-pyrazolidones such as 1-phenyl-3-pyrazolidones, 1-phenyl-4,4'-dimethyl-3-pyrazolidone, 1-phenyl-4-methyl-4-hydroxymethyl-3-pyrazolidone, 5,5-dimethyl-1-phenyl-3-pyrazolidone;

ascorbic acids etc. can be used individually or in combinations for this purpose. Furthermore the developer disclosed in Japanese Patent. Application (OPI) No. 55928/83 can also be used for this purpose. Developing agents of this type may be included in an alkaline processing composition (processing element) or they may be included in the appropriate layer of a light sensitive element.

Sodium sulfite, potassium sulfite, ascorbic acid, reductones (for example piperidinohexose reductone) etc. may be included in the developer as a preservative.

A direct positive image can be obtained with the photosensitive materials of this invention by development with a surface developer. A surface developer is a developer with which the development process is induced essentially by the latent image and fogging nuclei which are present on the surfaces of the silver halide grains. The developer preferably, does not contain a silver halide solvent but such a solvent (for example a sulfite) may be included provided that the internal latent image makes essentially no contribution to the development process until development of the surface development center of the silver halide grains has been essentially completed.

Sodium hydroxide, potassium hydroxide, sodium carbonate, potassium carbonate, trisodium phosphate, sodium metaborate etc. may be included in the developer as alkali and buffering agents. The quantities of these agents are selected in such a way as to provide a developer of pH 9 to 13 and preferably of pH 10 to 11.5.

The inclusion in the developer of compounds normally used as fogging restrainers, for example the benzimidazoles, such as 5-nitrobenzimidazole; the benzotriazoles, such as benzotriazole, 5-methylbenzotriazole etc. is useful for minimizing the minimum density of the direct positive image.

Detailed practical examples of developing agents, preservatives, buffering agents, methods of development and methods of use for black and white photosensitive materials are disclosed in sections XIX to XXI of *Research Disclosure,* No. 17643 (published in December 1978) etc.

It is possible to use any type of silver halide developing agent (or electron donating agent) provided that it is able to undergo cross-oxidation when DRR compounds are used in the invention.

Developing agents of this type may be included in alkaline development processing baths (processing elements) or in an appropriate layer of a photographic element. Examples of developing agents which can be used in the invention are as follows:

Hydroquinone, aminophenols, for example N-methylaminophenol, 1-phenyl-3-pyrazolidinone, 1-phenyl-4,4-dimethyl-3-pyrazolidinone, 1-phenyl-4-methyl-4-oxymethyl-3-pyrazolidinone, N,N-diethyl-p-phenylenediamine, 3-methyl-N,N-diethyl-p-phenylenediamine, 3-methoxy-N-ethoxy-p-phenylenediamine etc.

The use of one of the black and white developing agents mentioned here which generally produces little staining of the image-receiving layer (mordant layer) is especially desirable, as is the case with the alkali development processing solutions described earlier.

Processing is preferably carried out with a viscous developer when the sensitive materials of this invention are used in films in which use is made of the diffusion transfer principle. Such viscous developers are liquid compositions which contain the necessary processing components for the development of a silver halide emulsion and for forming diffusion transfer dye images) and they are based on water as the principal solvent but they may also contain other hydrophilic solvents such as methanol and methylcellosolve etc.

The preferred processing compositions contain hydrophilic polymers such as high molecular weight poly(vinyl alcohol), hydroxyethylcellulose and sodium carboxymethylcellulose. These polymers may be used in such a way as to provide a processing composition of viscosity at room temperature of at least 1 poise and preferably of some 500 to 1000 poise.

The above mentioned processing compositions are preferably used by packing into a container which can be burst by the application of pressure as disclosed in U.S. Pat. Nos. 2,543,181, 2,643,886, 2,653,732, 2,723,051, 3,056,491, 3,056,492 and 3,152,515 etc.

The invention is illustrated by means of examples below but the invention is not limited by these examples.

Moreover the A and B emulsions used in the examples were prepared in the following way:

Emulsion A

An aqueous solution of silver nitrate were added simultaneously with vigorous stirring over a period of about 20 minutes at 75° C. to an aqueous gelatin solution to which 0.3 gram per mole of silver of 3,4-dimethyl 1,3-thiazoline-2-thione had been added and a monodispersed octahedral silver bromide emulsion of grain size 0.4 μm was obtained. Six milligrams each of sodium thiosulfate and chloroauric acid (tetrahydrate) were added to this emulsion per 1 mol of silver and chemical sensitization was achieved by heating the emulsion to 75° C. for a period of 80 minutes. The silver bromide grains obtained in this way were then used as cores and grown for a further period of 40 minutes under the same precipitation conditions as on the first occasion until finally a monodispersed octahedral core/shell silver bromide emulsion of grain size 0.7 μm was obtained. This emulsion was washed with water and desalted and then 1.5 mg each of sodium thiosulfate and chloroauric acid (tetrahydrate) were added per 1 mol of silver, chemical sensitization was achieved by heating to 60° C. for a period of 60 minutes and the internal latent image type silver halide emulsion A was obtained. The variation coefficient of the grain size distribution was 10%.

Emulsion B 30 g of gelatin was added to and dissolved in 1 liter of a mixture of potassium bromide, sodium chloride and potassium iodide at concentrations of 0.5 mol, 0.2 mol and 0.0015 mol per liter respectively. Seven hundred cubic centimeters of a silver nitrate solution of concentration 1 mol/liter was added over a period of 20 minutes to the aforementioned solution at a temperature of 60° C. and the mixture was physically ripened for a period of 20 minutes.

The emulsion was then washed with water and after the soluble halide had been removed 20 grams of gelatin was added and the total volume was made up to 1200 cc with water. A silver halide emulsion of average grain size 0.4 μm was obtained in this way.

Next 500 cc of silver nitrate solution of concentration 1 mol/liter and 500 cc of aqueous sodium chloride solution of concentration 2 mol/liter were added simultaneously at 60° C. to 300 cc of the above mentioned emulsion which was washed with water after precipitating a silver chloride shell in this way. Silver halide emulsion B of average grain size 0.7 μm was obtained in this way.

EXAMPLE 1

Multilayer color printing papers with the layer structure indicated in Table 1 were formed using the core/-shell type internal latent image emulsion A on a paper support which had been laminated on both sides with polyethylene. Coating liquid was prepared as below.

Preparation of the Coating Liquid for the First Layer:

A solution obtained by adding 10 ml of ethyl acetate and 4 ml of solvent (c) to 10 grams of the cyan coupler (a) and 2.3 grams of the color image stabilizer (b) was emulsified and dispersed in 90 ml of a 10% aqueous gelatin solution which contained 5 ml of 10% sodium dodecylbenzenesulfonate. On the other hand, the red sensitizing dye indicated below was added at the rate of $2.0\times10^{-4}$ mol per 1 mol of silver halide to the above mentioned silver halide emulsion (containing 70 g/kg of silver) to provide 90 grams of red sensitive emulsion. The emulsified dispersion, emulsion and development accelerator (d) were then mixed together and dissolved, the concentration was adjusted with gelatin to provide the composition shown in Table 1 and the resulting material was used as the coating liquid for the first layer.

The coating liquids for the second to seventh layers and the B1 and B2 layers were prepared using the same method as for the first layer. Moreover 1-oxy-3,5-dicloro-s-triazine sodium salt, and 1,2-bis(vinylsulphoniumaetoamide) ethane were each used at the rate of 0.6 wt % with respect to the gelatin as gelatin hardeners in each of the layers. Moreover the FR compounds of this invention were added as indicated in Table 2 at the rate of $5.0\times10^{-3}$ mol per 1 mol of silver.

TABLE 1

| Layer | Principal Composition | Amount Used |
|---|---|---|
| Seventh Layer (Protective layer) | Gelatin | 1.33 g/m$^2$ |
| | Latex particles of polymethyl acrylate (Average particle size 2.7 μm) | 0.05 g/m$^2$ |
| | Acrylic modified poly (vinyl alcohol) copolymer (17% modification) | 0.17 g/m$^2$ |
| Sixth Layer (Ultraviolet absorbing layer) | Gelatin | 0.54 g/m$^2$ |
| | Ultraviolet Absorber (i) | $5.10\times10^{-4}$ mol/m$^2$ |
| | Solvent (k) | 0.08 g/m$^2$ |
| Fifth Layer (Blue sensitive layer) | Emulsion | Silver: 0.40 g/m$^2$ |
| | Gelatin | 1.35 g/m$^2$ |
| | Yellow Coupler (l) | $6.91\times10^{-4}$ mol/m$^2$ |
| | Color Image Stabilizer (m) | 0.13 g/m$^2$ |
| | Solvent (h) | 0.02 g/m$^2$ |
| | Color Development Accelerator(d) | 32 mg/m$^2$ |
| Fourth Layer (Ultraviolet absorbing layer) | Gelatin | 1.60 g/m$^2$ |
| | Colloidal Silver | 0.10 g/m$^2$ |
| | Ultraviolet Absorber (i) | $1.70\times10^{-4}$ mol/m$^2$ |
| | Color Mixture (j) Preventing Agent | $1.60\times10^{-4}$ mol/m$^2$ |
| | Solvent (k) | 0.24 g/m$^2$ |
| Third Layer (Green sensitive layer) | Emulsion | Silver: 0.18 g/m$^2$ |
| | Gelatin | 1.56 g/m$^2$ |
| | Magenta coupler (f) | $4.60\times10^{-4}$ mol/m$^2$ |
| | Color Image Stabilizer (g) | 0.14 g.m$^2$ |
| | Solvent (h) | 0.42 g.m$^2$ |
| | Development Accelerator (d) | 32 mg/m$^2$ |
| Second Layer (Color mixing preventing layer | Gelatin | 0.90 g/m$^2$ |
| | Colloidal Silver | 0.02 g/m$^2$ |
| | Color Mixture Preventing Agent (e) | $2.33\times10^{-4}$ mol/m$^2$ |
| First Layer (Red sensitive layer) | Emulsion | Silver: 0.39 g/m$^2$ |
| | Gelatin | 0.90 g/m$^2$ |
| | Cyan coupler (a) | $7.05\times10^{-4}$ mol/m$^2$ |
| | Color Image Stabilizer (b) | $5.20\times10^{-4}$ mol/m$^2$ |
| | Solvent (c) | 0.22 g/m$^2$ |
| | Development Accelerator (d) | 32 mg/m$^2$ |
| Support | Polyethylene laminated paper (white pigment (TiO2) & blue dye (ultramarine) included in the polyethylene on the first layer side) Thickness 100 μm | |
| B1 Layer (Anti-curling layer) | Gelatin | 3.6 g/m$^2$ |
| B2 Layer (Protective layer) | Same as the Seventh Layer | |

The following compounds were employed for the spectral sensitivity increasing dyes.

Red Sensitive Emulsion Layer:

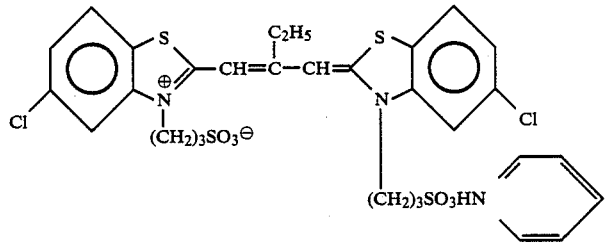

Green Sensitive Emulsion Layer:

-continued

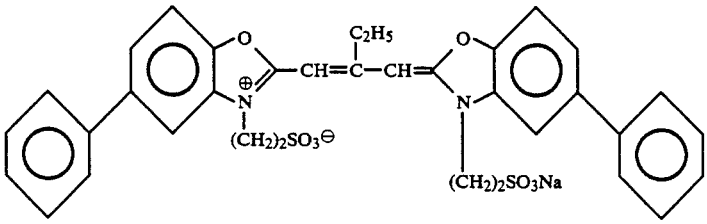

Blue Sensitive Emulsion Layer:

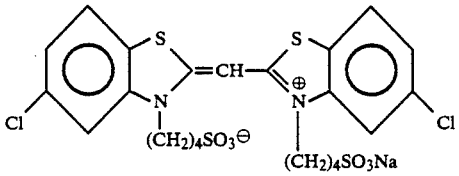

The following dyes were used as irradiation preventing dyes.

Irradiation Preventing Dye Used in the Green Sensitive Emulsion Layer:

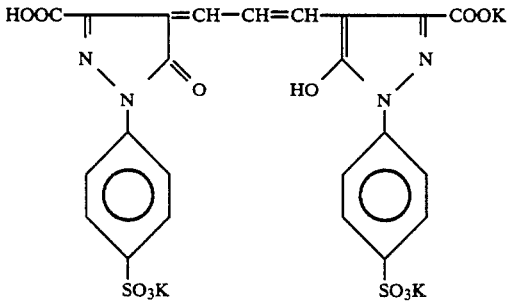

Irradition Preventing Dye Used in the Red Sensitive Emulsion Layer:

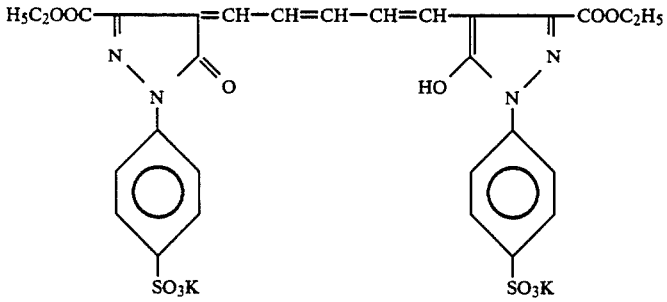

The structural formulae of the compounds used in the example as couplers etc. are indicated below.

(a) Cyan Coupler:
A 1:1 (mol ratio) mixture of

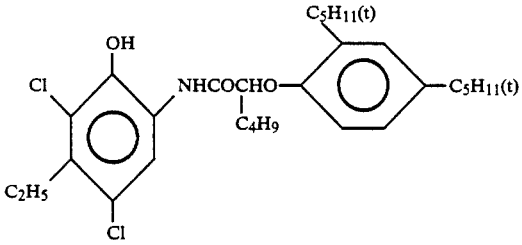

and

-continued
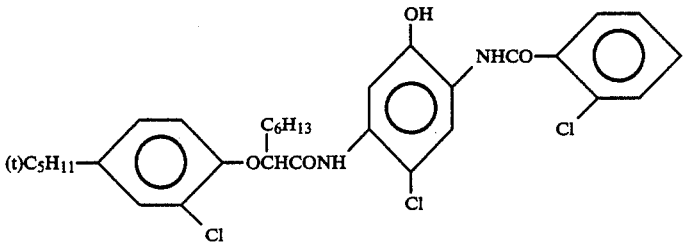
(b) Color Image Stabilizer:
A 1:3:3 mixture (mole ratio) of
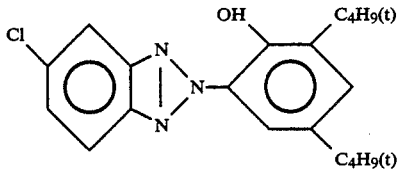
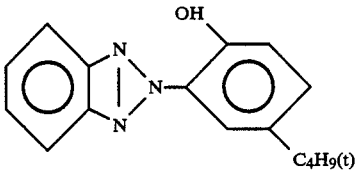
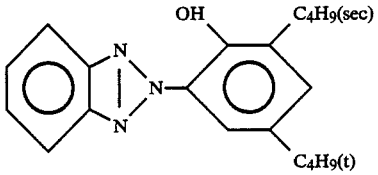
(c) Solvent:
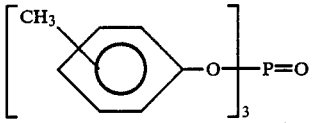
(d) Development Accelerator:
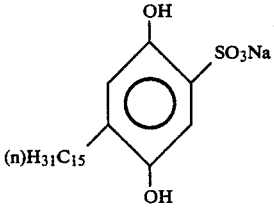
(e) Color Mixing Preventing Agent:
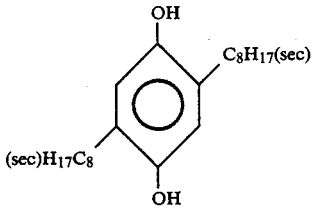
(f) Magenta Coupler:

-continued
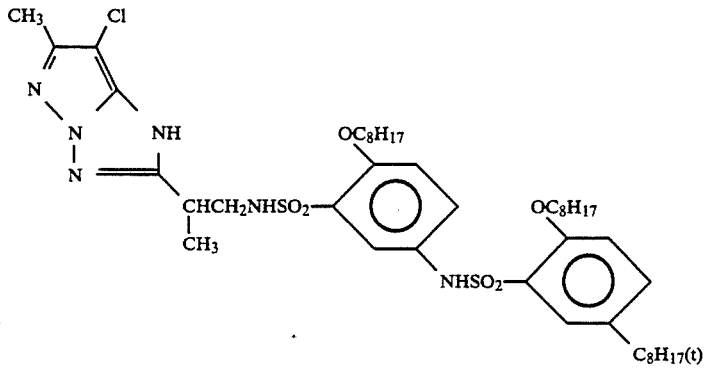
(g) Color Image Stabilizer:
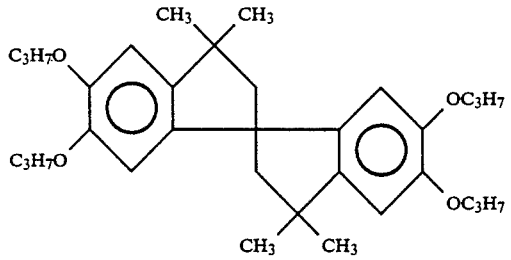
(h) Solvent:
A 2:1 (by weight) mixture of
$[(n)C_8H_{17}O]_3P{=}O$
and
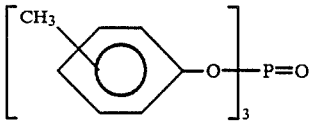
(i) Ultraviolet Absorber:
A 1:5:3 (mole ratio) mixture of
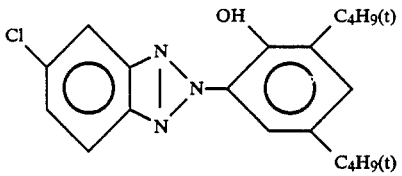
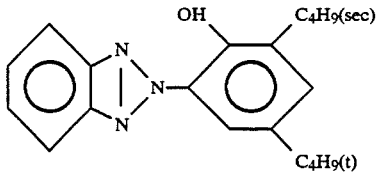
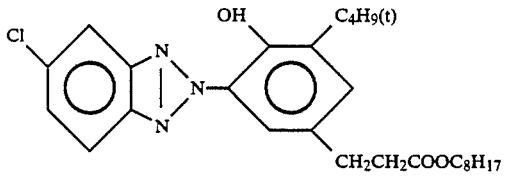
(j) Color Mixture Preventing Agent:

-continued

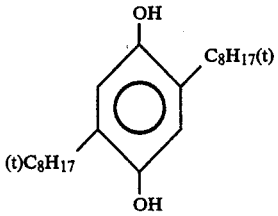

(k) Solvent:

$[isoC_9H_{19}O]_3P{=}O$ (l) Yellow Coupler:

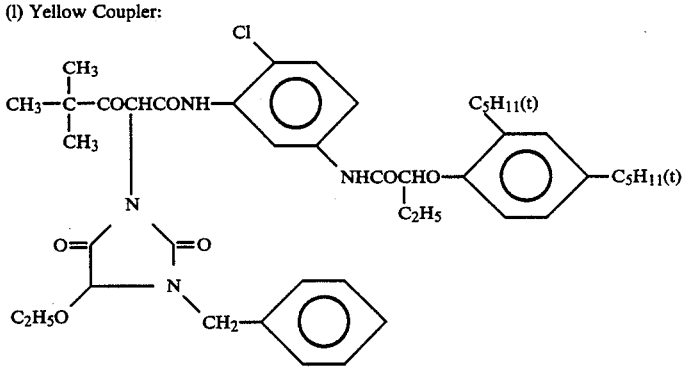

(m) Color Image Stabilizer:

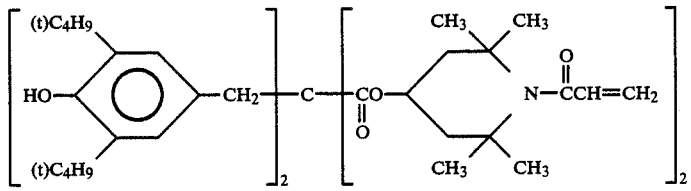

Color printing papers which had been prepared in this way were exposed through a wedge (1/10 sec, 10 CMS) and then processed using process A indicated below and the magenta colored image density was measured. On this occasion a 10 second fogging exposure (0.5 lux at the photosensitive film, color temperature 5400° K.) was made 15 seconds after the start of development.

The results obtained were as shown in Table 2.

| Processing System A | Time | Temperature |
|---|---|---|
| Color Development | 1 min 50 sec | 37° C. |
| Bleach-Fix | 40 sec | 37° C. |
| Stabilizer (1) | 20 sec | 37° C. |
| Stabilizer (2) | 20 sec | 37° C. |
| Stabilizer (3) | 20 sec | 37° C. |

The replenishment procedure for the stabilizer baths involved the replenishment of stabilizer bath (3) with transfer of the overflow from stabilizer bath (3) to stabilizer bath (2) and transfer of the overflow of stabilizer bath (2) to stabilizer bath (1), using a counter-flow replenishment system.

| [Color Developer] | Stock Solution |
|---|---|
| Diethylenetriamine pentaacetic acid | 2.0 grams |
| Benzyl alcohol | 12.8 grams |
| Diethylene glycol | 3.4 grams |
| Sodium sulfite | 2.0 grams |

-continued

| [Color Developer] | Stock Solution |
|---|---|
| Sodium bromide | 0.26 grams |
| Hydroxylamine sulfate | 2.60 grams |
| Sodium chloride | 3.20 grams |
| 3-Methyl-4-amino-N—ethyl-N—(β-methanesulfonamidoethy)-aniline | 4.25 grams |
| Potassium carbonate | 30.0 grams |
| Fluorescent whitener (Stilbene type) | 1.0 gram |
| Water to make | 1000 ml |
| pH | 10.20 |

The pH was adjusted with potassium hydroxide or hydrochloric acid.

| [Bleach-Fix Bath] | Stock Solution |
|---|---|
| Ammonium thiosulfate | 110 grams |
| Sodium bisulfite | 10 grams |
| Ammonium diethylenetriaminepentaacetato ferrate monohydrate | 56 grams |
| Disodium ethylenediaminetetraacetate dihydrate | 5 grams |
| 2-Mercapto-1,3,4-triazole | 0.5 gram |
| Water to make | 1000 ml |
| pH | 6.5 |

the pH was adjusted with ammonia or hydrochloric acid.

| [Stabilizer Bath] | Stock Solution |
|---|---|
| 1-Hydroxyethylidene-1,1'-diphosphonic acid (60%) | 1.6 ml |
| Bismuth chloride | 0.35 grams |
| Poly(vinyl pyrrolidone) | 0.25 grams |
| Aqueous ammonia | 2.5 ml |
| Nitrilotriacetic acid trisodium salt | 1.0 gram |
| 5-Chloro-2-methyl-4-isothiazoline-3-one | 50 mg |
| 2-Octyl-4-isothiazoline-3-one | 50 mg |
| Fluorescent whitener (4,4'-diaminostilbene type) | 1.0 gram |
| Water to make | 1000 ml |
| pH | 7.5 |

The pH was adjusted using potassium hydroxide or hydrochloric acid.

The FR compounds of this invention indicated in Table 2 were added at the rate of $5.0\times10^{-3}$ mol per 1 mol of silver to the third layer during the preparation of the color printing paper.

The printing papers were stored (incubated) for 3 days at a temperature 40° C., 80% RH and then exposed in the way indicated above and the magenta density was measured. The results obtained were as shown in Table 2.

TABLE 2

| | | Incubation | | | |
|---|---|---|---|---|---|
| | | No | | Yes | |
| No. | FR Compound | Dmax | Dmin | Dmax | Dmin |
| 1 | 1-3 | 2.2 | 0.10 | 2.1 | 0.10 |
| 2 | 2-5 | 2.2 | 0.10 | 2.1 | 0.10 |
| 3 | 3-1 | 2.3 | 0.10 | 2.2 | 0.10 |
| 4 | 3-4 | 2.2 | 0.10 | 2.1 | 0.10 |
| 5 | None | 2.0 | 0.10 | 1.2 | 0.14 |

Sample numbers 1 to 4 to which an FR compound of this invention had been added had a higher maximum image density when incubation had not been carried out and moreover in comparison to sample number 5 to which no FR compound had been added the fall in the maximum image density ($D_{max}$) and the rise in the minimum image density ($D_{min}$) due to incubation were both reduced in extent.

Color papers were prepared by adding FR compounds of this invention (1-2, 1-10, 2-2, 3-2, 3-3) to the first layer in the same way and similar results were obtained on incubating and exposure under the same conditions as described above at the same time as sample number 5.

Similar results were also obtained with color papers in which FR compounds of this invention (1-9, 1-19, 2-6, 3-3) had been added to the fifth layer.

It is clear from the above results that not only is the maximum image density of the direct positive color photosensitive material increased by the FR compounds of this invention but that the storage properties of the material are also improved.

EXAMPLE 2

Color printing papers were prepared in the same way as in Example 1 except that nucleating agent (N-II-9) was added at the rate of $4.5\times10^{-5}$ mol per 1 mol of silver, the nucleation accelerator (A-4) was added at the rate of $3\times10^{-4}$ mol per 1 mol of silver and moreover FR compounds of this invention as shown in Table 3 were added at the rate of $5.0\times10^{-3}$ mol per 1 mol of silver to the first, third and fifth layers. Positive color images were obtained after incubation and exposure in the same way as in Example 1 except that on this occasion the color development time was 1 minute 20 seconds and the fogging exposure was omitted. The results obtained are shown in Table 3.

TABLE 3

| | | | | Incubation | | | |
|---|---|---|---|---|---|---|---|
| | | | | No | | Yes | |
| No. | FR Cpd. | Layer to which FR Compound was added | Color of which the density was measured | Dmax | Dmin | Dmax | Dmin |
| 6 | 1-16 | Third | Magenta | 2.2 | 0.10 | 2.1 | 0.11 |
| 7 | 2-5 | " | " | 2.3 | 0.10 | 2.1 | 0.11 |
| 8 | 3-1 | " | " | 2.3 | 0.10 | 2.1 | 0.11 |
| 9 | 1-3 | First | Cyan | 2.3 | 0.10 | 2.1 | 0.10 |
| 10 | 1-5 | " | " | 2.3 | 0.10 | 2.2 | 0.11 |
| 11 | 3-2 | " | " | 2.2 | 0.10 | 2.1 | 0.11 |
| 12 | 1-6 | Fifth | Yellow | 2.2 | 0.10 | 2.1 | 0.11 |
| 13 | 1-8 | " | " | 2.3 | 0.10 | 2.2 | 0.11 |
| 14 | 3-6 | " | " | 2.2 | 0.10 | 2.1 | 0.11 |
| 15 | None | — | Magenta | 2.0 | 0.10 | 1.4 | 0.15 |
| 16 | " | — | Cyan | 2.1 | 0.10 | 1.3 | 0.15 |
| 17 | " | — | Yellow | 2.0 | 0.10 | 1.4 | 0.15 |

Sample numbers 6 to 14 which included an FR compound of this invention all had a much better maximum image density than sample numbers 15 to 17 to which no FR compound had been added. This effect was especially marked after incubation. Furthermore the increase in the minimum image density on incubation was also much smaller. That is to say, the storage properties of the photosensitive material was improved by means of this invention.

EXAMPLE 3

Color printing papers were prepared in the same way as in Example 1 except that the nucleating agent (N-1-9) was added at the rate of $3.6\times10^{-5}$ mol per 1 mol of silver and the nucleation accelerator (A-16) was added at the rate of $3\times10^{-4}$ mol per 1 mol of silver to the first, third and fifth layers, the cyan and yellow couplers indicated below were used and the FR compounds of this invention were added at the rate of $3.2\times10^{-4}$ mol per 1 mol of silver.

Cyan Coupler:

-continued

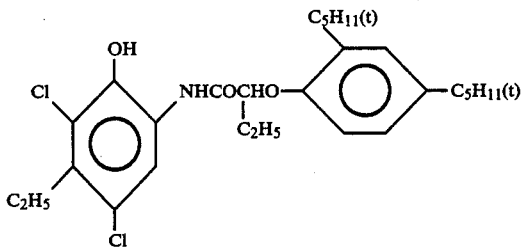

Yellow Coupler:

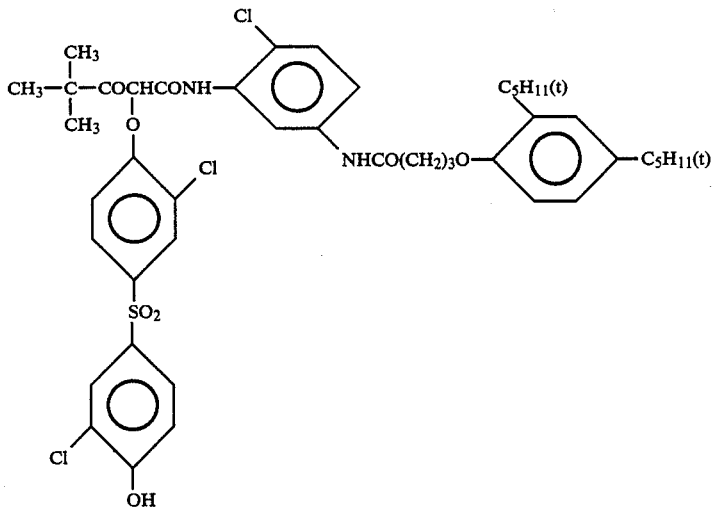

These were incubated and exposed in the same way as in Example 2. The magenta, cyan and yellow densities were measured and the maximum image densities are shown in Table 4.

TABLE 4

| No. | FR Compound: No. of Compound | FR Compound: Added to: | Color of which the density was measured | Process B Incubation: No | Process B Incubation: Yes | Process C Incubation: No | Process C Incubation: Yes | Process D Incubation: No | Process D Incubation: Yes |
|---|---|---|---|---|---|---|---|---|---|
| 18 | 1-1 | 1st Layer | Cyan | 2.3 | 2.1 | 2.4 | 2.2 | 2.1 | 2.0 |
| 19 | 1-5 | 1st Layer | " | 2.2 | 2.0 | 2.3 | 2.1 | 2.1 | 2.0 |
| 20 | 3-8 | 1st Layer | " | 2.2 | 2.0 | 2.2 | 2.0 | 2.1 | 2.0 |
| 21 | 1-16 | 3rd Layer | Magenta | 2.3 | 2.1 | 2.3 | 2.1 | 2.1 | 2.0 |
| 22 | 3-7 | 3rd Layer | " | 2.2 | 2.0 | 2.2 | 2.0 | 2.1 | 2.0 |
| 23 | 3-8 | 3rd Layer | " | 2.2 | 2.0 | 2.2 | 2.0 | 2.1 | 2.0 |
| 24 | 1-1 | 5th Layer | Yellow | 2.2 | 2.0 | 2.3 | 2.1 | 2.2 | 2.1 |
| 25 | 2-6 | 5th Layer | " | 2.3 | 2.1 | 2.3 | 2.1 | 2.2 | 2.1 |
| 26 | 3-5 | 5th Layer | " | 2.2 | 2.0 | 2.2 | 2.0 | 2.1 | 2.0 |
| 27 | None | — | Cyan | 2.0 | 1.2 | 2.1 | 1.5 | 2.0 | 1.7 |
| 28 | None | — | Magneta | 2.0 | 1.3 | 2.1 | 1.6 | 2.0 | 1.7 |
| 29 | None | — | Yellow | 2.0 | 1.2 | 2.1 | 1.5 | 2.0 | 1.7 |

| Process | pH of Color Developer | Temperature | Time |
|---|---|---|---|

TABLE 4-continued

| No. | FR Compound: No. of Compound | FR Compound: Added to: | Color of which the density was measured | Process B Incubation: No | Process B Incubation: Yes | Process C Incubation: No | Process C Incubation: Yes | Process D Incubation: No | Process D Incubation: Yes |
|---|---|---|---|---|---|---|---|---|---|
| B | | | 10.2 | | 35° C. | | 1 min 30 sec | | |
| C | | | 11.2 | | " | | 1 min 10 sec | | |
| D | | | 12.0 | | " | | 1 min 10 sec | | |

With samples 18 to 26 the fall in the maximum imaged density on incubation was smaller than in the case of the comparative examples 27 to 29 using all of processes B, C and D, which is to say on processing in developers at different pH values and on modifying the development time.

Moreover the photosensitive materials of this invention had satisfactorily high maximum image densities when processed in low pH developer.

EXAMPLE 4

Color printing papers were prepared in the same way as in Example 1 except that emulsion B was used, the yellow coupler indicated below was used for the yellow coupler in the fifth layer, the composition of the third layer was as shown in Table 5 and FR compounds of this invention were added as shown in Table 6 to the first layer at the rate of $1.5\times10^{-4}$ mol per mol of silver.

Yellow Coupler:

-continued
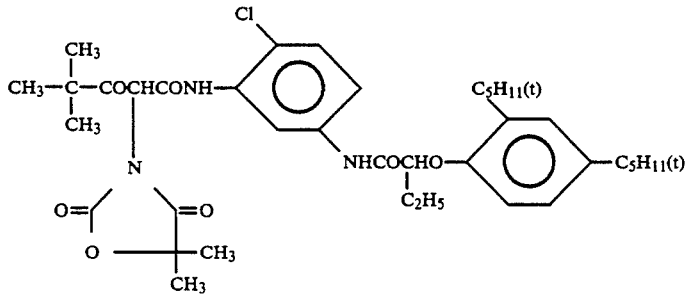
TABLE 5
| | | | |
|---|---|---|---|
| Third Layer (Green sensitive layer | Emulsion B | Silver | 0.39 g/m$^2$ |
| | Gelatin | | 1.56 g/m$^2$ |
| | Magenta Coupler (o) | | 4.60 × 10$^{-4}$ mol/m$^2$ |
| | Color Image Stabiliser (p) | | 0.14 g/m$^2$ |
| | Solvent (q) | | 0.42 g/m$^2$ |
| | Development Accelerator (d) | | 32 mg/m$^2$ |
(o) Magenta Coupler:
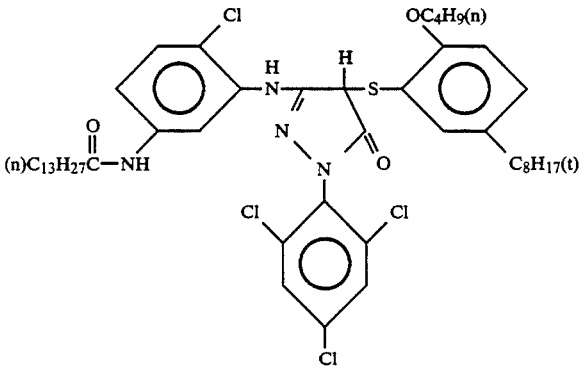
(p) Color Image Stabilizer:
A 2:3 (by weight) mixture of
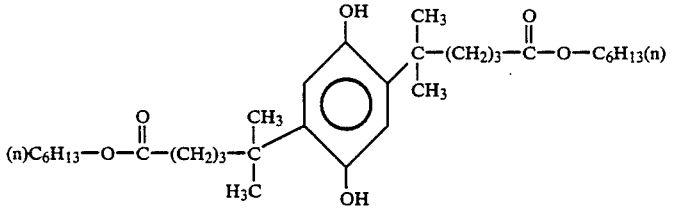
and
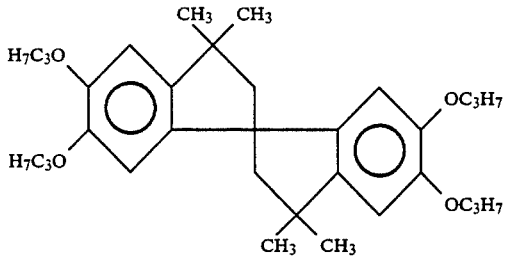
(q) Solvent:
A 1:2:2 (by weight) mixture of TABLE 5-continued

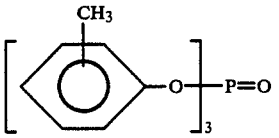

[(n)$C_8H_{17}$ O]$_3$P=O and

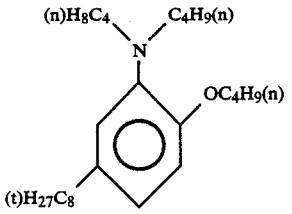

The color printing papers were incubated and exposed in the same way as in Example 1.

The maximum cyan image densities were measured and the results obtained are shown in Table 6.

TABLE 6

| No. | FR Compound | Incubation No | Incubation Yes |
|---|---|---|---|
| 30 | 1-2 | 2.2 | 2.0 |
| 31 | 1-23 | 2.1 | 2.0 |
| 32 | None | 2.0 | 1.1 |

Sample numbers 30 and 31 which contained an FR compound of this invention had much better maximum image densities that sample number 32 to which no FR compound had been added. This effect was especially marked after incubation.

EXAMPLE 5

Color printing papers were prepared in the same way as in Example 4 except that the positions of the first and third layers was reversed, the cyan coupler and the yellow coupler indicated below were used and the nucleating agent (N-II-6) was added at the rate of $3.2\times10^{-5}$ mol per mol of silver, the nucleation accelerator (A-29) was added at the rate of $1.2\times10^{-4}$ mol per mol of silver and FR compounds were added as shown in Table 7.

Cyan Coupler:

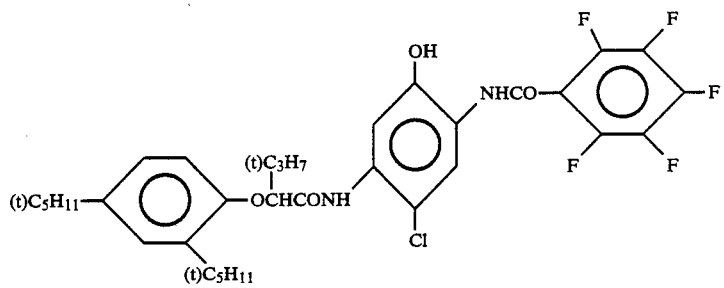

Yellow Coupler:

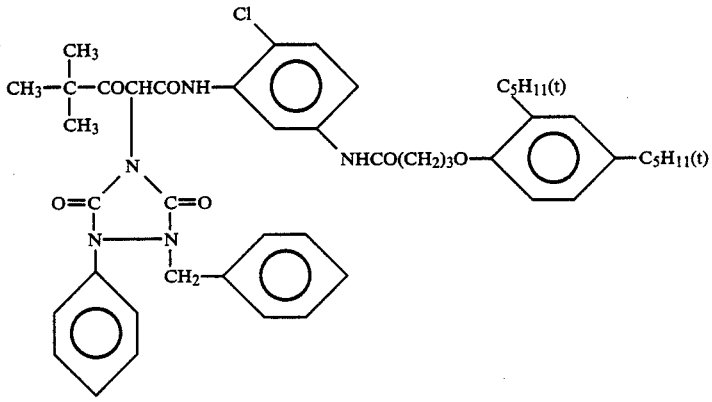

A wedge which had a rectangular wave pattern was aced on the color paper which was then exposed and processed in the same way as in Example 2. Measurement of the number of lines per mm at which the pattern could be as achieved using a microscope with a magnification of 100. These results obtained are shown in Table 7.

TABLE 7

| No. | FR Compound: Compound No. | FR Compound: Layer to which the compound was added | Resolving Power* |
|---|---|---|---|
| 33 | 1-18 | Fifth | 23 lines/mm |
| 34 | 2-2 | First | 24 |
| 35 | 3-5 | Third | 23 |
| 36 | 3-9 | First | 22 |
| 37 | None | — | 17 |

*Resolving Power: Number of lines of the rectangular wave distinguishable per mm.

Sample numbers 33 to 36 which contained FR compounds of this invention had much better resolving powers than the comparative example of sample number 37.

EXAMPLE 6

Emulsion X

An aqueous solution of silver nitrate and an aqueous solution of potassium bromide were added simultaneously at constant rate to an aqueous gelatin solution (pH=5.5) at 75° C. which contained 20 mg per liter of thioether(1,8-dihydroxy-3,6-dithiaoctane) with a well stirring while maintaining a constant silver electrode potential, an amount of silver nitrate corresponding to $\frac{7}{8}$th of a mol being added in 5 minutes, and a spherical type silver bromide monodispersed emulsion of average grain size about 0.14 μm was obtained. Next 20 mg of sodium thiosulfate and 20 mg of chloroauric acid (tetrahydrate) were added to this emulsion per 1 mol of silver halide, the pH was adjusted to 7.5 and a core emulsion was obtained by means of a chemical sensitization process carried out at 75° C. for 80 minutes while stirring the mixture thoroughly. Then an aqueous solution of silver nitrate (containing $\frac{7}{8}$ mol silver nitrate) and an aqueous potassium bromide solution were added simultaneously over a period of 40 minutes while maintaining a silver electrode potential at which regular octahedral grains would grow and stirring the mixture thoroughly at the same temperature as before to grow the shells and an octahedral core/shell type monodispersed emulsion of average grain size about 0.3 μm was obtained. The pH of this emulsion was adjusted to 6.5, 5 mg of sodium thiosulfate and 5 mg of chloroauric acid (tetrahydrate) were added per 1 mol of silver halide, a chemical sensitization treatment of the shell surface was carried out by ripening the emulsion for 60 minutes at a temperature of 75° C. and ultimately an octahedral core/shell type monodispersed emulsion of the internal latent image type (emulsion X) was obtained. The results obtained on measuring the grain size distribution of this emulsion from electronmicrographs indicated that the average grain size was 0.30 μm and that the variation coefficient (the percentage value obtained on dividing the statistical standard deviation by the aforementioned average grain size) was 10%.

Next 5 mg per 1 mol of silver halide of the panchromatic sensitizing dye 3,3'-diethyl-9-methylthiacarbocyanine was added to the above mentioned emulsion X and then $1.4\times10^{-6}$ mol per 1 mol of silver halide of (N-I-9) was added as a nucleating agent, $4.7\times10^{-4}$ mol of A-20 was added as a nucleation accelerator and FR compounds were added as-shown in Table 8. The emulsion obtained in this way was coated at the rate of 2.8 grams of silver per square meter on a polyethylene terephthalate support. At this time a protective layer consisting of gelatin and film hardening agent was coated over the emulsion layer and direct positive photographic material samples 38 to 44 which were sensitive to light into the red region were obtained.

These photosensitive materials were stored (incubated) for 3 days under conditions of temperature 50° C., 70% RH. The above mentioned photosensitive materials were exposed for 0.1 second through a step wedge in a 1 kw tungsten light (color temperature 2854° K.) sensitometer. They were then developed for 18 seconds at 38° C. in Kodak Proster Plus processing solutions (developer pH 10.7) in an automatic developing machine (Kodak Proster I Processor) and then they were water washed, fixed, water washed again and dried in the same processing machine. The maximum densities ($D_{max}$) and minimum densities ($D_{min}$) of the direct positive images of each sample obtained in this way were measured and the results obtained are shown in Table 8.

TABLE 8

| No. | FR Compound: Compound used | FR Compound: Amount added* | Incubation: No Dmax | Incubation: No Dmin | Incubation: Yes Dmax | Incubation: Yes Dmin |
|---|---|---|---|---|---|---|
| 38 | 3-1 | $2.0\times10^{-4}$ | 2.5 | 0.06 | 2.5 | 0.06 |
| 39 | 3-2 | $1.5\times10^{-5}$ | 2.4 | 0.06 | 2.4 | 0.06 |
| 40 | 3-10 | $1.5\times10^{-3}$ | 2.4 | 0.06 | 2.4 | 0.06 |
| 41 | 3-11 | $2.5\times10^{-4}$ | 2.6 | 0.06 | 2.5 | 0.06 |
| 42 | 3-12 | $1.8\times10^{-4}$ | 2.5 | 0.06 | 2.5 | 0.06 |
| 43 | 3-13 | $1.8\times10^{-4}$ | 2.4 | 0.06 | 2.4 | 0.06 |
| 44 | None | — | 2.1 | 0.06 | 1.7 | 0.06 |

*mol/1 mol of silver.

Sample numbers 38 to 43 to which FR compounds of this invention had been added had a higher maximum image density when incubation had not been carried out and the fall in the maximum image density on incubation was smaller than that observed with sample number 44 to which no FR compound had been added. That is to say the storage properties of the photosensitive material under conditions of high temperature and humidity were improved by the addition of the FR compounds of this invention.

EXAMPLE 7

Photosensitive sheets were prepared by coating the layers (1) to (11) described below sequentially onto a black support.

(1) A layer containing the cyan DRR compound indicated below (0.36 mmol/mz), tricyclohexylphophate (0.09 g/m$^2$), 2,5-di(t-pentadecyl)hydroquinone (0.01 g/m$^2$) and gelatin (0.44 g/m$^2$).

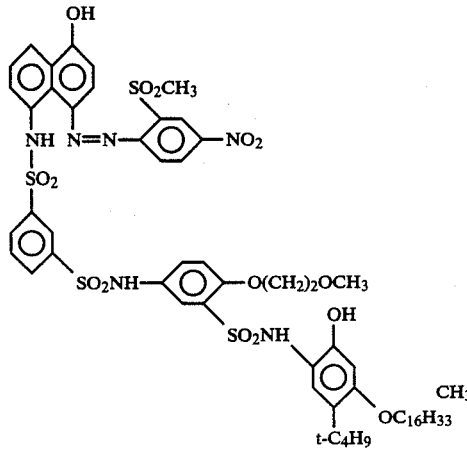

(2) A layer containing a red sensitive internal latent image type direct reversal silver bromide emulsion (emulsion A and red sensitizing dye of Example 1) (0.5 g/m$^2$ as weight of silver), gelatin (0.78 g/m$^2$), nucleating agent N-II-22 (27 μg/m$^2$) and sodium pentadecylhydroquinone sulfonate (0.06 g/m$^2$). (3) A layer containing 2,5 di(t-pentadecyl)hydroquinone (0.71 g/mz), vinyl pyrrolidone—vinyl acetate copolymer (mol ratio 7:3) (0.24 g/m$^2$) and gelatin (0.4 g/m$^2$).

(4) A layer containing gelatin (0.3 g/m$^2$).

(5) A layer containing the magenta DRR compound indicated below (0.49 g/m$^2$), tricyclohexylphosphate (0.08 g/m$^2$), 2,5-di(t-pentadecyl)hydroquinone (0.01 g/m$^2$) and gelatin (0.5 g/m$^2$).

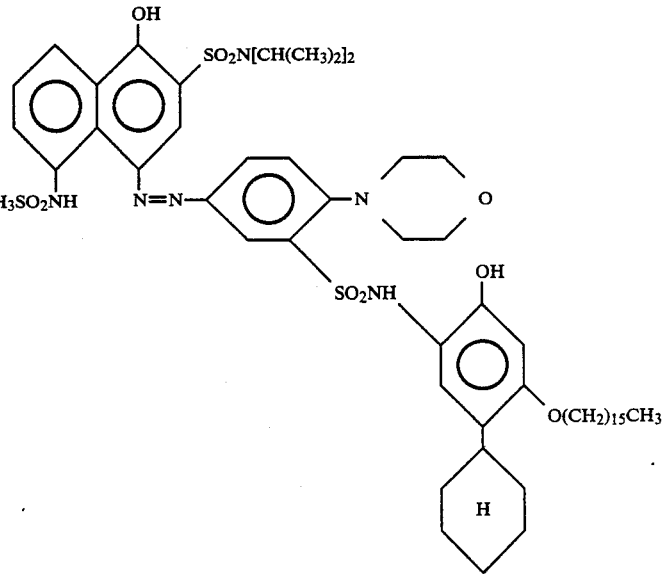

(6) A layer containing a green sensitive internal latent image type direct reversal silver bromide emulsion (emulsion A and the green sensitizing dye of Example 1) (0.34 g/m$^2$ as weight of silver), gelatin (0.66 g/m$^2$), the same nucleating agent as in layer (2) (12.9 μg/m$^2$) and sodium pentadecylhydroquinone sulfonate (0.04 g/m$^2$).

(7) A layer containing 2,5-di(t-pentadecyl)hydroquinone (0.71 g/m$^2$), vinyl pyrrolidone—vinyl acetate copolymer (mol ratio 7:3) (0.24 g/mz) and gelatin (0.4 g/m$^2$).

(8) A layer containing gelatin (0.25 g/m$^2$).

(9) A layer containing the yellow DRR compound indicated below (0.48 g/m$^2$), tricyclohexylphosphate (0.03 g/m$^2$), 2,5-di(t-pentadecyl)hydroquinone (0.004 g/m$^2$) and gelatin (0.43 g/m$^2$).

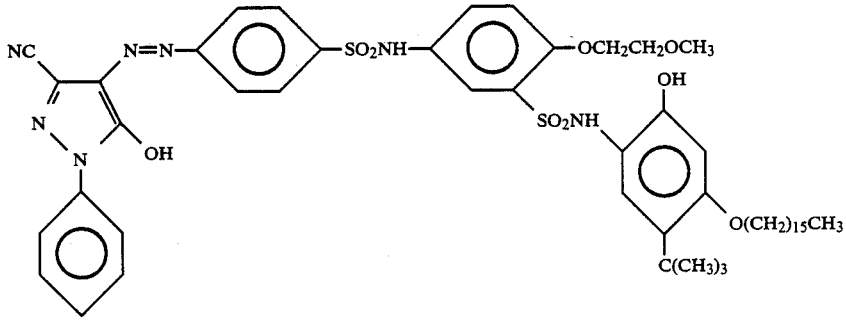

(10) A layer containing a blue sensitive internal latent image type direct reversal silver bromide emulsion (emulsion A and the blue sensitizing dye of Example 1) (0.84 g/m$^2$ as weight of silver), gelatin (0.9 g/m$^2$), the same nucleating agent as in layer (2) (29 mg/m$^2$) and sodium pentadecylhydroquinone sulfonate (0.05 g/m$^2$).

(11) A layer containing gelatin (1.0 g/m²).

A processing liquid (0.8 gram) of the composition indicated below was packed into a burstable container.

| Processing liquid | |
|---|---|
| Benzyl alcohol | 0.20 ml |
| 1-(p-tolyl)-4-hydroxymethyl-4-methyl-3-pyrazolidinone | 0.3 gram |
| Methylhydroquinone | 0.012 gram |
| 5-methylbenzotriazole | 0.6 gram |
| Sodium sulfite | 0.18 gram |
| Hydroxymethylcellulose | 4 grams |
| Potassium hydroxide (28% aqueous solution) | 22.4 ml |
| Water | 67 ml |

Furthermore, a dye image receiving sheet was prepared by coating the layers (12) to (16) indicated below sequentially onto the surface of a white support which had been coated sequentially on the reverse side with a carbon black layer and a titanium white layer.

(12) A layer containing acrylic acid—butyl acrylate (80:20, by weight) copolymer (22 g/m²) and 1,4-bis(2,3-epoxypropoxy)-butane (0.44 g/m²).

(13) A layer containing acetylcellulose (100 grams of acetylcellulose was hydrolyzed and 39.4 grams of acetyl group were formed) (3.8 g/m²) and styrene—maleic anhydride (60:40, by weight) copolymer (molecular weight about 50,000) (0.2 g/m²) and 5 (β-cyanoethylthio)-1-phenyltetrazole (0.115 g/m²).

(14) A layer containing vinylidene chloride—methyl acrylate—acrylic acid (85:12:3, by weight) copolymer latex (3.5 g/m²) and poly(methyl methacrylate) latex (particle size 1 to 3 microns) (0.05 g/m²).

(15) A mordant layer containing the mordant indicated below (3.0 g/m²) and gelatin (3.0 g/m²).

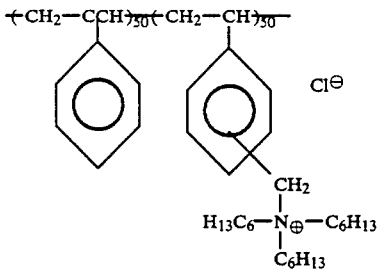

(16) A layer containing phthalated gelatin (1 g/m²).

The aforementioned light sensitive sheet was used as sample 45 and samples 46 to 48 were prepared by including the FR compounds of this invention as indicated in Table 9 in layer (2).

The samples were stored (incubated) for 3 days at 40° C. in an atmosphere of 80% RH and then exposed, after which the samples were combined with the aforementioned dye image receiving sheet and a transfer image was obtained by deploying the aforementioned processing liquid to a thickness of 60 μm between the sheets by means of a pressure applying part.

The maximum cyan image densities obtained were measured and the results are shown in Table 9.

TABLE 9

| No. | FR Compound: Compound used | FR Compound: Amount added (mol/mol Ag) | Incubation: No | Incubation: Yes |
|---|---|---|---|---|
| 45 | None | — | 2.2 | 1.5 |
| 46 | 3-1 | $1.2 \times 10^{-5}$ | 2.4 | 2.1 |
| 47 | 3-13 | $8 \times 10^{-6}$ | 2.4 | 2.2 |
| 48 | 3-2 | $3 \times 10^{-6}$ | 2.5 | 2.2 |

In sample numbers 46 to 48 where an FR compound of this invention had been added to the photosensitive material for use in a diffusion transfer process the maximum image density was higher in the absence of incubation and moreover the fall in the maximum image density on incubation was less than that observed in the case of sample number 45 to which no FR compound had been added.

Similar results were obtained in tests carried out on adding the FR compounds 3-10, 3-11 and 3-5 to layer (6) or FR compounds 3-12, 3-13 and 3-6 to layer (10).

EXAMPLE 8

Color printing papers were prepared in the same way as in example 1 except that the nucleating agent (N-I-14) was added at the rate of $3.7 \times 10^{-6}$ mol per 1 mol of silver and the nucleation accelerator (A 20) was added at the rate of $3.0 \times 10^{-4}$ mol per 1 mol of silver to the first, third and fifth layers and moreover FR compounds of this invention were added at the rate of $1.0 \times 10^{-2}$ mol. % (mol/% with respect to silver) in the way indicated in Table 10.

These color printing papers were incubated in the same way as in Example 1 and then exposed and subjected to the processing treatment E. Moreover the processing treatment E was carried out using an automatic developing machine which had a developing tank of 5 liter capacity and bleach-fix tank and water wash tank capacities of 3 liters each. The results shown in Table 10 were obtained by measuring the colour image densities of samples processed after first processing 20 mz of sample 49.

TABLE 10

| No. | FR Compound: Compound used | FR Compound: Layer to which the compound was added | Color of which the density was measured | Incubation: No Dmax | Incubation: Yes Dmax |
|---|---|---|---|---|---|
| 49 | 2-16 | Third | Magenta | 2.2 | 2.2 |
| 50 | 2-17 | " | " | 2.3 | 2.3 |
| 51 | 3-11 | " | " | 2.2 | 2.2 |
| 52 | 1-4 | First | Cyan | 2.4 | 2.4 |
| 53 | 2-7 | " | " | 2.4 | 2.4 |
| 54 | 1-28 | " | " | 2.3 | 2.3 |
| 55 | 3-13 | " | " | 2.4 | 2.4 |
| 56 | 1-6 | Fifth | Yellow | 2.3 | 2.2 |
| 57 | 1-17 | " | " | 2.3 | 2.3 |
| 58 | 1-23 | " | " | 2.4 | 2.3 |
| 59 | None | — | Magenta | 2.0 | 1.6 |
| 60 | None | — | Cyan | 2.1 | 1.5 |
| 61 | None | — | Yellow | 2.0 | 1.6 |

Sample numbers 49 to 58 of this invention had much better $D_{max}$ values than the comparative example numbers 59 to 61 both before and after incubation.

| Processing Treatment E | Time | Temperature | Replenishment Rate |
|---|---|---|---|
| Color Development | 90 sec | 38° C. | 290 ml/m$^2$ |
| Bleach-Fix | 45 sec | 35° C. | 290 ml/m$^2$ |
| Water Wash (1) | 30 sec | 35° C. | |
| Water Wash (2) | 30 sec | 35° C. | |
| Water Wash (3) | 30 sec | 35° C. | 320 ml/m$^2$ |

The replenishment of the wash water was carried out by replenishing the water wash bath (3). The overflow from the water wash bath (3) was fed into the water wash bath (2) and the overflow from this bath was supplied to water wash bath (1) to establish a counter-flow replenishment system. At this time the photosensitive material carried over 35 ml/m$^2$ of solution from the previous bath and so the replenishment rate was 9.1 times.

| [Color Developer] | Stock Solution | Replenisher |
|---|---|---|
| Diethylenetriamine pentaacetic acid | 0.5 gram | 0.5 gram |
| 1-hydroxyethylidene-1,1-diphosphonic acid | 0.5 gram | 0.5 gram |
| Diethylene glycol | 8.0 grams | 13.0 grams |
| Benzyl alcohol | 12.0 grams | 18.5 grams |
| Sodium bromide | 0.7 gram | — |
| Sodium chloride | 0.5 gram | |
| Sodium sulfite | 2.0 grams | 2.5 grams |
| N,N-Diethylhydroxylamine | 3.5 grams | 4.5 grams |
| Triethylenediamine(1,4-diazabicyclo[2,2,2]octane) | 3.5 grams | 4.5 grams |
| 3-Methyl-4-amino-N-ethyl-N-(β-methanesulfonamidoethyl)aniline | 5.5 grams | 8.0 grams |
| Potassium carbonate | 30.0 grams | 30.0 grams |
| Fluorescent whitener (stilbene type) | 1.0 gram | 1.3 grams |
| Pure water to make | 1000 ml | 1000 ml |
| pH | 10.50 | 10.90 |

The pH was adjusted using potassium hydroxide or hydrochloric acid.

| [Bleach-Fix Bath] | Stock Solution = Replenisher |
|---|---|
| Ammonium thiosulfate | 100 grams |
| Sodium bisulfite | 21.0 grams |
| Ammonium ethylenediaminetetraacetato ferrate dihydrate | 50.0 grams |
| Ethylenediamine tetraacetic acid disodium salt, dihydrate | 5.0 grams |
| Pure water to make | 1000 ml |
| pH | 6.3 |

The pH was adjusted with aqueous ammonia or hydrochloric acid.

[Wash Water]

Pure water was used (Stock=replenisher)

In this context pure water signifies tap water from which all cations other than hydrogen ions and all anions other than hydroxyl ions had been reduced to concentrations of less than 1 ppm by means of an ion exchange process.

EXAMPLE 9

Example 1 was repeated except that the processing treatment was changed from process A to process F outlined below and similar results to those obtained in example 1 were obtained.

| Processing Treatment F | Time | Temperature | Replenishment Rate |
|---|---|---|---|
| Color Development*1 | 135 sec | 36° C. | 320 ml/m$^2$ |
| Bleach-Fix | 40 sec | 36° C. | 320 ml/m$^2$ |
| Stabilizing (1)*2 | 40 sec | 36° C. | |
| Stabilizing (2)*2 | 40 sec | 36° C. | 320 ml/m$^2$ |
| Drying | 40 sec | 70° C. | |

| [Color Developer] | Stock Solution | Replenisher |
|---|---|---|
| Hydroxyethylimino-diacetic acid | 0.5 gram | 0.5 gram |
| Monoethylene glycol | 9.0 grams | 10.0 grams |
| Benzyl alcohol | 9.0 grams | 10.0 grams |
| Monoethanolamine | 2.5 grams | 2.5 grams |
| Sodium bromide | 2.3 grams | 1.5 grams |
| Sodium chloride | 5.5 grams | 4.0 grams |
| N,N-diethylhydroxylamine | 5.9 grams | 6.5 grams |
| 3-Methyl-4-amino-N-ethyl-N-(β-methanesulfonamidoethyl)aniline | 2.7 grams | 3.0 grams |
| 3-Methyl-4-amino-N-ethyl-N-hydroxyethylaniline | 4.5 grams | 5.0 grams |
| Potassium carbonate | 30.0 grams | 35.0 grams |
| Fluorescent whitener (stilbene type) | 1.0 gram | 1.2 grams |
| Pure water to make | 1000 ml | 1000 ml |
| pH | 10.30 | 10.70 |

*1Color developed while exposing to while light of intensity 1 lux for 15 seconds starting from 15 seconds after immersion in the color developer.

*2Stabilizer replenishment with a counter-flow system from stabilizing bath (2) to stabilizing bath (1).

The pH was adjusted using potassium hydroxide or hydrochloric acid.

| [Bleach-Fix Bath] | Stock Solution = Replenisher |
|---|---|
| Ammonium thiosulfate | 110 grams |
| Sodium bisulfite | 12 grams |
| Ammonium diethylenetriaminepentaacetato ferrate | 80 grams |
| Diethylenetriamine pentaacetic acid | 5 grams |
| 2-Mercapto-5-amino-1,3,4-thiadiazole | 0.3 gram |
| Pure water to make | 1000 ml |
| pH | 6.80 |

The pH was adjusted using aqueous ammonia or hydrochloric acid.

| [Stabilizer] | Stock Solution = Replenisher |
|---|---|
| 1-Hydroxyethylidene-1,1-diphosphonic acid | 2.7 grams |
| o-Phenylphenol | 0.2 gram |
| Potassium chloride | 2.5 grams |
| Bismuth chloride | 1.0 gram |
| Zinc chloride | 0.25 gram |
| Sodium sulfite | 0.3 gram |
| Ammonium sulfate | 4.5 grams |
| Fluorescent whitener (stilbene type) | 0.5 gram |
| Pure water to make | 1000 ml |
| pH | 7.2 |

The pH was adjusted with potassium hydroxide or hydrochloric acid.

EXAMPLE 10

Example 8 was repeated except for the use of 3-methyl-4-amino-N-ethyl-N-(β-methanesulfonamidoethyl-)aniline (3.5 g/l) and 3-methyl-4-amino-N-ethyl-N-hydroxyethylaniline (3.0 g/l) as the developing agent in the color developer, and similar results were obtained.

EXAMPLE 11

Example 8 was repeated except for the fact that the coating rates of the first, third and fifth layers and the B1 layer were each increased by a factor of 1.5 times and the use of transparent polyethyleneterephthanol (100 μm) for the support, and similar results were obtained.

EXAMPLE 12

A monodispersed octahedral internal latent image type emulsion C of average grain size 0.4 μm (variation coefficient 8.5%) was obtained in the same way as emulsion A except that the core grain formation was carried out at a temperature of 55° C.

Example 8 was repeated using an emulsion consisting of a 1/1 mixture, by silver content, of emulsions A and C, and similar results were obtained.

EXAMPLE 13

Example 8 was repeated except for the fact that the first, third and fifth layers were each separated into two layers (with a total silver content the same as in example 8) and emulsion A was used for the layer farthest away from the support and the emulsion C was used for the layer closest to the support, and similar results were obtained.

EXAMPLE 14

Example 8 was repeated except for the fact that (N-I-9) was added at the rate of $2.5\times10^{-6}$ mol per mol of silver as nucleating agent and (A-26) was added at the rate of $3.5\times10^{-4}$ mol per mol of silver as nucleation accelerator to the emulsion layer and the FR compounds were added as indicated in Table 11 at the rate of $3.5\times10^{-2}$ mol per mol of silver, and similar results were obtained.

TABLE 11

| | FR Compound | |
|---|---|---|
| No. | Compound Used | Layer to which the compound was added |
| 1 | 1-2 | First |
| 2 | 1-7 | Fifth |
| 3 | 1-9 | Fifth |
| 4 | 1-24 | First |
| 5 | 1-25 | Fifth |
| 6 | 2-9 | Fifth |
| 7 | 2-10 | Fifth |
| 8 | 2-15 | Third |
| 9 | 2-20 | First |
| 10 | 3-10 | First |
| 11 | 3-10 | Fifth |
| 12 | 3-11 | Third |
| 13 | 3-12 | First |
| 14 | 3-12 | Third |
| 15 | 3-12 | Fifth |

EXAMPLE 15

Example 8 was repeated except for the fact that nucleating agents and nucleation accelerators were used in the first, third and fifth layers as indicated in Table 12 and FR compounds were used as shown in Table 13 and similar results were obtained.

TABLE 12

| | Nucleating Agent | | Nucleation Accelerator | |
|---|---|---|---|---|
| No. | Compound | Amount Added* | Compound | Amount Added* |
| 1 | N-I-2 | $3.5\times10^{-5}$ | A-5 | $4.7\times10^{-5}$ |
| 2 | N-I-6 | $5.8\times10^{-5}$ | A-6 | " |
| 3 | N-I-3 | $2.6\times10^{-5}$ | A-16 | " |
| 4 | N-I-4 | $3.2\times10^{-5}$ | A-17 | " |
| 5 | N-I-10 | $4.8\times10^{-6}$ | A-20 | " |
| 6 | N-I-11 | $1.8\times10^{-6}$ | A-26 | " |
| 7 | N-I-12 | $3.0\times10^{-6}$ | A-30 | " |
| 8 | N-I-13 | $1.8\times10^{-6}$ | A-32 | " |
| 9 | N-I-14 | $1.8\times10^{-6}$ | A-29 | " |
| 10 | N-II-11 | $5.8\times10^{-5}$ | A-25 | " |
| 11 | N-II-7 | $6.5\times10^{-5}$ | A-21 | " |
| 12 | N-II-6 | $7.2\times10^{-5}$ | A-18 | " |

*Amount added, mol/mol of silver

TABLE 13

| No. | FR Compound Used | Amount Added** |
|---|---|---|
| I | 3-10 | $3.6\times10^{-5}$ |
| II | 1-26 | $2.5\times10^{-4}$ |
| III | — | — |

**Amount added, mol/mol of silver

What is claimed is:

1. Direct positive photographic photosensitive materials comprising at least one type of FR compound which releases fogging agent or development accelerator or a precursor thereof in accordance with the amount of silver developed when the non-pre-fogged internal type silver halide being developed is included in a direct positive photographic material comprising at least one layer of non-pre-fogged internal latent image type silver halide emulsion on a support and a nucleating agent.

2. Direct positive photographic materials as claimed in claim (1), in which the said FR compound is a compound which can be represented by the general formula [1] below, General Formula [1]:

$$Cp—(TIME)_n—FA$$

wherein Cp represents a coupling group residue which can undergo a coupling reaction with the oxidized form of a primary aromatic amine developing agent; TIME represents a timing group which releases FA, after it has been eliminated from Cp, by means of a coupling reaction; n has a value of 0 or 1; and FA represents a fogging agent or development accelerator which acts upon the silver halide grains during development and forms fogging nuclei at which development, can begin.

3. Direct positive photographic materials as claimed in claim (1), in which the said FR compound is a compound which can be represented by the general formula [2] below, General Formula[2]:

$$BALL—Cp—(TIME)_n—FA$$

wherein Cp represents a coupling group residue which can undergo a coupling reaction with the oxidized form of a primary aromatic amine developing agent; BALL represents group which is fast to diffusion which can be eliminated from Cp by means of the coupling reaction with the oxidized form of the primary aromatic amine developing agent; TIME represents a timing group which releases FA, after it has been eliminated from Cp, by means of a coupling reaction; n has a value of 0 or 1; and FA represents a fogging agent or development accelerator which acts upon the silver halide grains during development and forms fogging nuclei at which development can begin, in which FA does not need to be eliminated from Cp or TIME after the coupling reaction.

4. Direct positive photographic materials as claimed in claim (1), in which the said FR compound is a compound which can be represented by the general formula [3]below, General Formula [3]:

$$\text{RED}-(\text{TIME})_n-\text{FA}$$

wherein RED represents a compound residual group which can undergo an oxidation-reduction reaction with the oxidized form of the primary aromatic amine developing agent; TIME represents a timing group which releases FA, after it has been eliminated from RED, by means of a coupling reaction; n has a value of 0 or 1; and FA represents a fogging agent or development accelerator which acts upon the silver halide grains during development and forms fogging nuclei at which development can begin.

5. Direct positive photographic materials as claimed in any of claims (2) to (4), in which the said FA has a group which acts reductively upon the silver halide grains during development and forms fogging nuclei.

6. Direct positive photographic materials as claimed in any of claims (2) to (4), in which the said FA has a group which acts on the silver halide grains during development and forms silver sulfide nuclei.

7. A method of forming direct positive images comprising that in a method for the formation of direct positive images in which a direct positive photographic photosensitive material comprising at least one layer of non-pre-fogged internal latent image forming silver halide emulsion on a support is processed, after image exposure, in a surface developer, wherein at least one type of FR compound which releases fogging agent or development accelerator or precursors thereof is included in the said photographic material, and that the said photosensitive material is subjected to a fogging process and to a development process during and/or after the said fogging process.

8. A method of forming direct positive images as claimed in claim (7), in which said fogging process is carried out using light fogging.

9. A method of forming direct positive images as claimed in claim (7), in which the said fogging process is carried out by the presence of a nucleating agent.

10. A method of forming direct positive images as claimed in claim (7), in which the said development process is carried out at pH 11.5 or below.

11. A method of forming direct positive images as claimed in claim (7), in which the said development process is carried out using a primary aromatic amine developing agent.

12. The direct positive photographic material claimed in claim 1 wherein the nucleating agent is represented by the general formula [N-I]

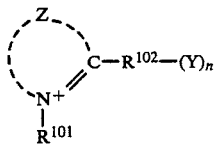

wherein Z represents a non-metallic atomic group required to form a 5 or 6 membered substituted or unsubstituted heterocyclic ring; $R^{101}$ is a substituted or unsubstituted aliphatic group; R is a hydrogen atom, a substituted or unsubstituted aliphatic group or a substituted or unsubstituted aromatic group; wherein at least one of the groups represented by $R^{101}$, $R^{102}$ and Z contains an alkynyl group, acyl group, hydrazine group or a hydrazone group or $R^{101}$ and $R^{102}$ form a 6 membered ring, and a dihydropyridinium skeleton is formed; and $R^{101}$ to $R^{102}$ and Z may be substituted with at least one $X^1-(L^1)_m$ group, wherein X is a group for promoting adsorption on silver halide, $L^1$ is a divalent linking group, and m is 0 or 1; Y is a counter ion to balance electrical charge and n is 0 or 1: and/or general formula [N-II]

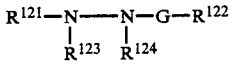

wherein $R^{121}$ represents an aliphatic group, aromatic group or a heterocyclic group; $R^{122}$ represents a hydrogen atom, alkyl group, aralkyl group, aryl group, alkoxy group, aryloxy group or amino group: G represents a carbonyl group, sulfonyl group, sulfoxy group, phosphoryl group or iminomethylene group (NH=C<); and $R^{123}$ and $R^{124}$ both represent hydrogen atoms or one represents a hydrogen atom and the other represent an alkylsulfonyl group, arylsulfonyl group or an acyl group; and a hydrazine structure (>N—N=C<) may be provided in a form which contains G, $R^{123}$, $R^{124}$ and the hydrazine nitrogen; and said $R^{121}$, $R^{122}$, $R^{123}$, $R^{124}$ and G may be substituted with substituent groups.

* * * * *